US007107797B2

(12) United States Patent
Frullini et al.

(10) Patent No.: US 7,107,797 B2
(45) Date of Patent: Sep. 19, 2006

(54) METHOD AND APPARATUS FOR JOINING THE EDGES OF A TUBULAR KNITTED ARTICLE

(75) Inventors: Paolo Frullini, Florence (IT); Alberto Frullini, Florence (IT)

(73) Assignees: Fabritex S.r.l, (IT), part interest; Sangiacomo, S.p.A., (IT), part interest ( * ) Notice: Subject to any disclaimer, the term of this patent is extended or adjusted under 35 U.S.C. 154(b) by 0 days.

(21) Appl. No.: 10/532,063

(22) PCT Filed: Oct. 17, 2003

(86) PCT No.: PCT/IT03/00638

§ 371 (c)(1),
(2), (4) Date: Dec. 14, 2005

(87) PCT Pub. No.: WO2004/035894

PCT Pub. Date: Apr. 29, 2004

(65) Prior Publication Data

US 2006/0144095 A1 Jul. 6, 2006

(30) Foreign Application Priority Data

Oct. 21, 2002 (IT) ..... FI20020199

(51) Int. Cl.
*D04B 9/56* (2006.01)

(52) U.S. Cl. ..... 66/148

(58) Field of Classification Search ..... 66/147, 66/148, 19, 31, 58, 48, 47
See application file for complete search history.

(56) References Cited

U.S. PATENT DOCUMENTS

| | | | | |
|---|---|---|---|---|
| 5,570,591 | A * | 11/1996 | Frullini et al. | 66/58 |
| 5,727,400 | A * | 3/1998 | Lonati et al. | 66/148 |
| 5,761,931 | A * | 6/1998 | Lonati et al. | 66/148 |
| 6,105,399 | A * | 8/2000 | Frullini et al. | 66/148 |
| 6,164,091 | A * | 12/2000 | Frullini et al. | 66/148 |
| 6,389,849 | B1 | 5/2002 | Conti | |

FOREIGN PATENT DOCUMENTS

| | | |
|---|---|---|
| EP | 0 592 376 | 4/1994 |
| EP | 0 635 593 | 1/1995 |
| EP | 0 942 086 | 9/1999 |
| WO | WO 02/070801 | 9/2002 |

* cited by examiner

*Primary Examiner*—Danny Worrell
(74) *Attorney, Agent, or Firm*—McGlew & Tuttle, PC

(57) ABSTRACT

The invention refers to a method and apparatus for joining the edges of a tubular knitted article, such as a stocking, upon the completion of the latter on a circular machine; the apparatus comprises a movable carrier able to be associated with a knitting head of a circular machine, and the said carrier supports means for the removal of stitches of the last knitted rank, in which the means operate the removal of one semi-rank, that is, of half the stitches of said last knitted rank, and the means operate the removal of the other semi-rank; the movable carrier being provided with driving means and transfer means able to move the stitches of one semi-rank onto the means which remove the other semi-rank.

37 Claims, 51 Drawing Sheets

METHOD AND APPARATUS FOR JOINING THE EDGES OF A TUBULAR KNITTED ARTICLE

The present invention refers to a method and apparatus for joining the edges of a tubular knitted article, such as a stocking, upon the completion of the latter on a circular machine.

Methods and machines are known for closing tubular articles. In particular, the European Patents EP-0.592.376 and EP-0.635.593 disclose how to close tubular articles, specifically with a hooked-up finish, by carrying out the above said operation on the outer or right-side out of the article. The document Ep-0.942.086 discloses how to hook-up the fabric edges on the desired side by applying an operating method which takes into account the type of article's manufacturing machine. In particular, provision is made for possibly hooking-up on the inner or inside-out side of the article by removing in advance the same article from a one-cylinder machine.

The above mentioned solutions, although representing undoubtedly an advance with respect to the existing systems, suffer from some drawbacks. One drawback relates to the excessive handling of the stitches, that is, an excessive number of transfers thereof to and from various members which brings about a higher possibility of losses and/or damages of the same stitches. Another drawback is the fact that the means and machines so constructed may result relatively complex and thus apt to be industrialized only by industries exhibiting advanced technology and a high level of know-how. The above drawbacks, which relate to one-cylinder machines, hold true also in the case of removing the articles from the lower cylinder of a two-cylinder machine, that is, in case the stitches are removed with their right side out.

The object of the present invention is to overcome the said drawbacks.

This result has been achieved, according to the invention, by providing a method and apparatus having the features disclosed in the independent claims. Further characteristics being set forth in the dependent claims.

Among the advantages of the present invention, one is that it provides the solution for the major problem concerning the case in which the article is removed from the cylinder of a one-cylinder machine or the lower cylinder of a two-cylinder machine, with its right-side out and by a limited number of stitch transfers; in fact, one important characteristic of the operating method according to the present invention is that the transfer of the stitches from the first semi-rank takes place by a 180°-overturning of the same means which have carried out the removal thereof and, thus, without any transfer of the stitches onto further means, thereby limiting the handling thereof. Moreover, the apparatus implementing the method according to the invention results extremely simple to make and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense, wherein.

Figure 4:
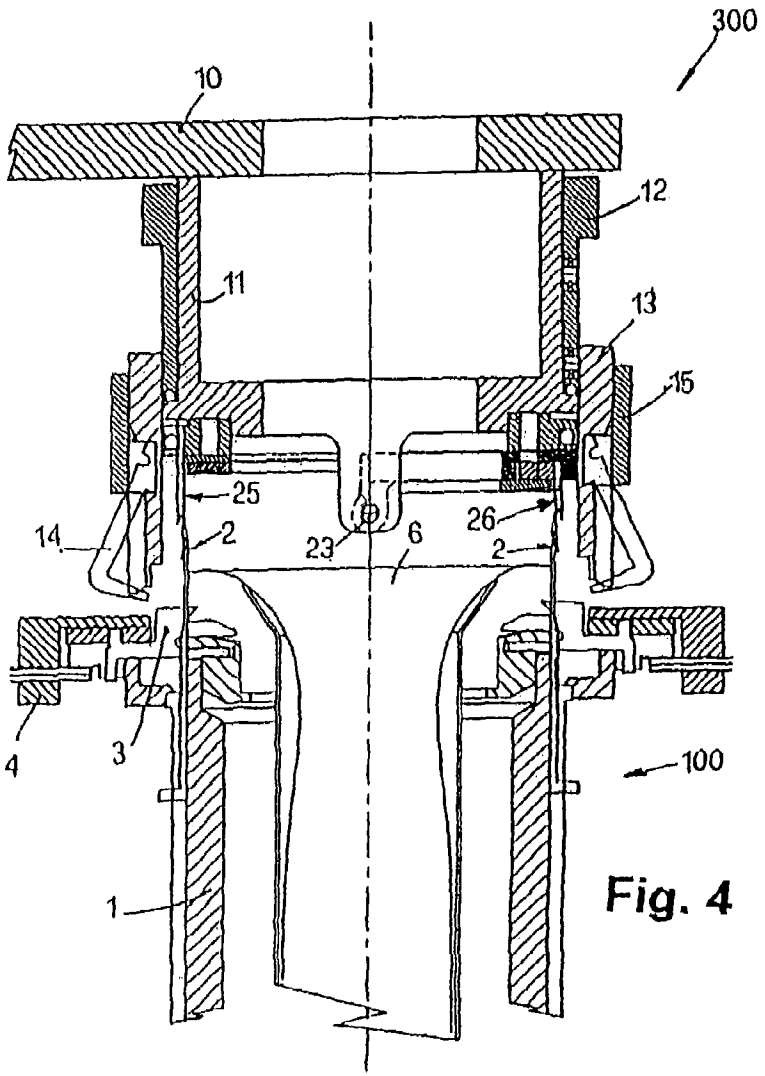
Figure 3:
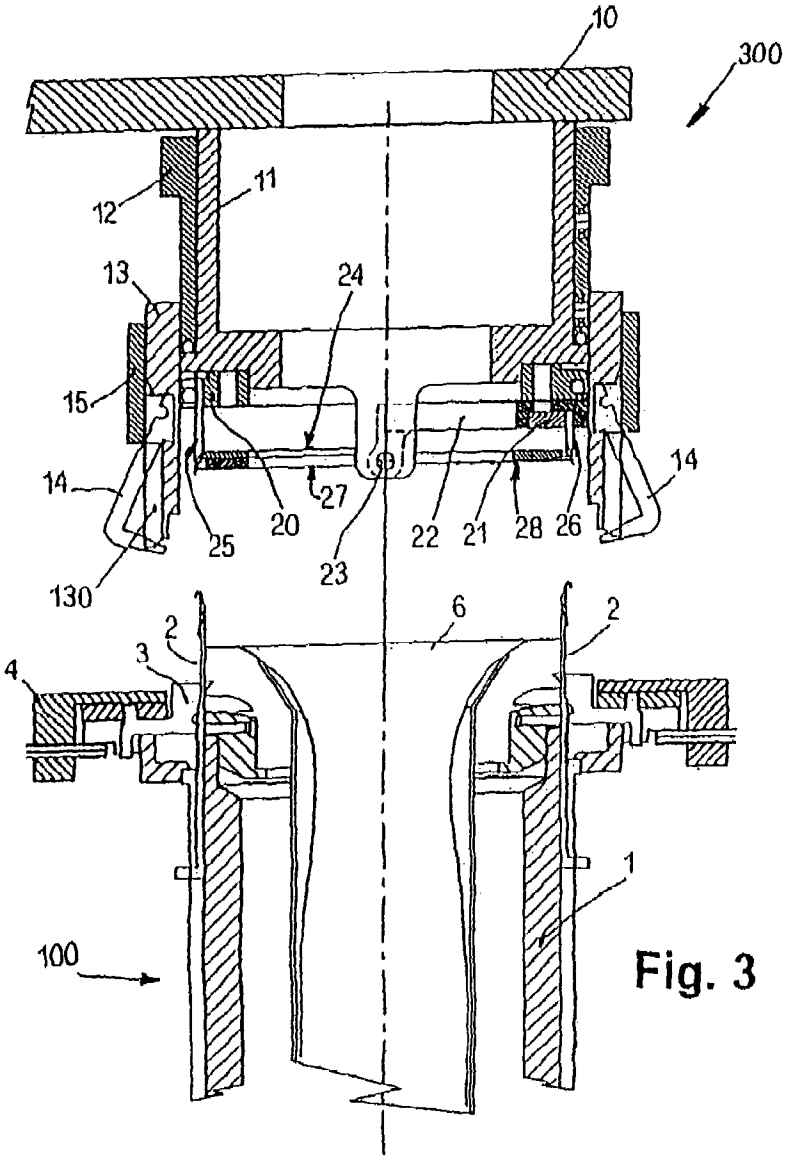
Figure 6:
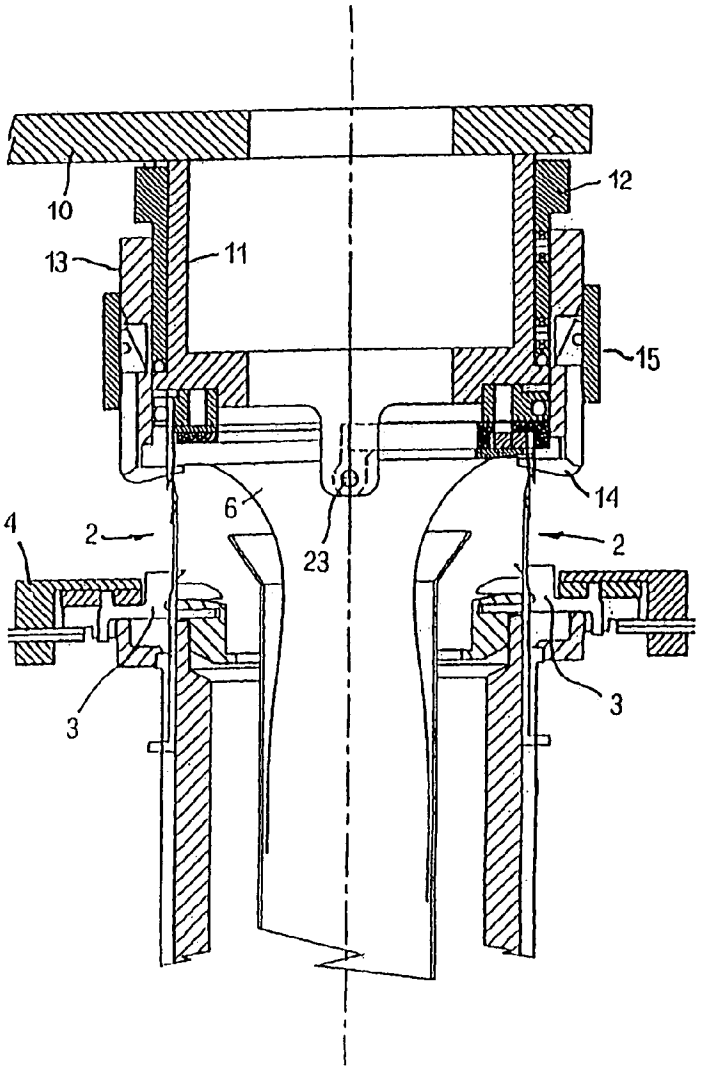
Figure 5:
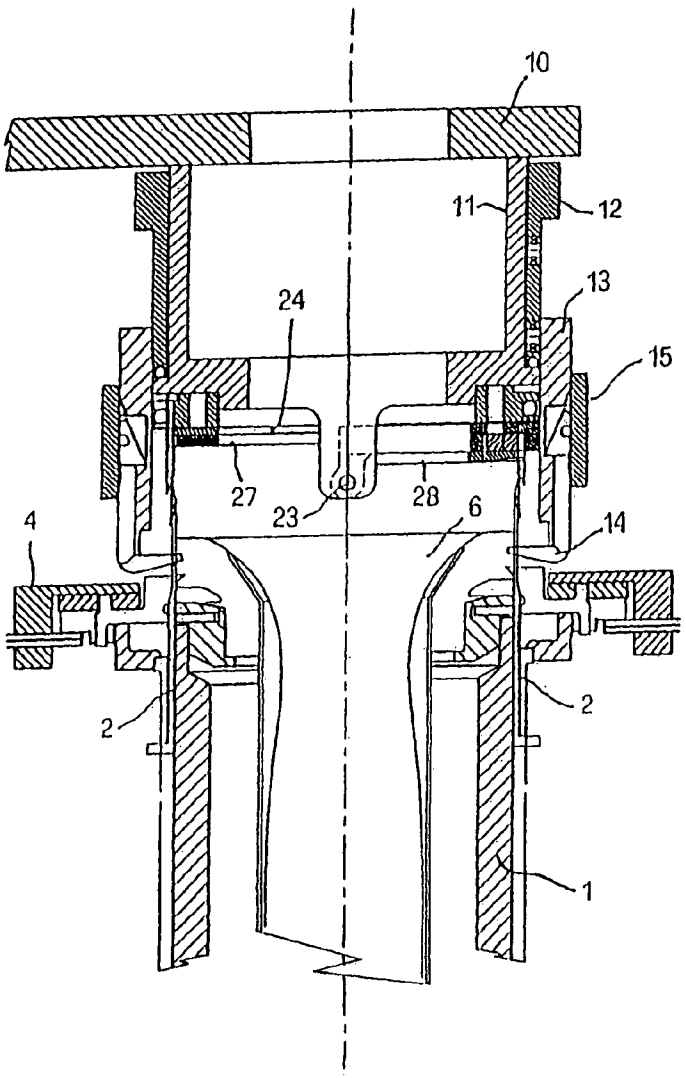
Figure 8:
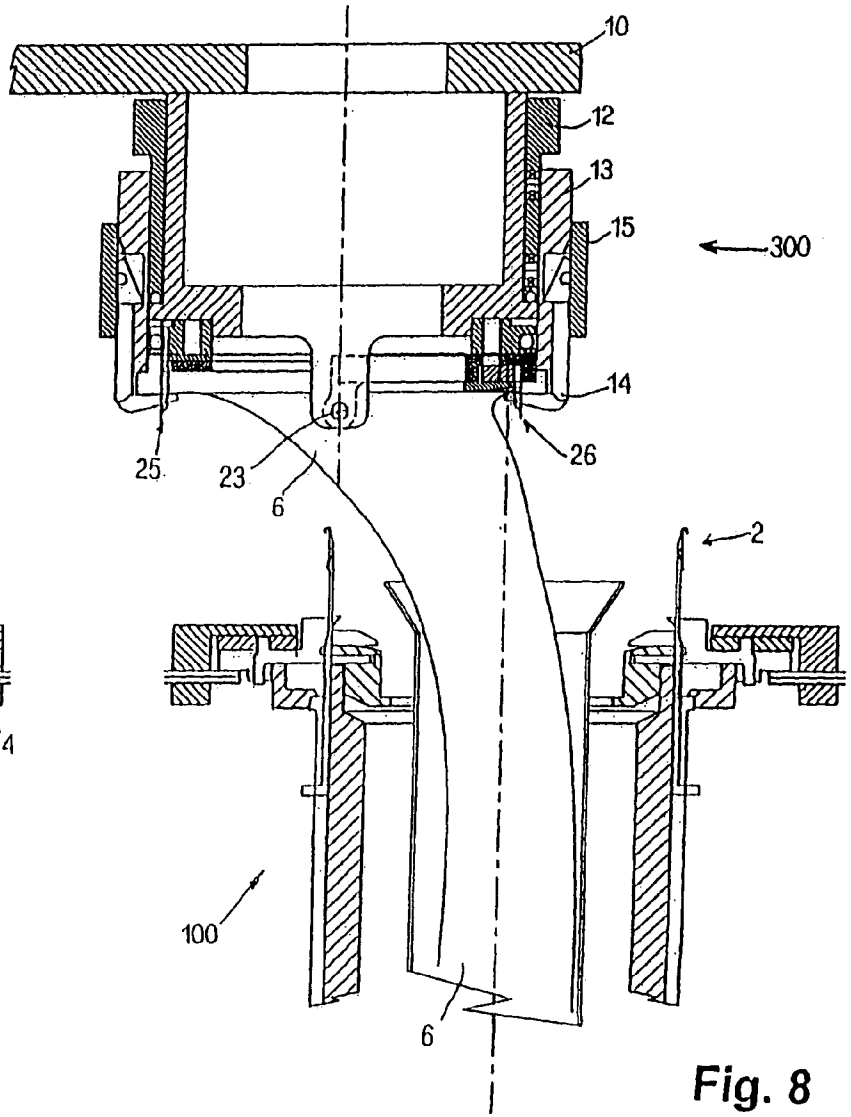
Figure 7:
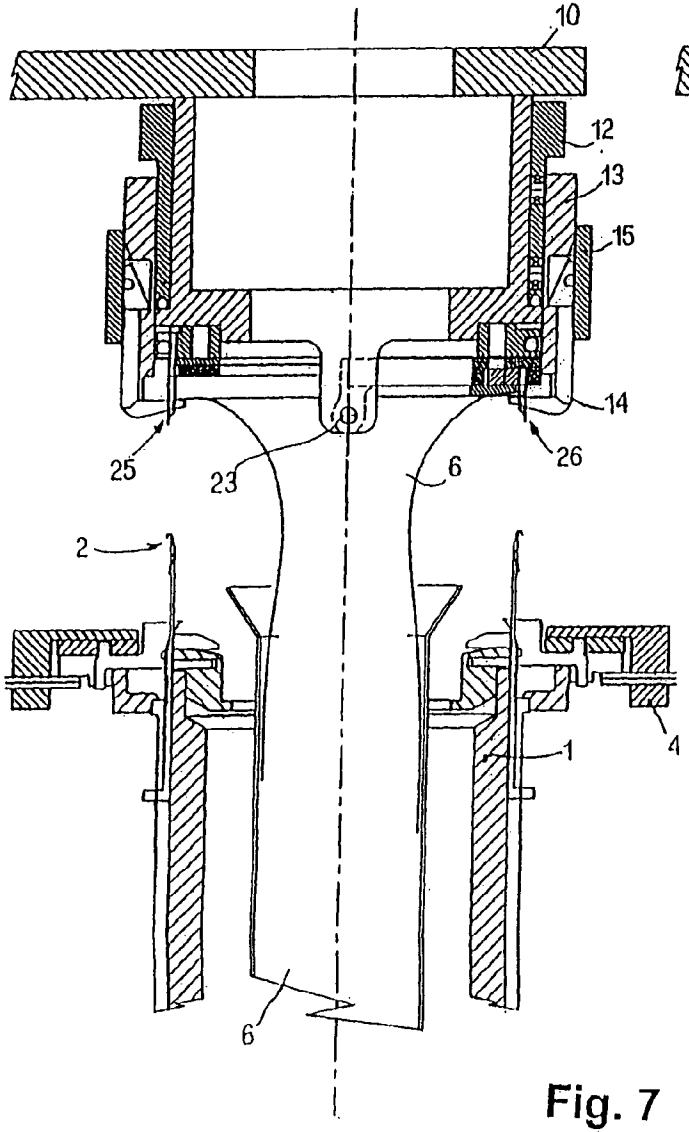
Figure 9:
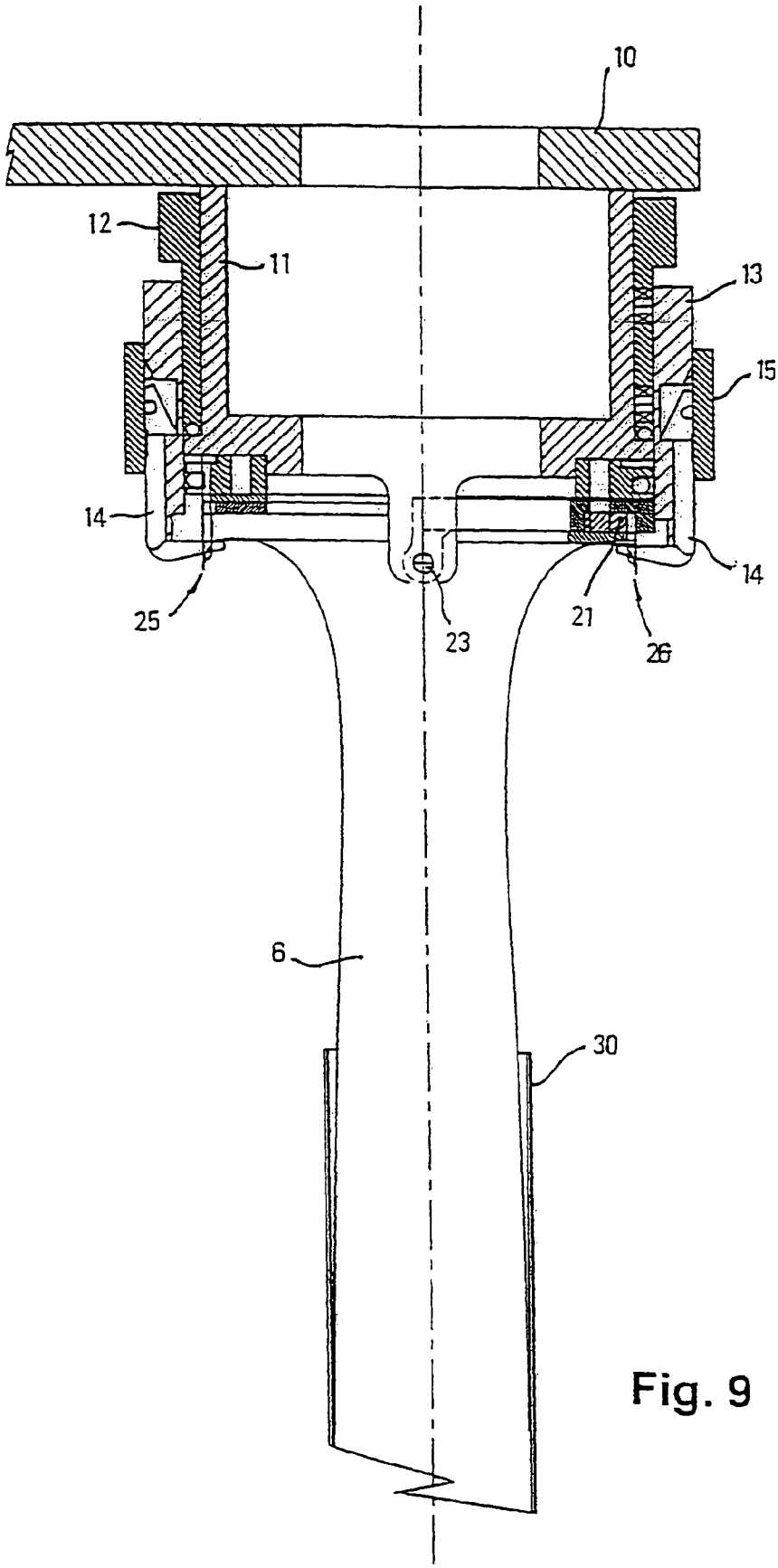
Figure 10:
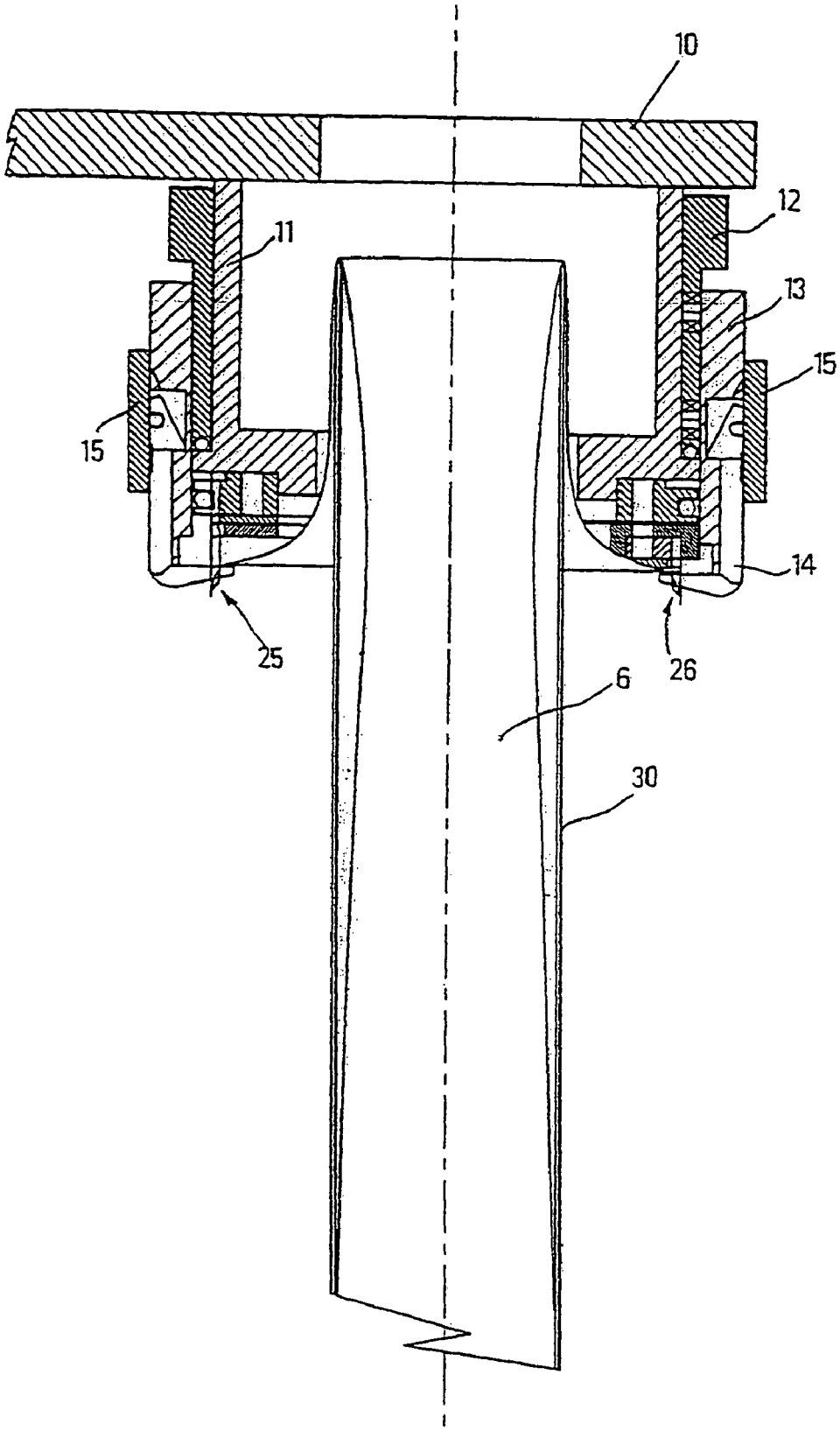
Figure 11:
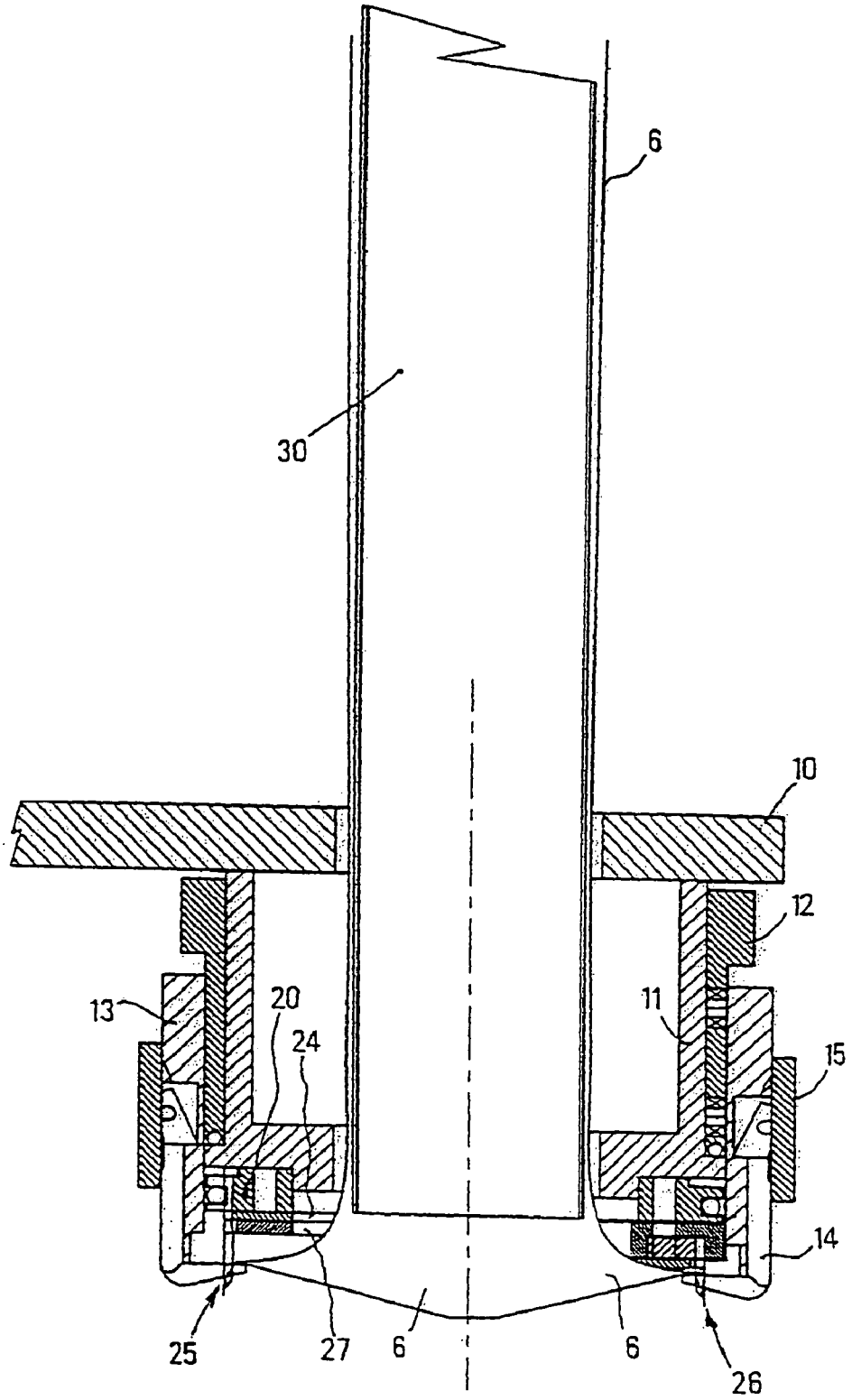
Figure 12:
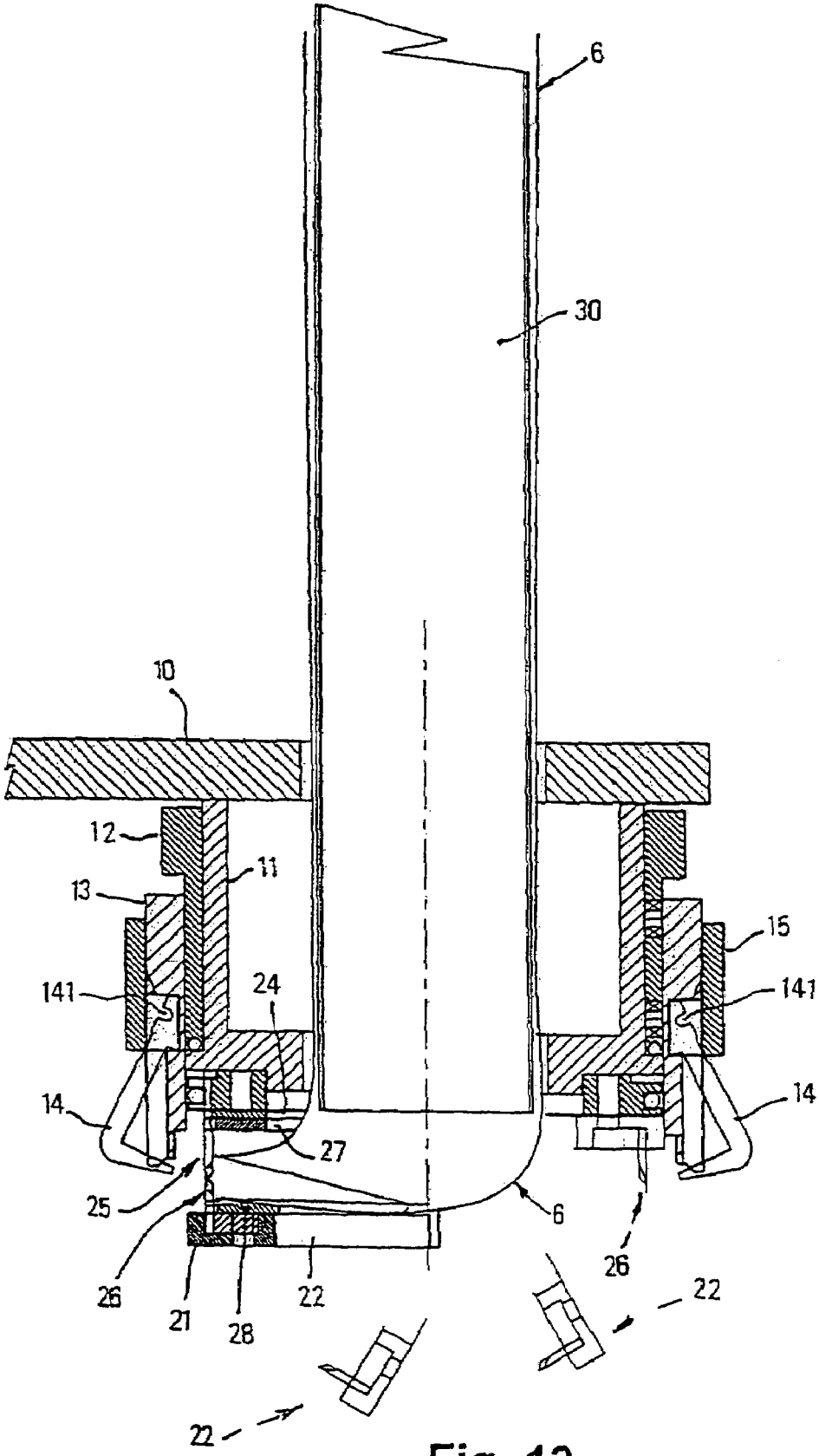
Figure 13:
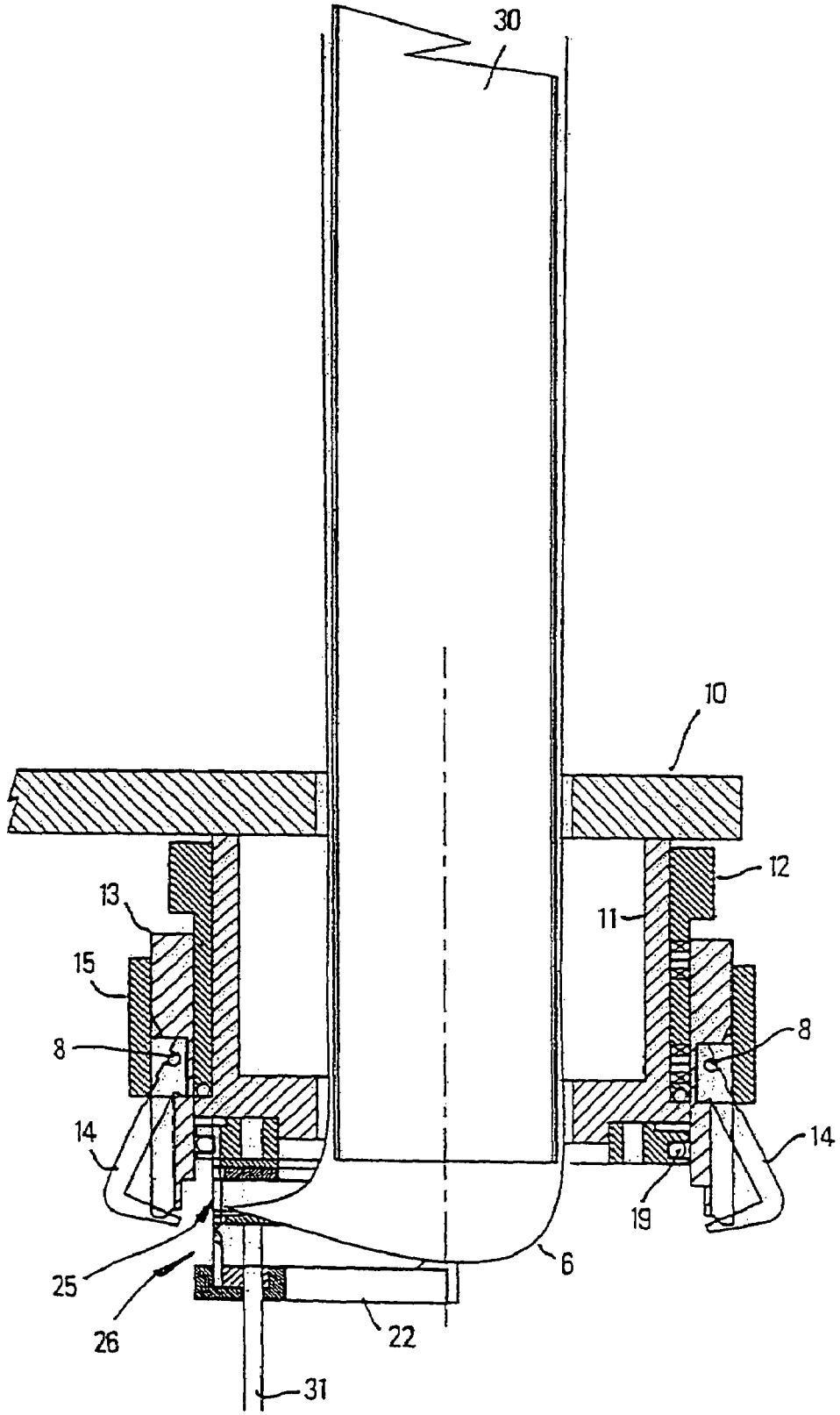
Figure 14:
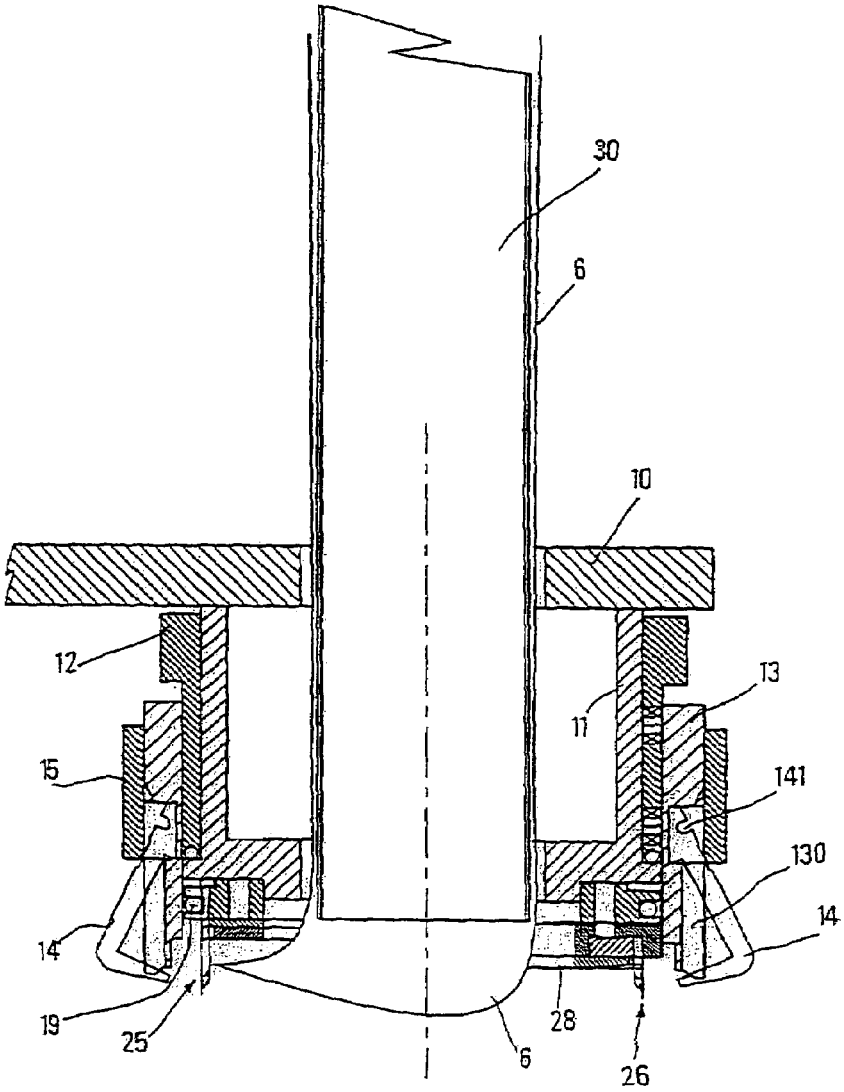
Figure 14:
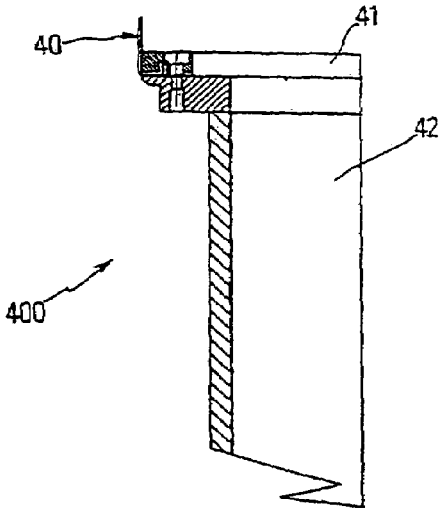
Figure 15:
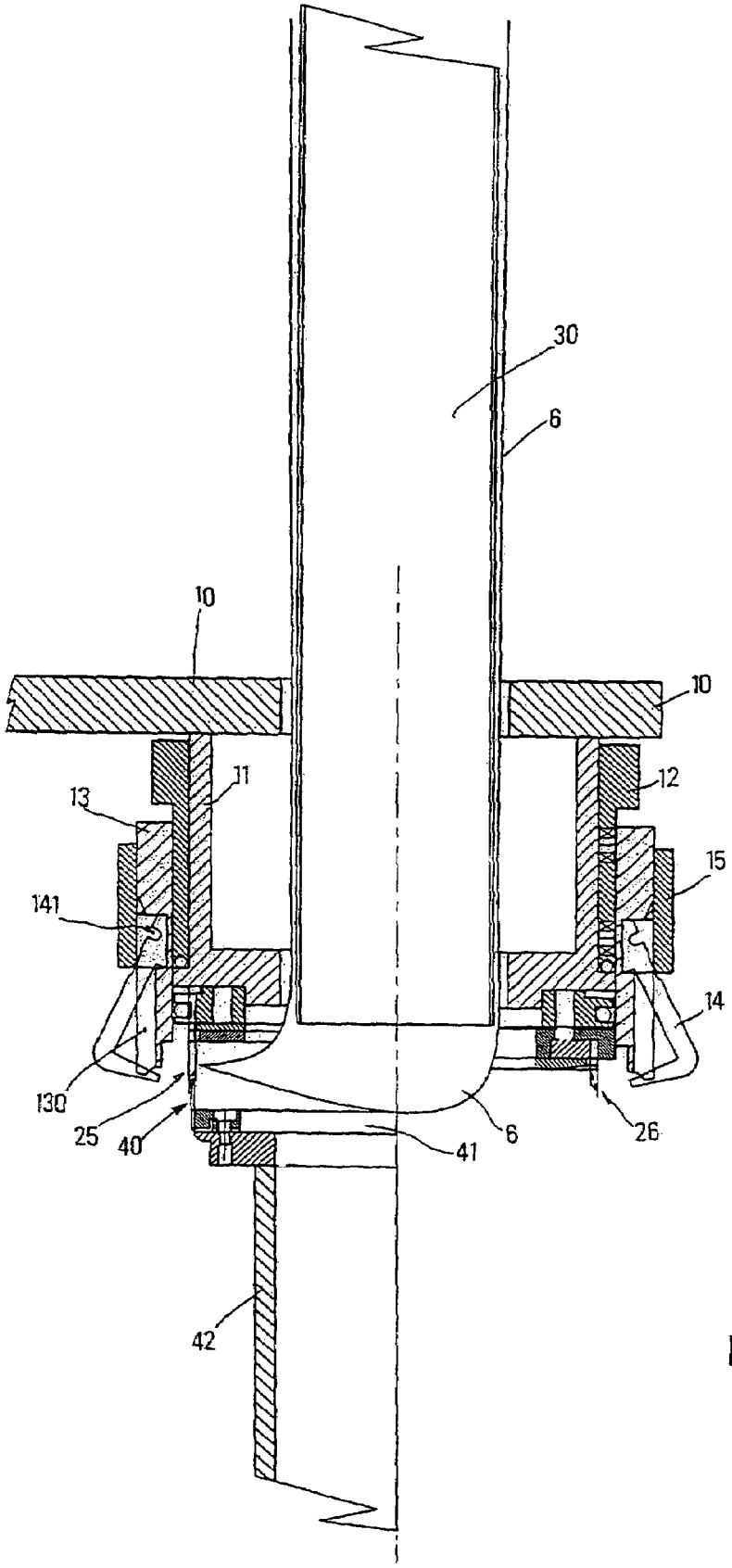
Figure 16:
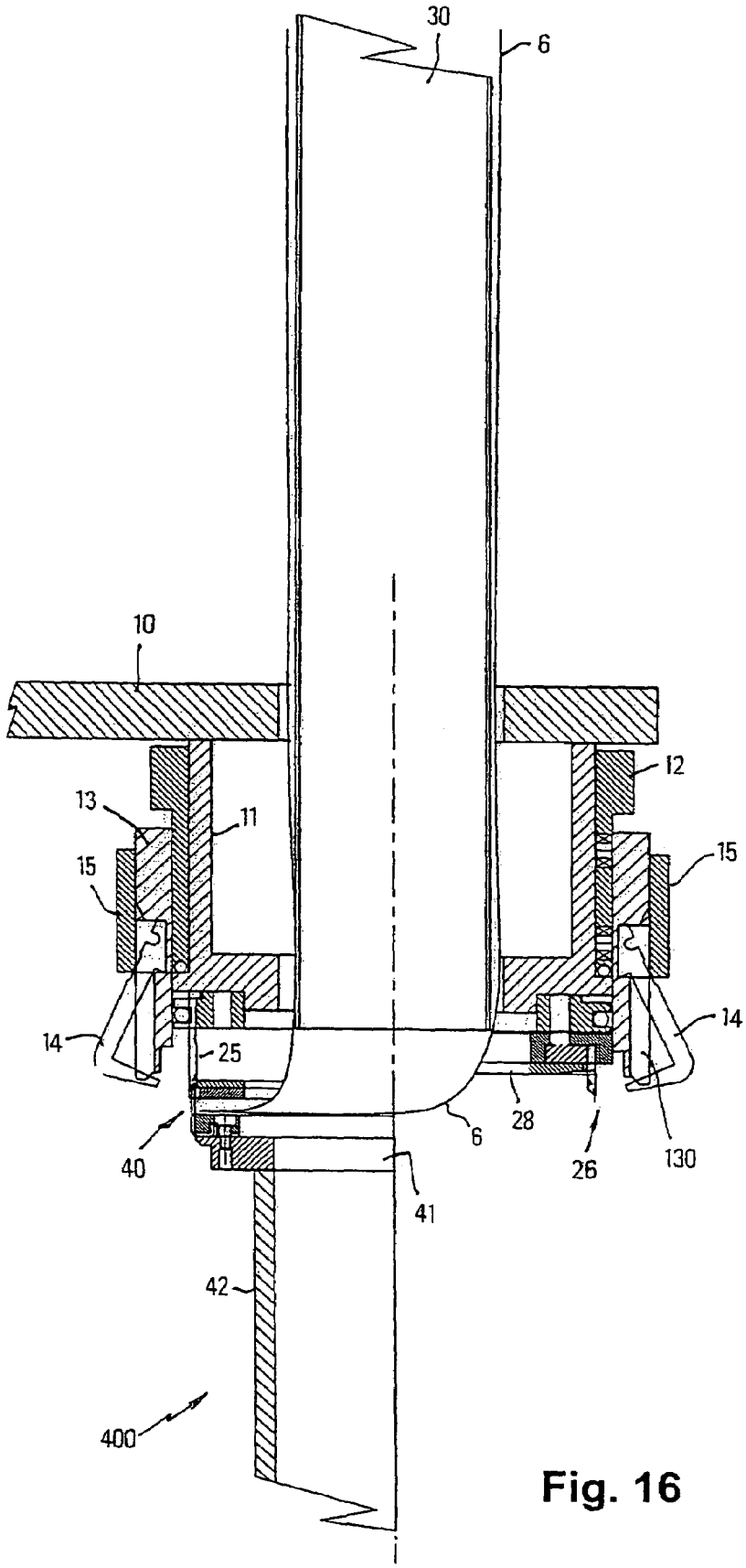
Figure 17:
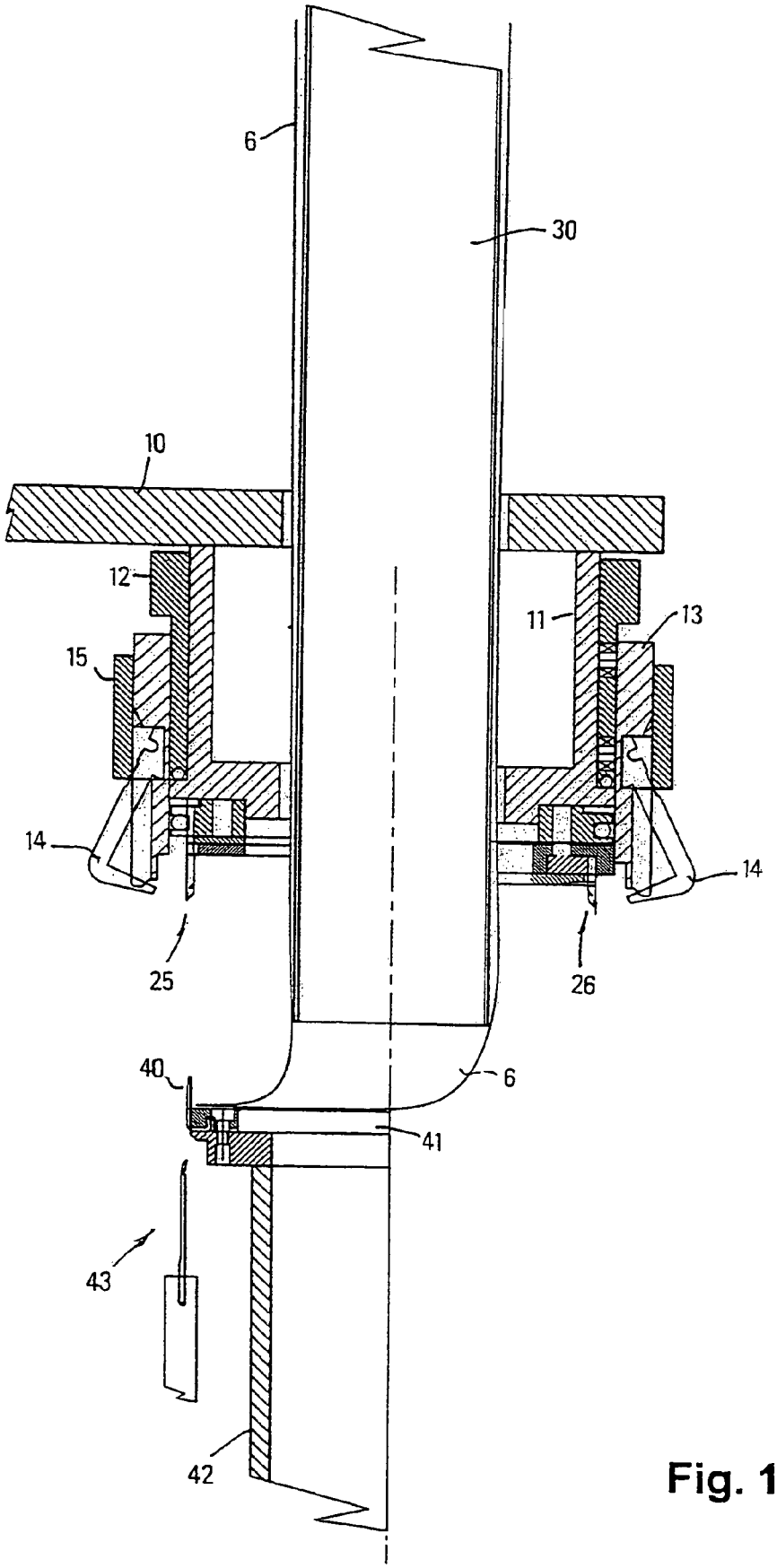
Figure 18:
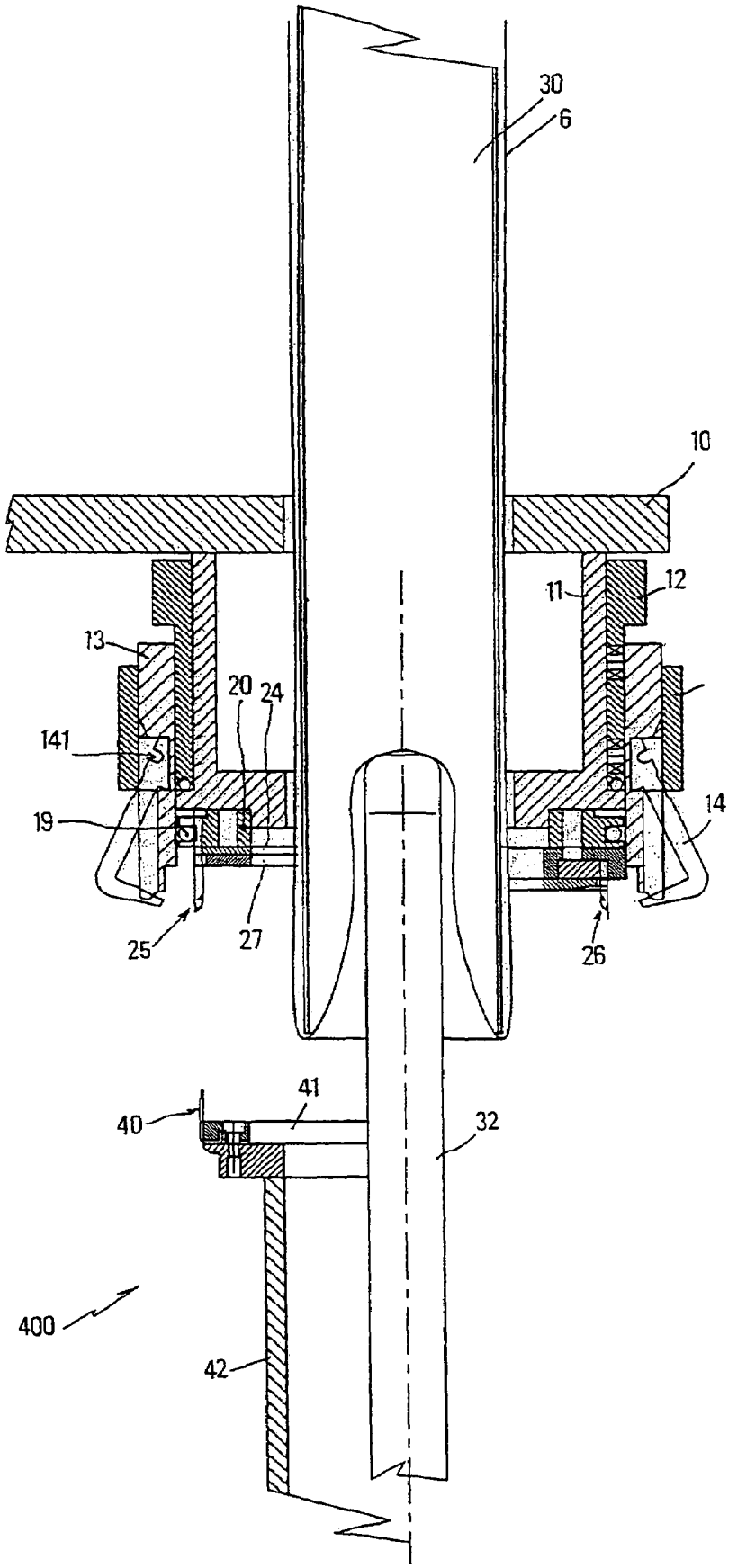
Figure 19:
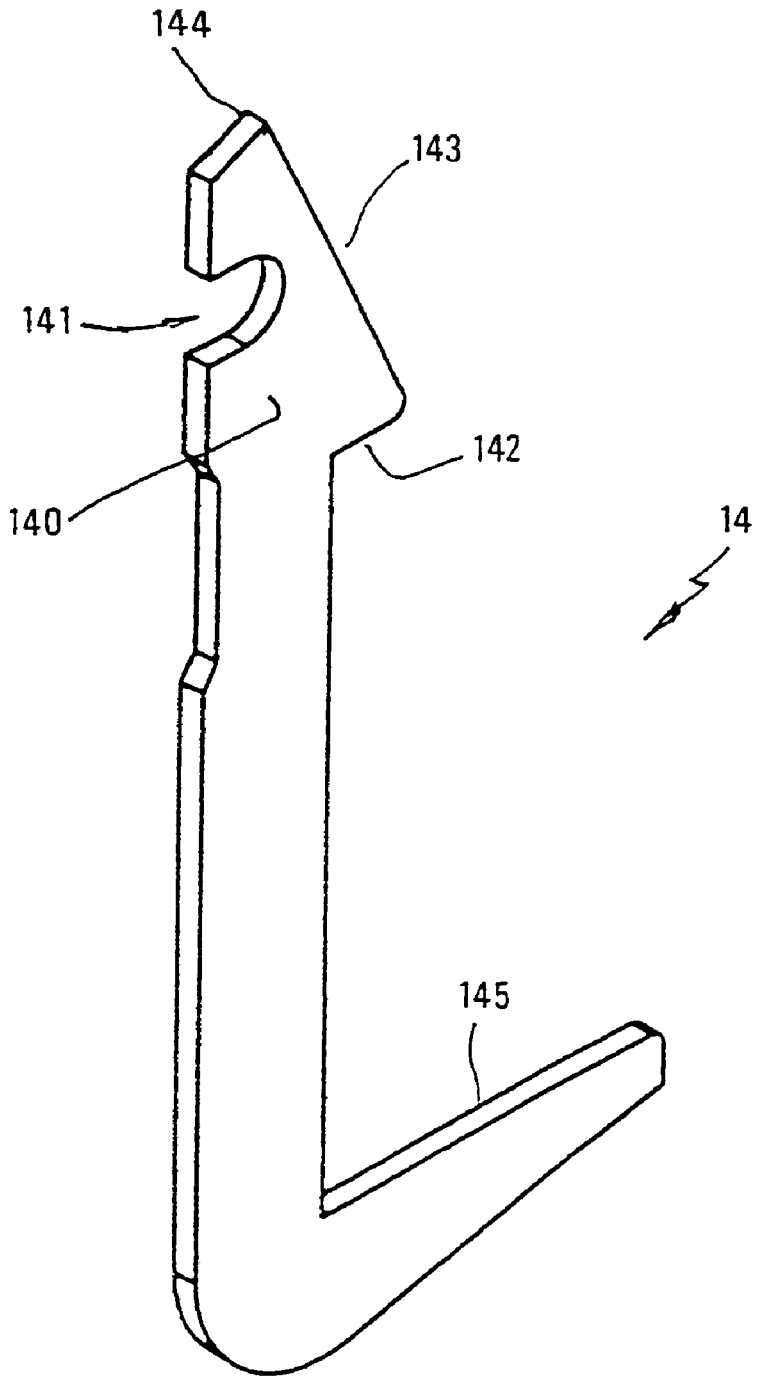
Figure 20:
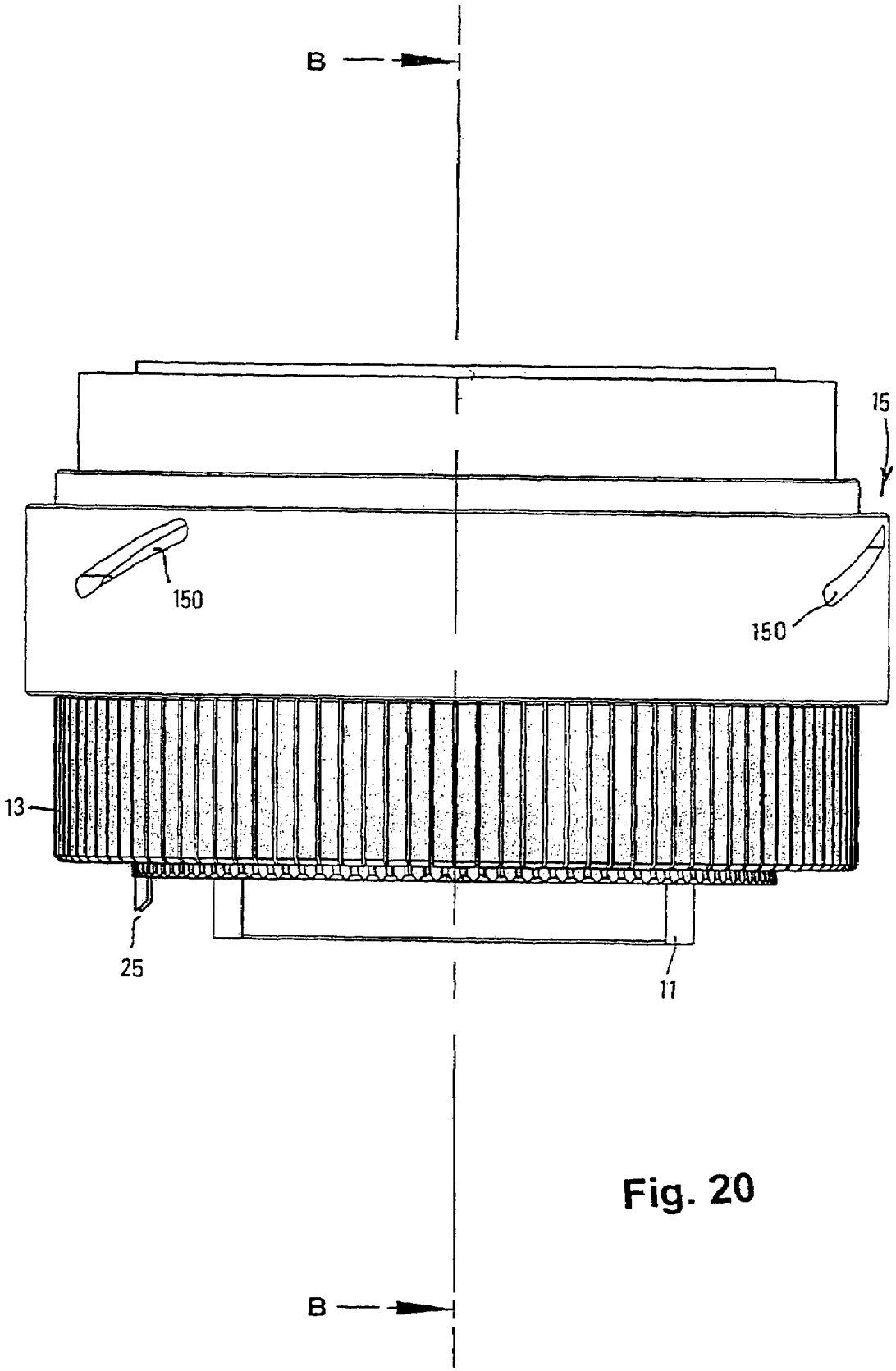
Figure 21:
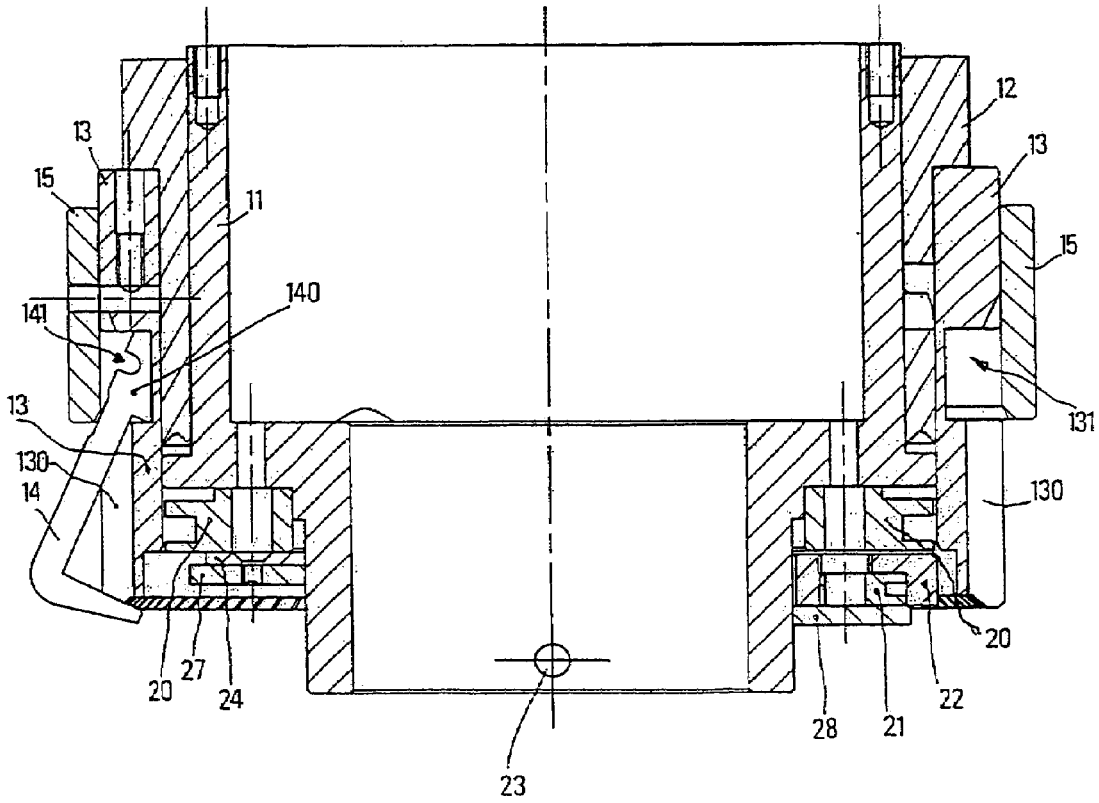
Figure 22:
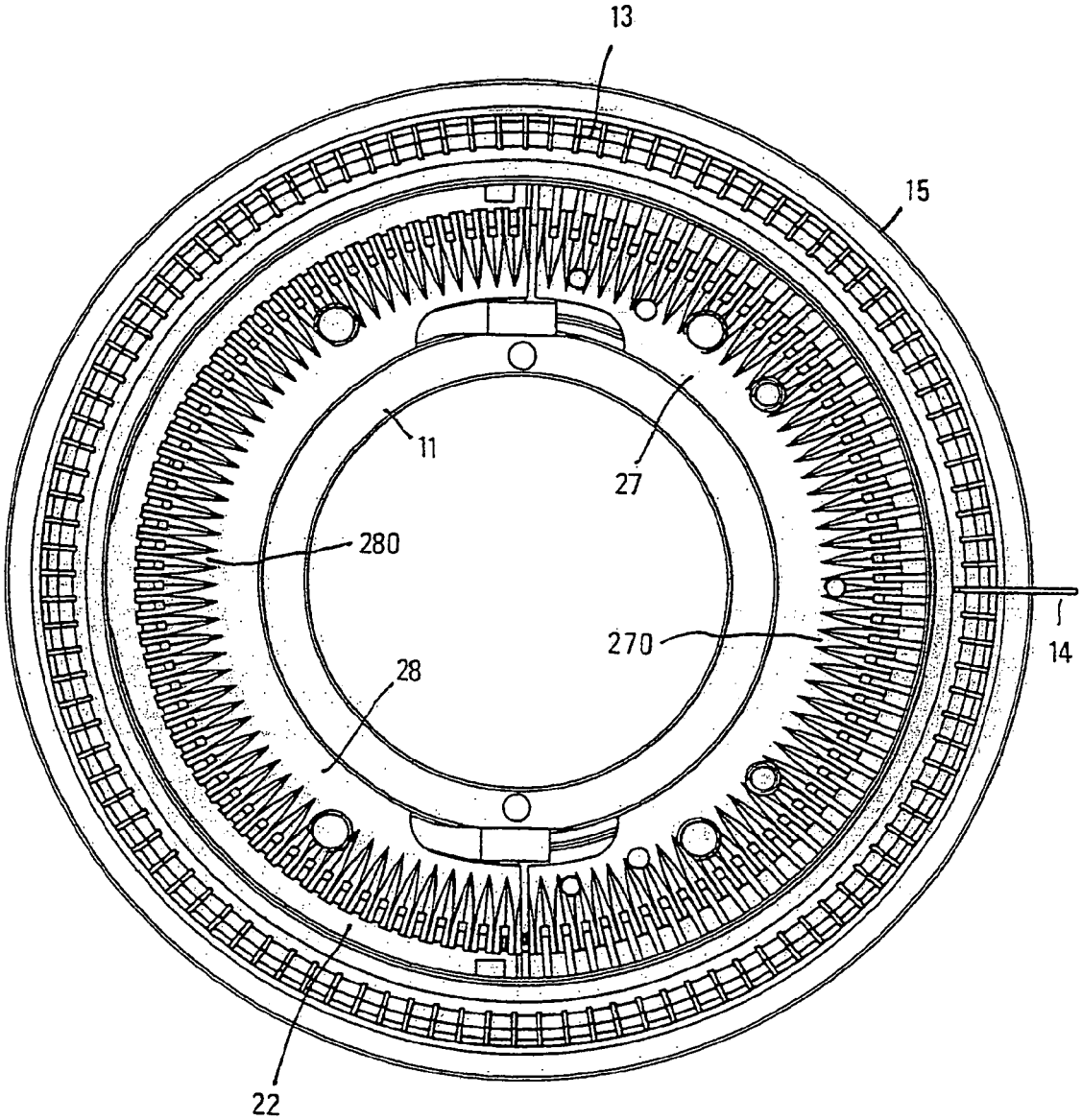
Figure 23:
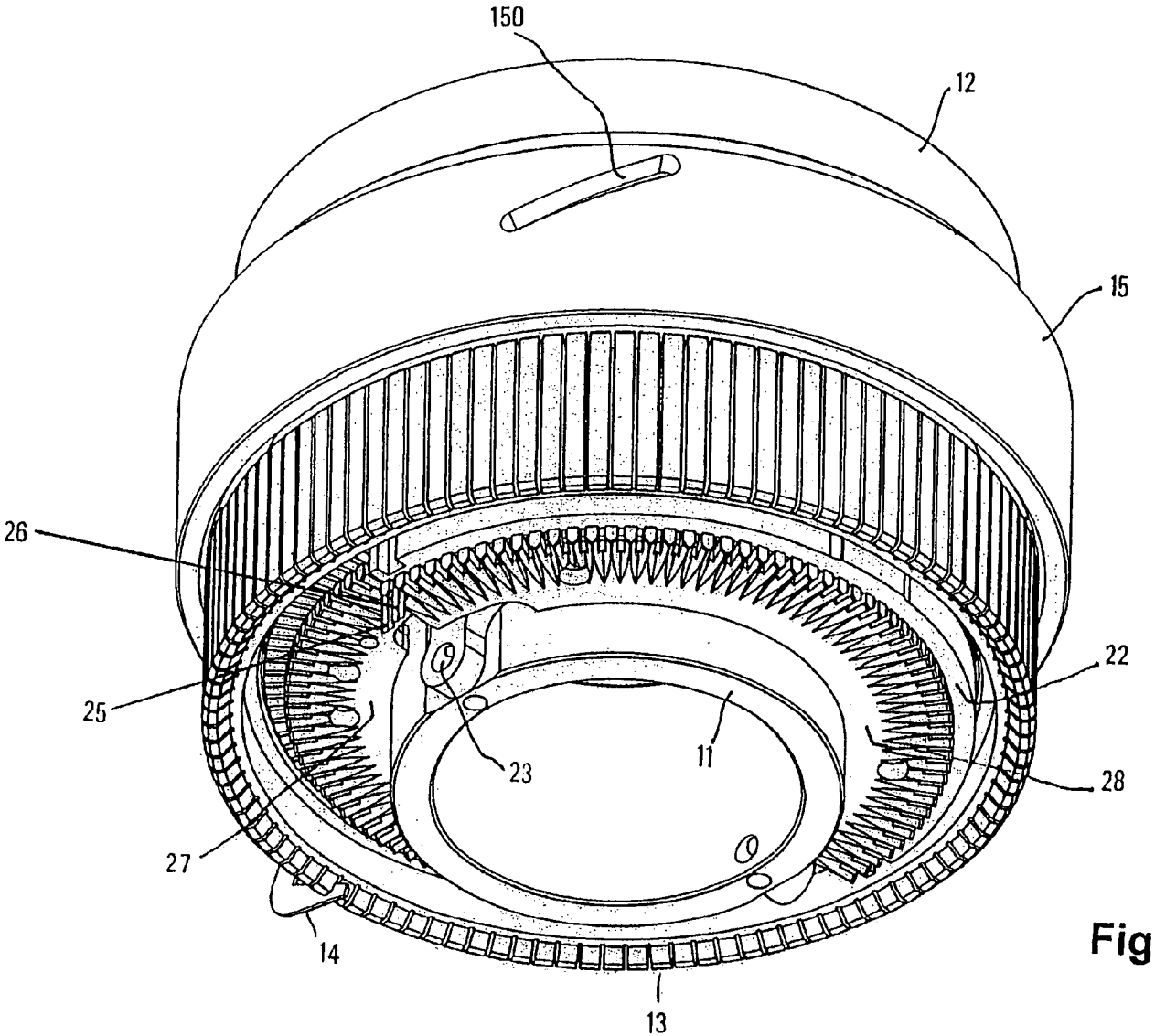
Figure 24:
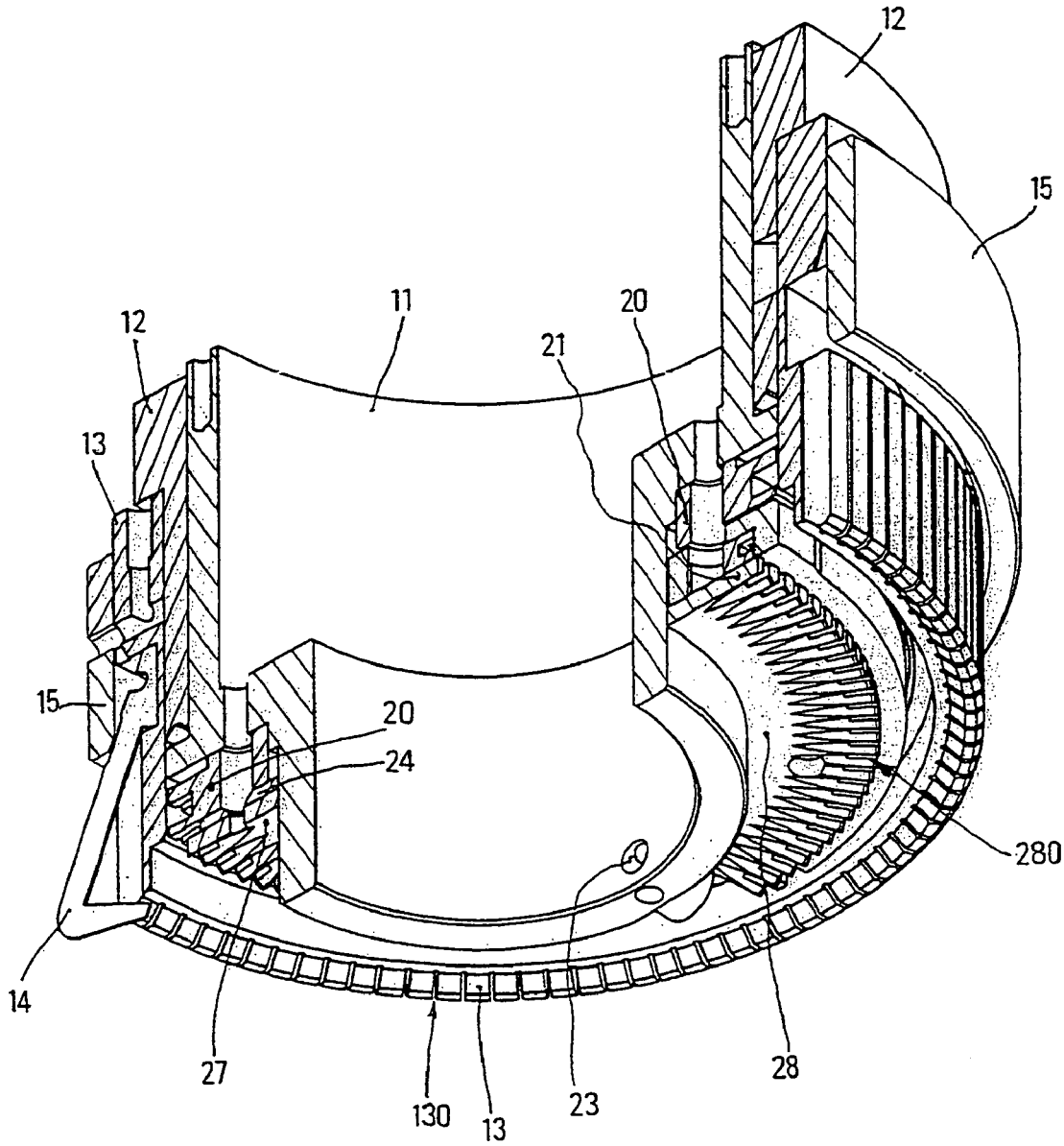
Figure 25:
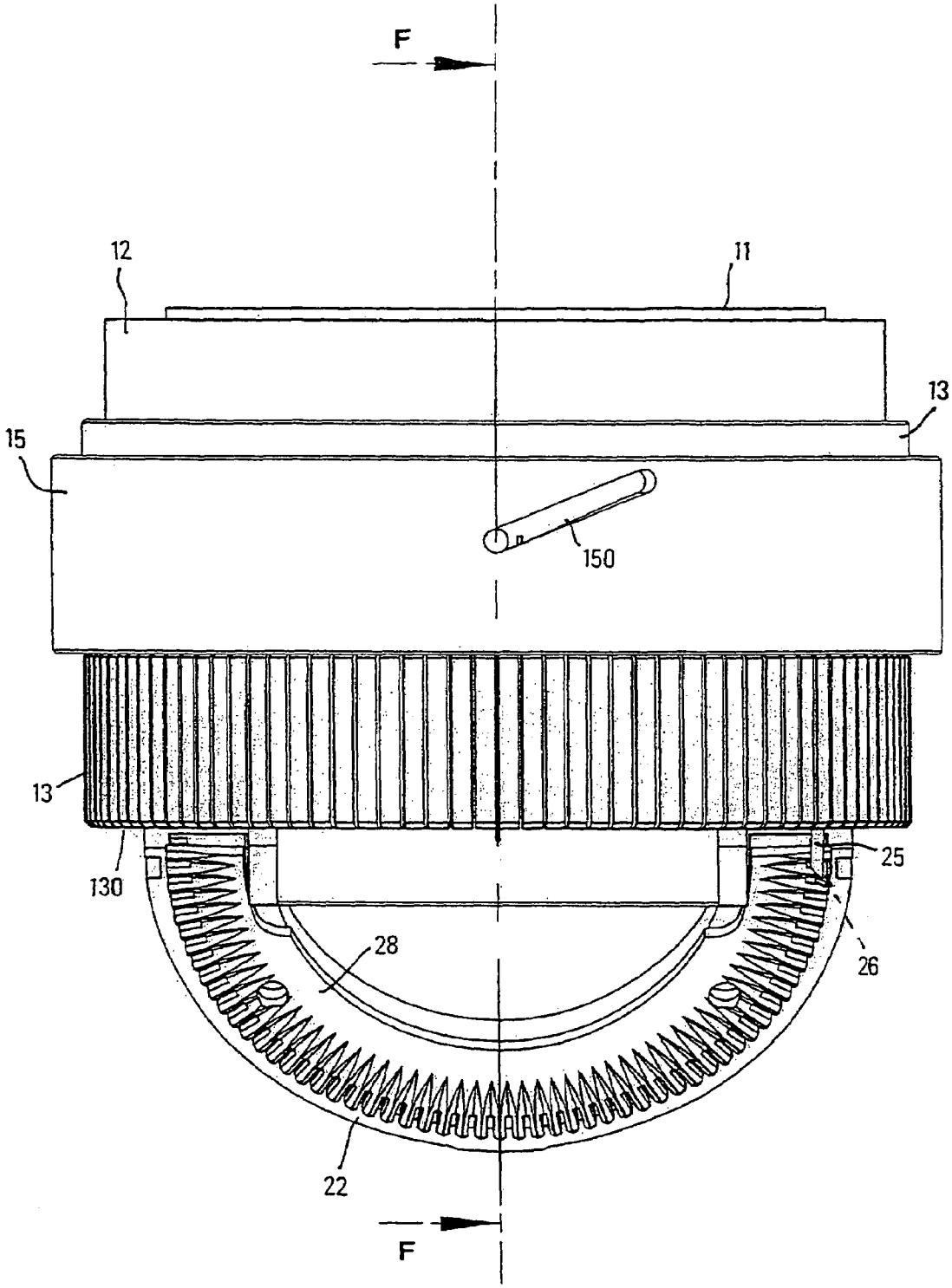
Figure 26:
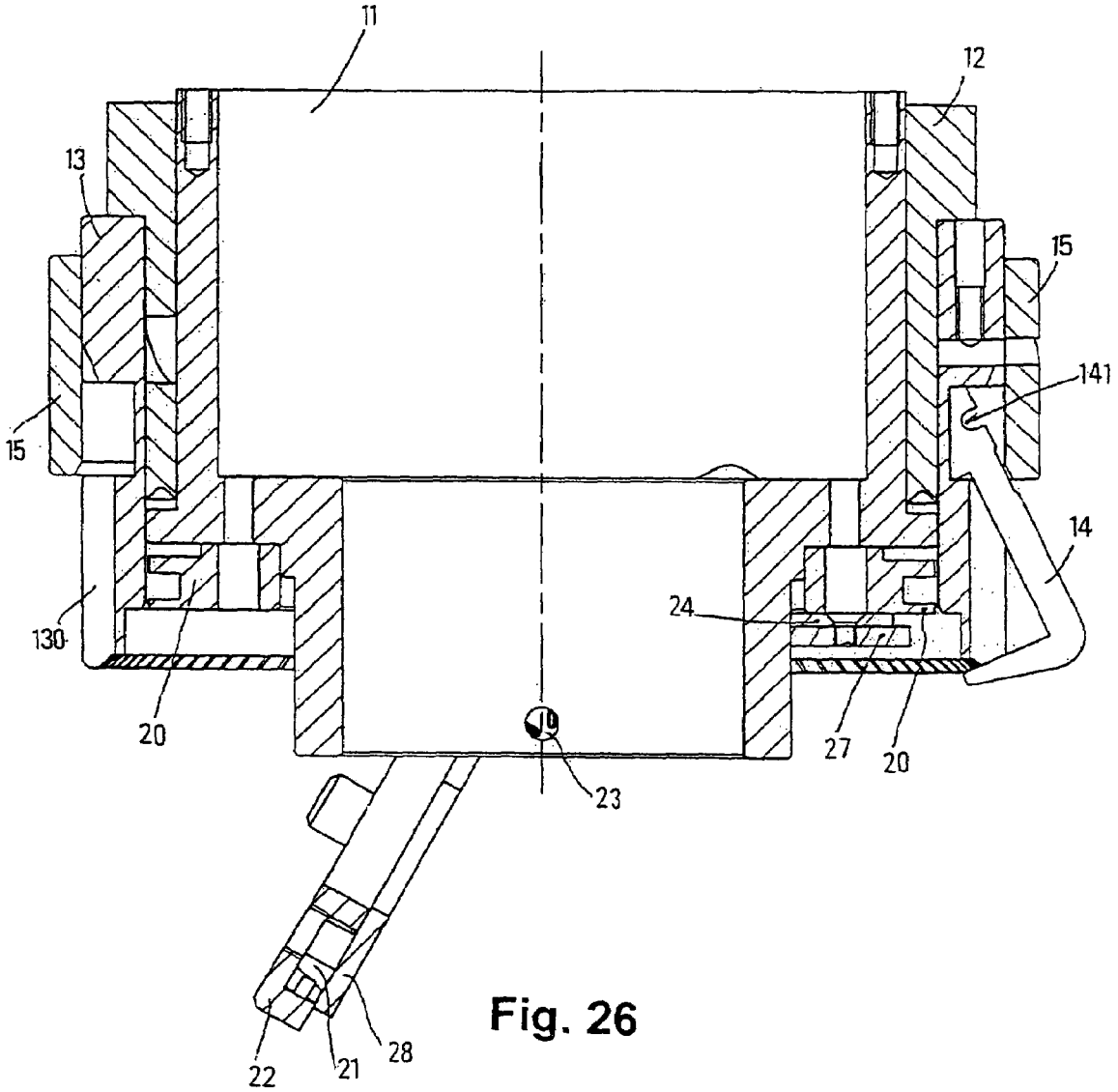
Figure 27:
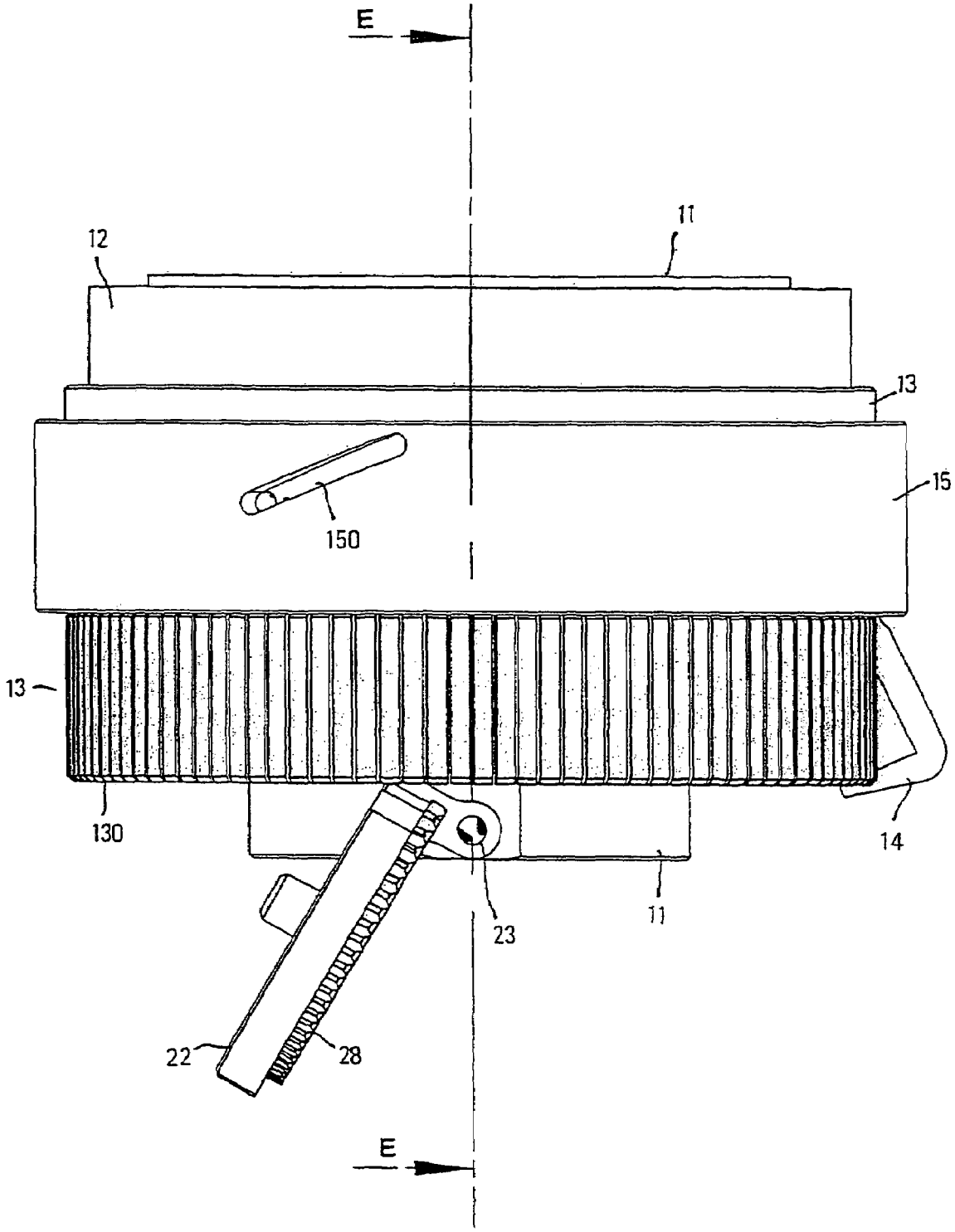
Figure 28:
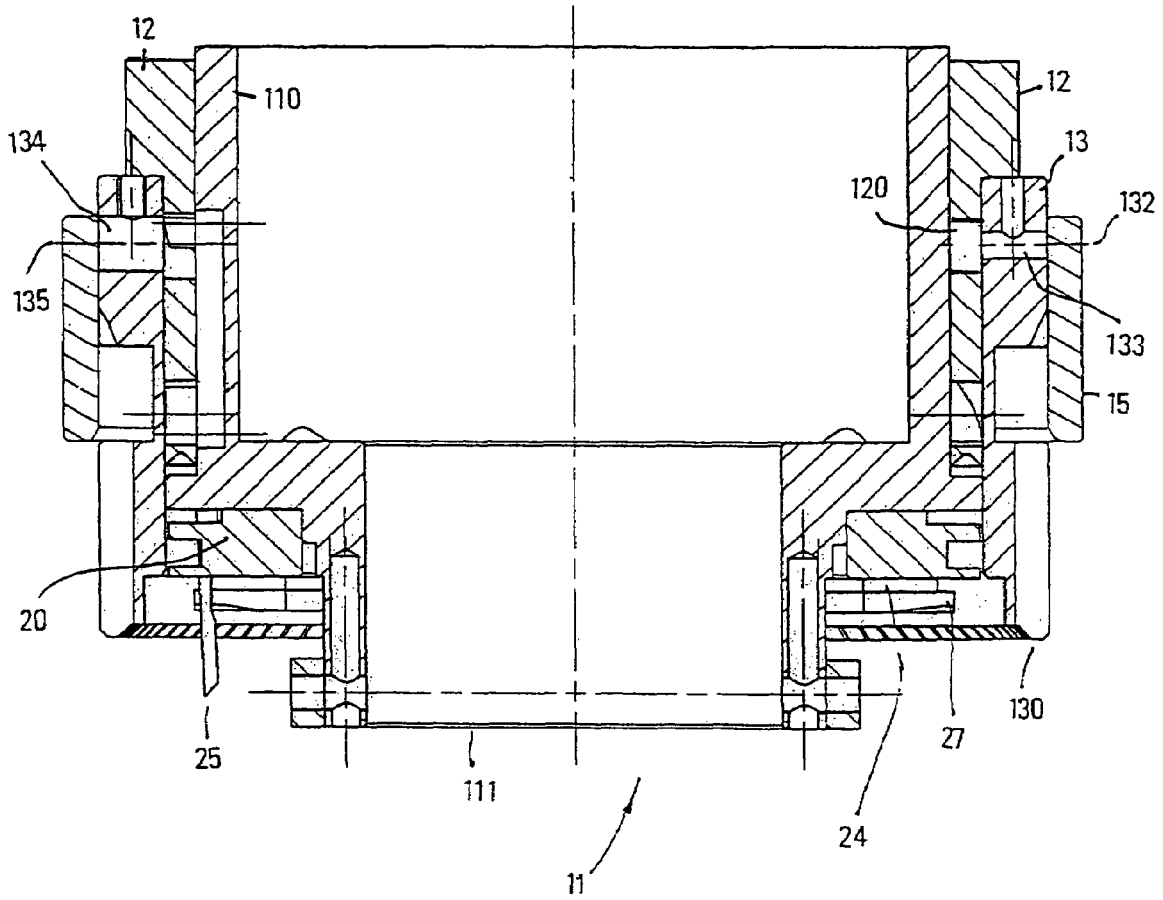
Figure 29:
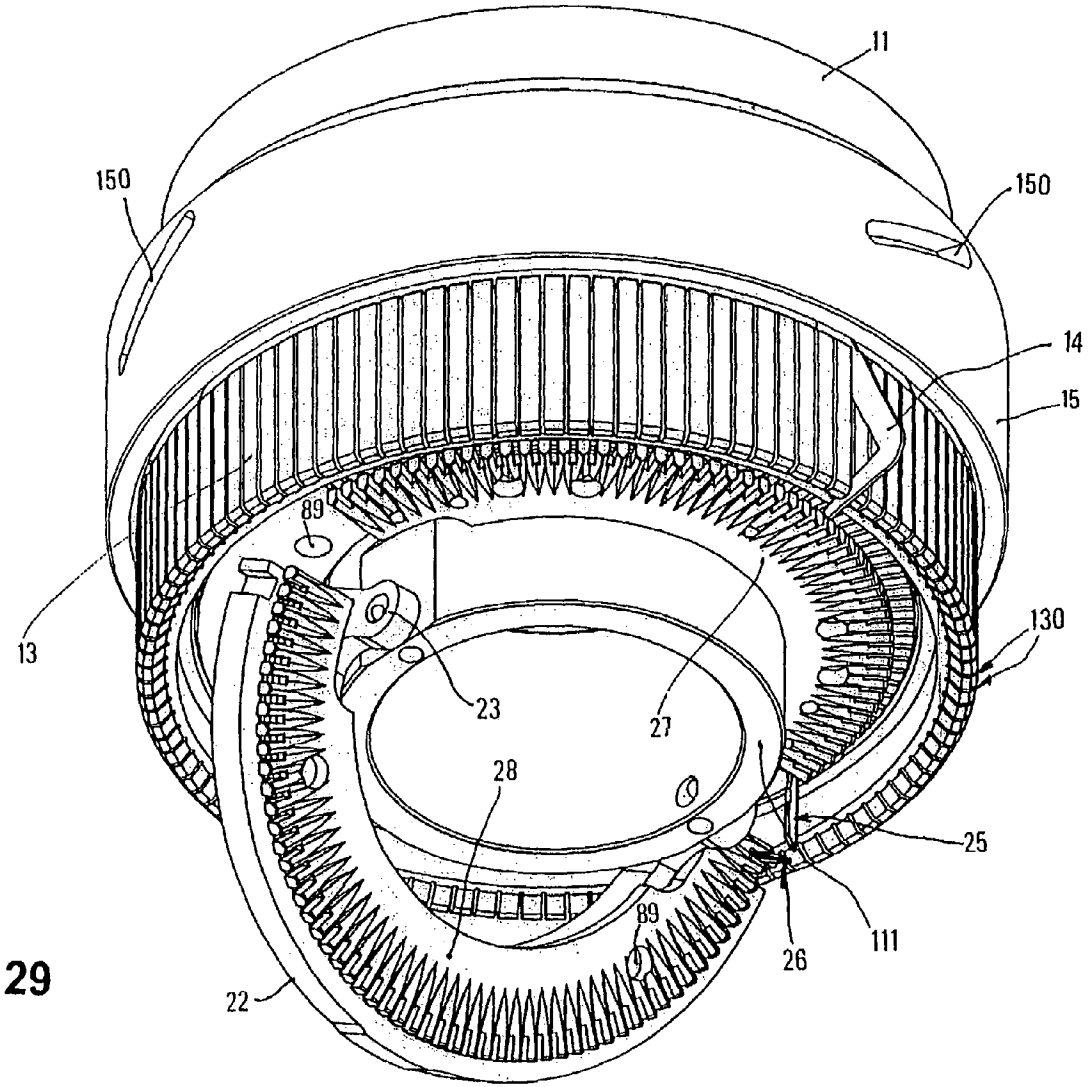
Figure 30:
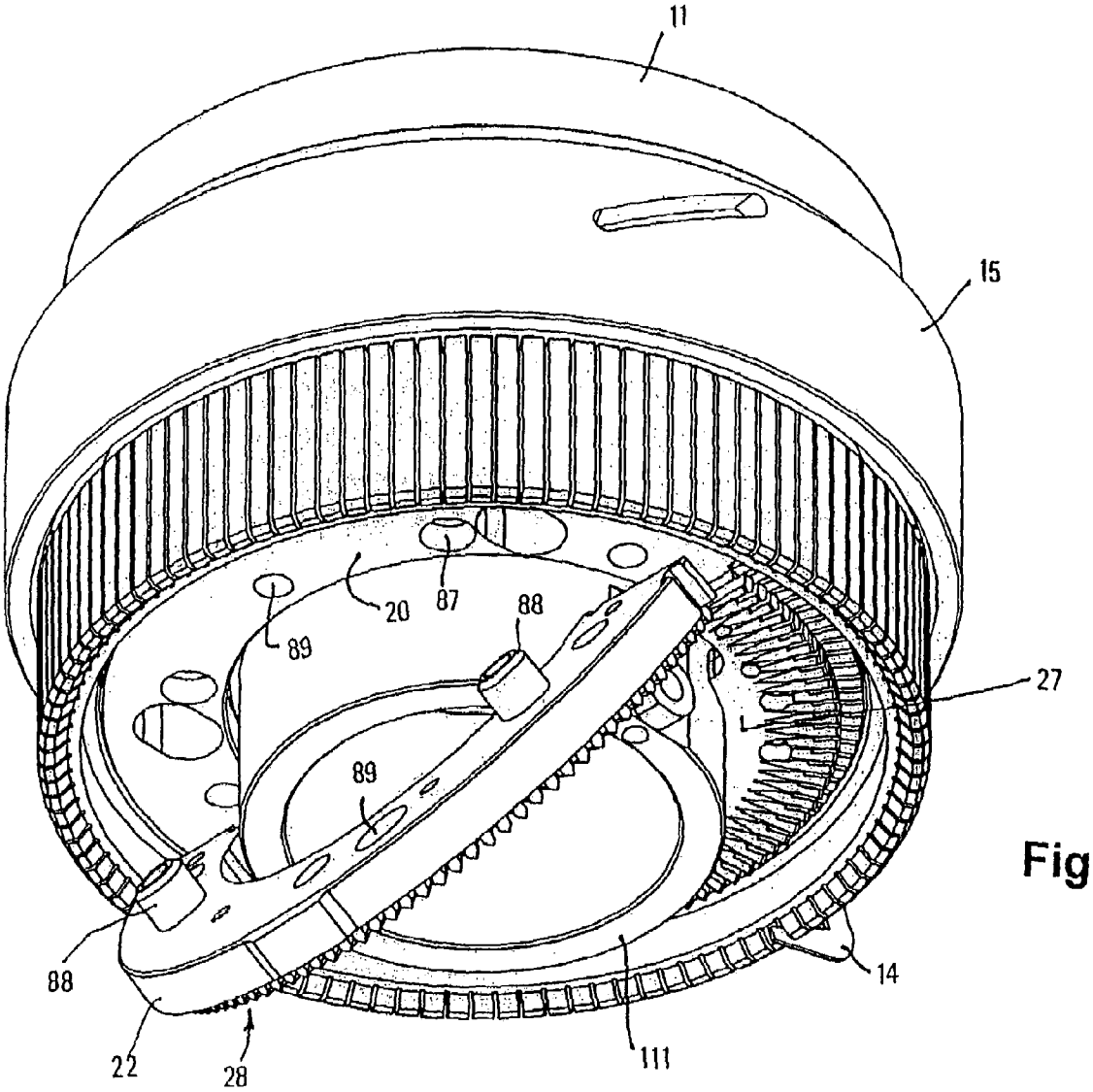
Figure 31:
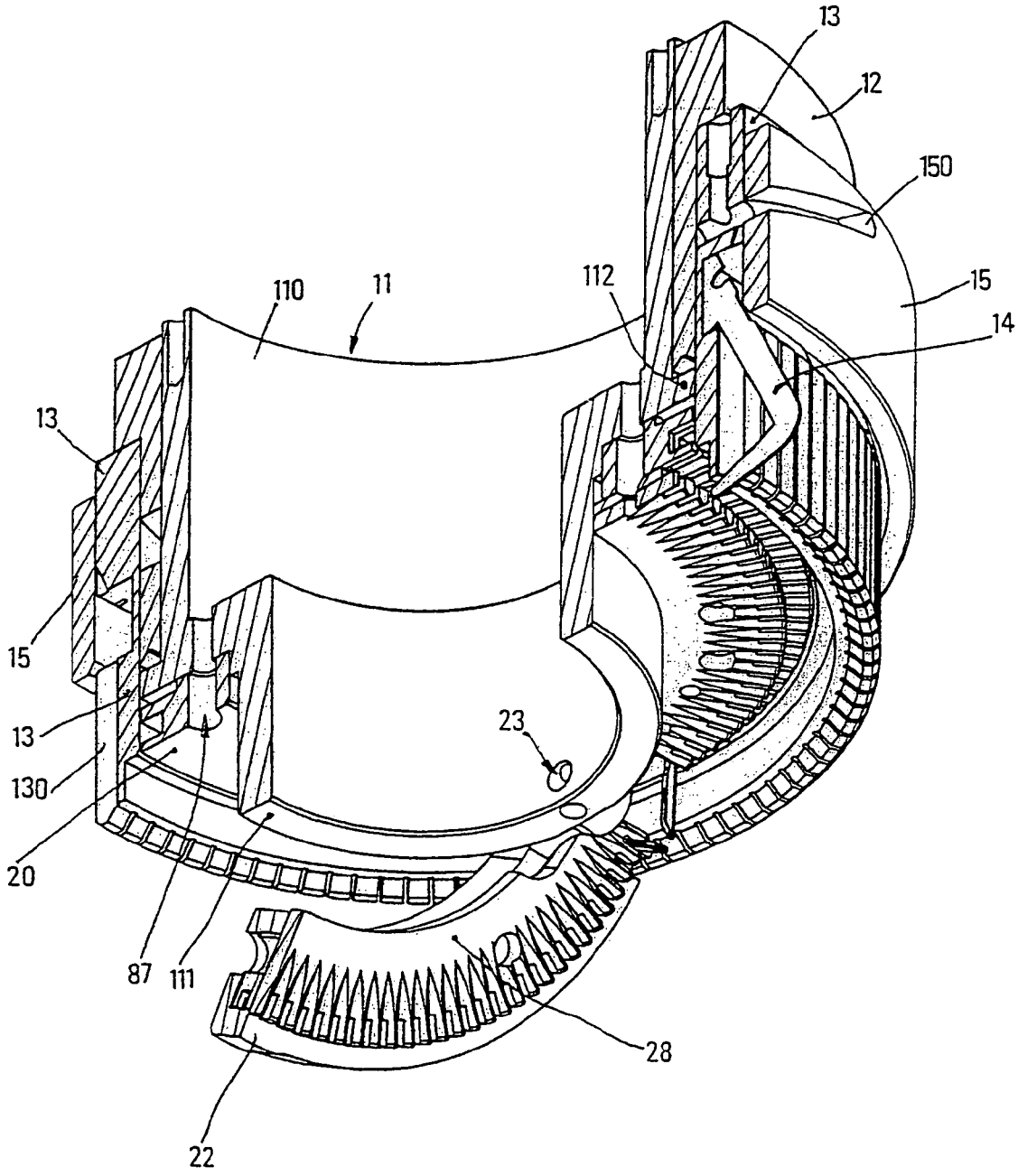
Figure 32:
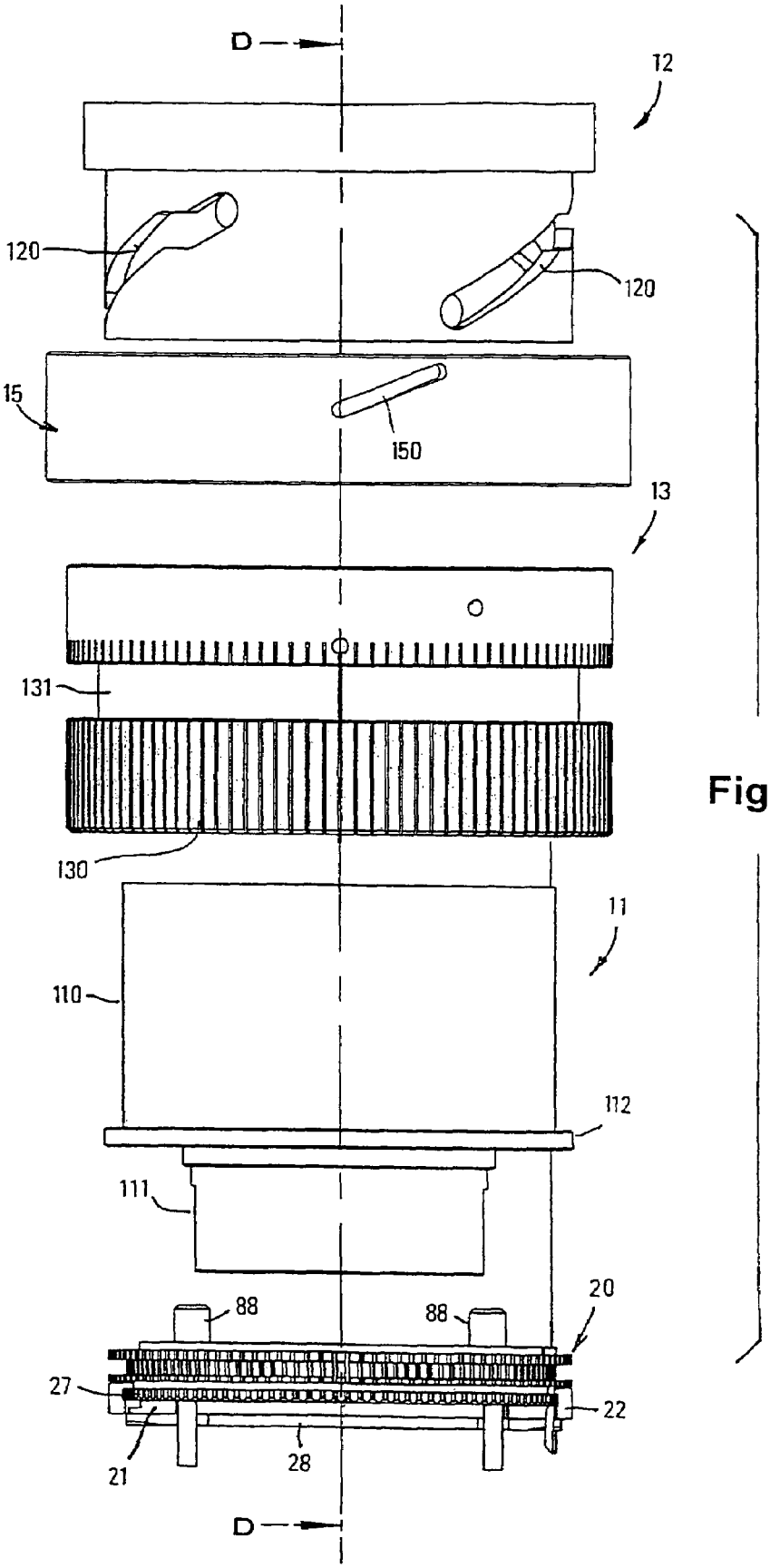
Figure 33:
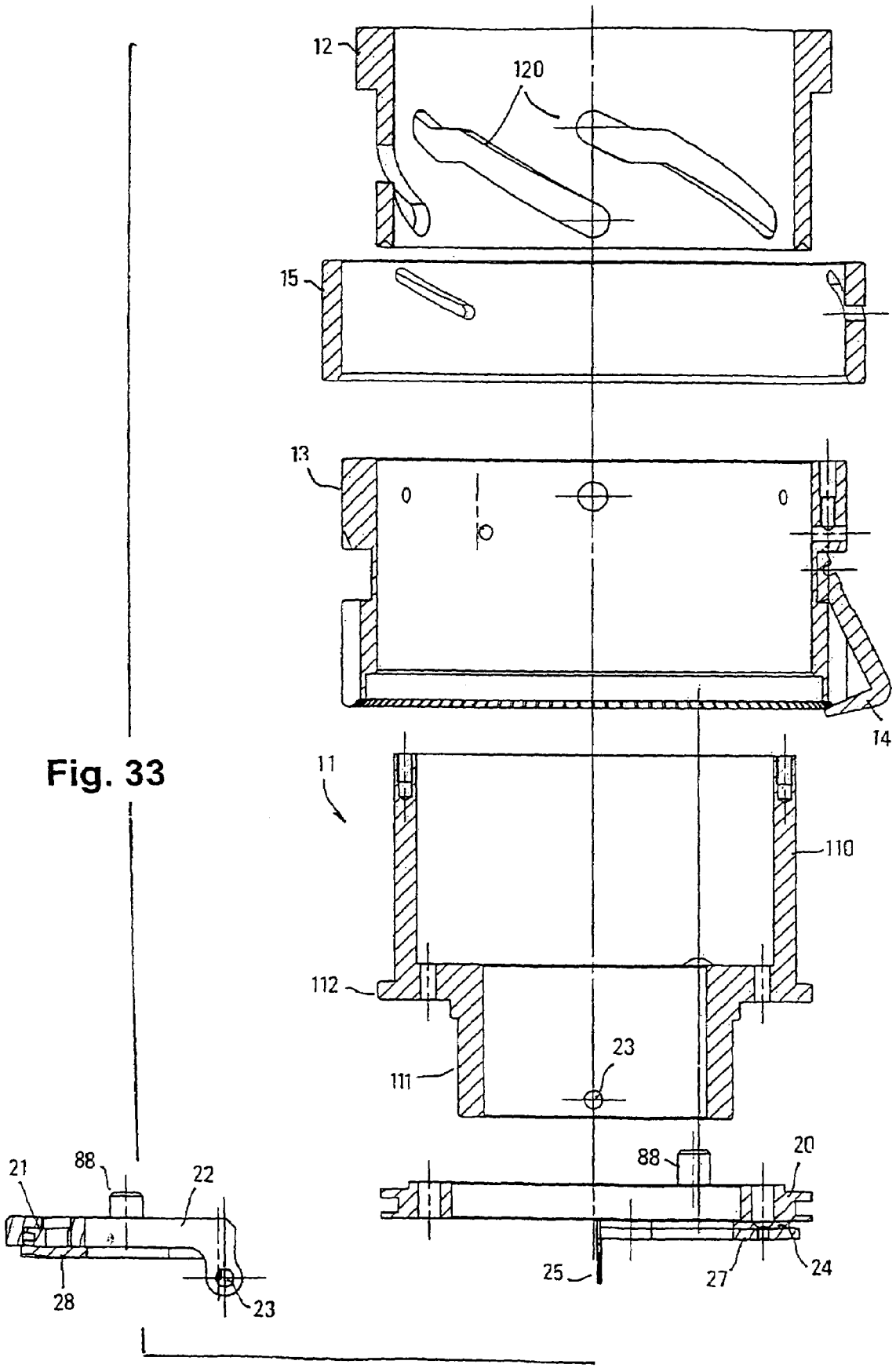
Figure 34:
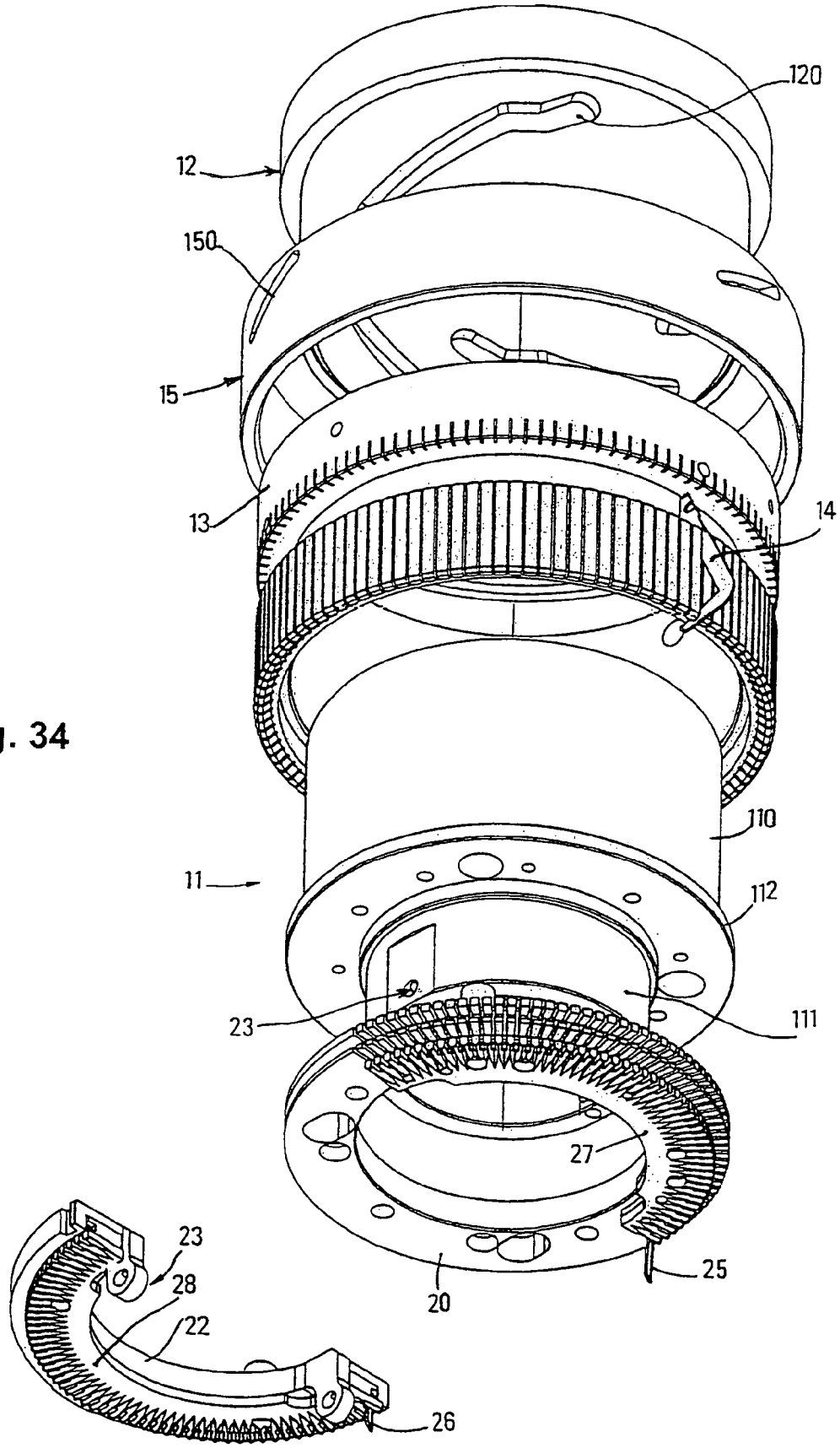
Figure 35:
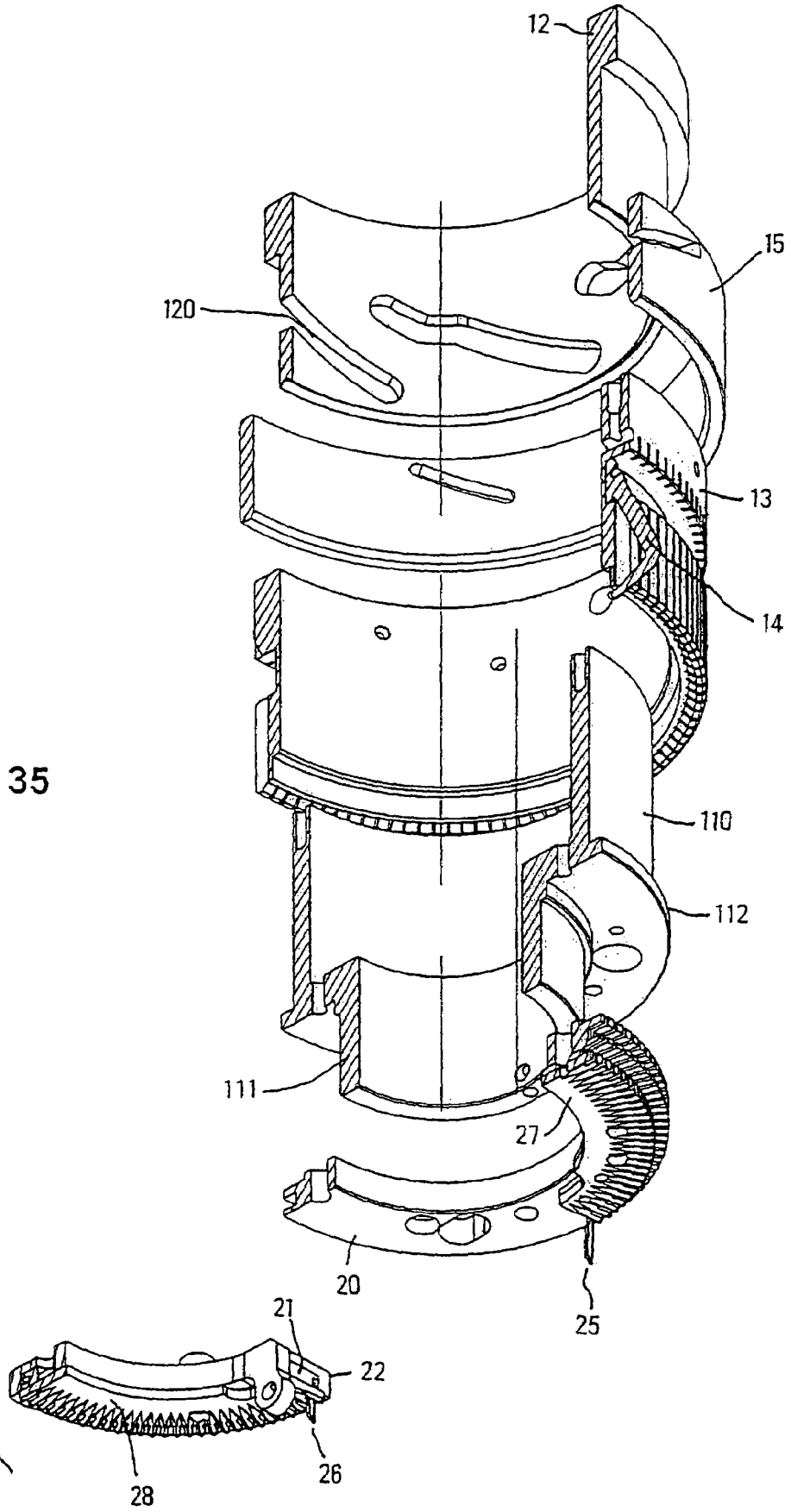
Figure 38:
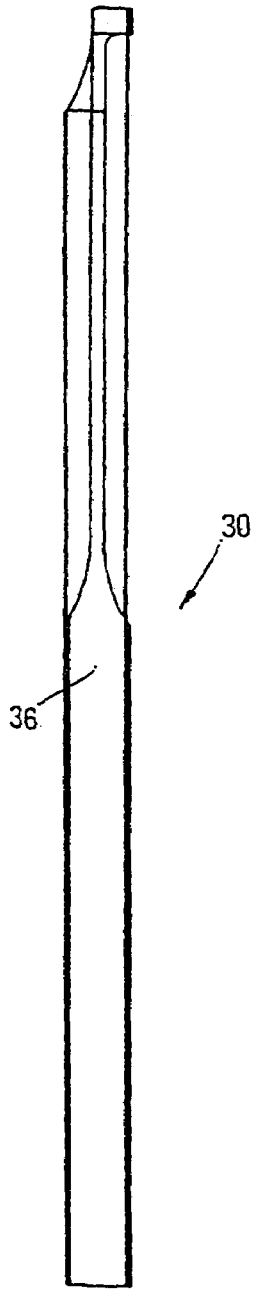
Figure 37:
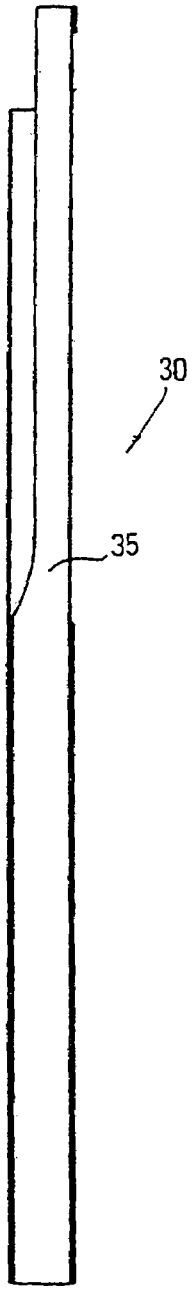
Figure 36:
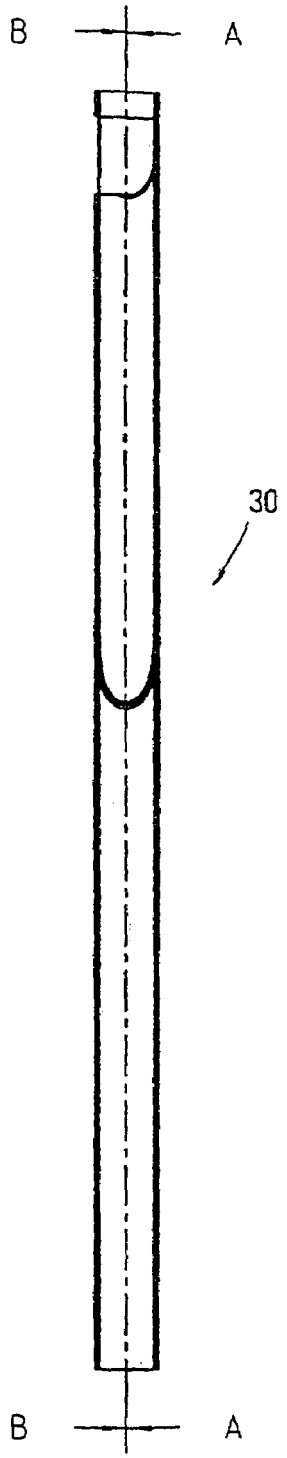
Figure 40:
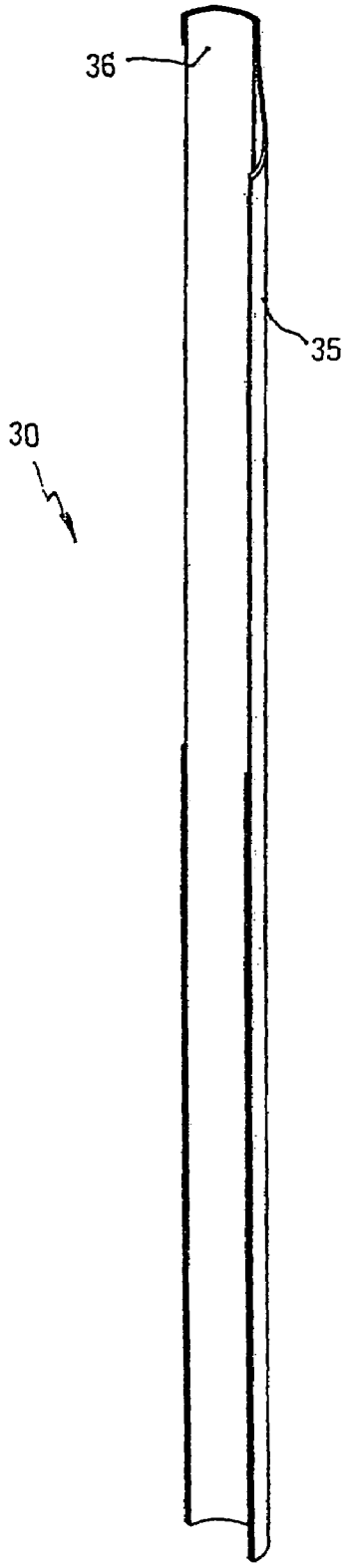
Figure 39:
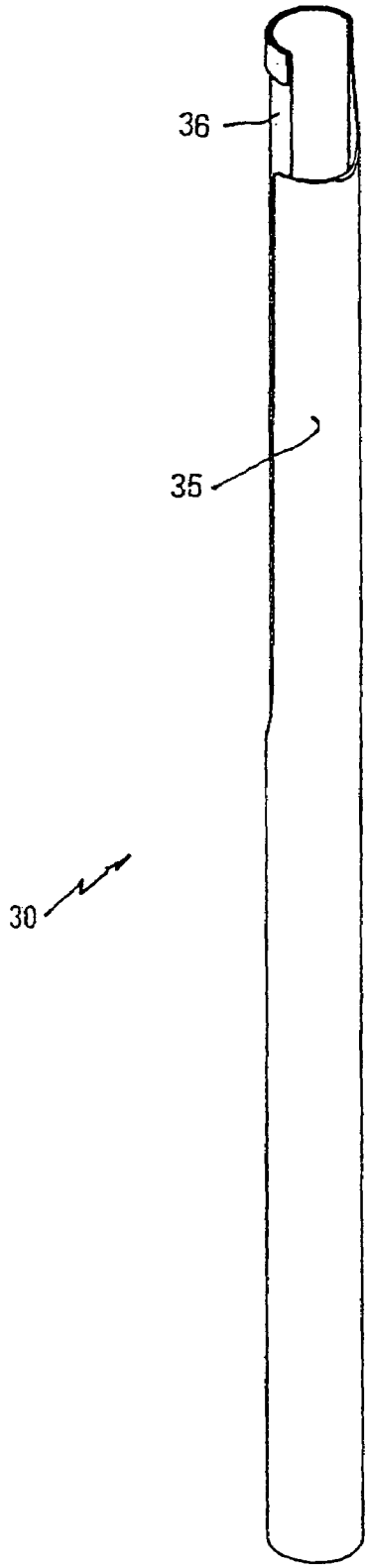
Figure 41:
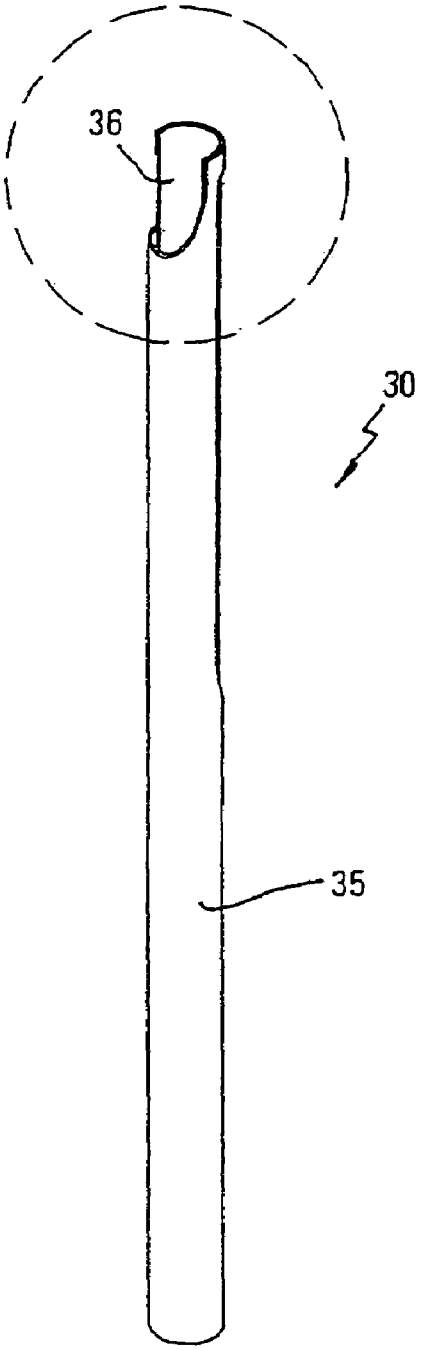
Figure 42:
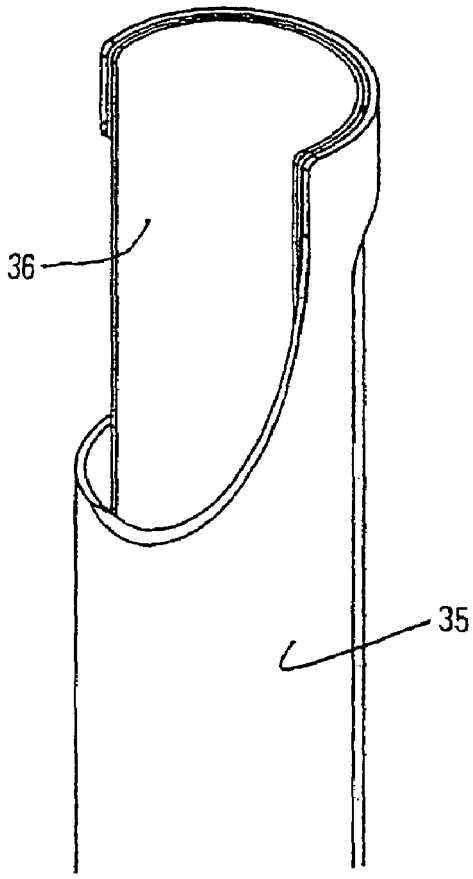
Figure 45:
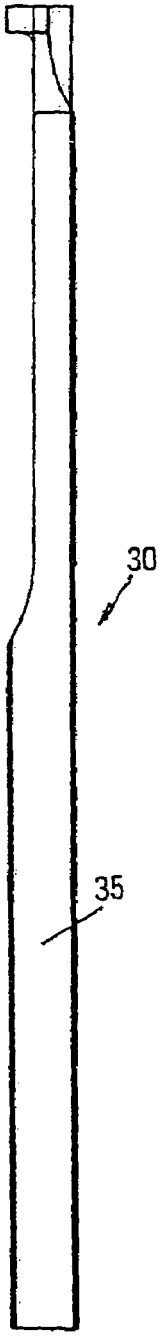
Figure 44:
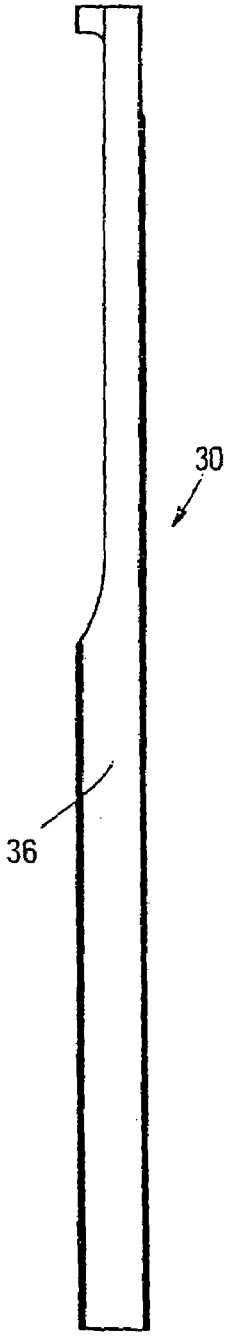
Figure 43:
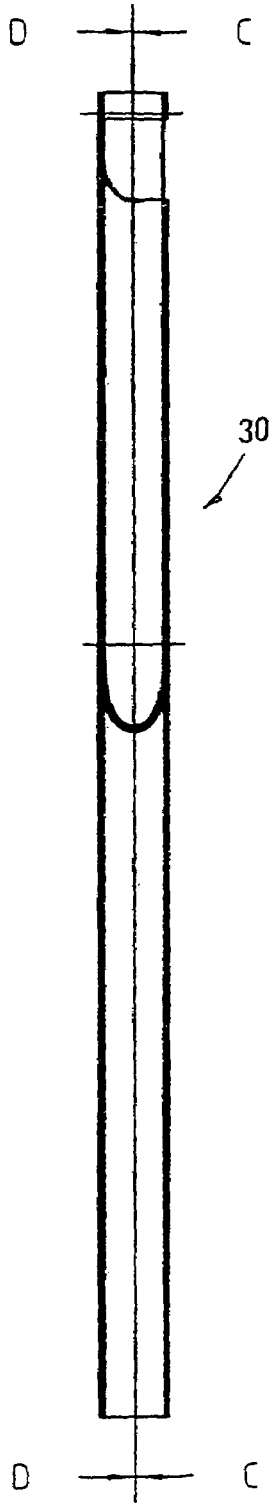
Figure 47:
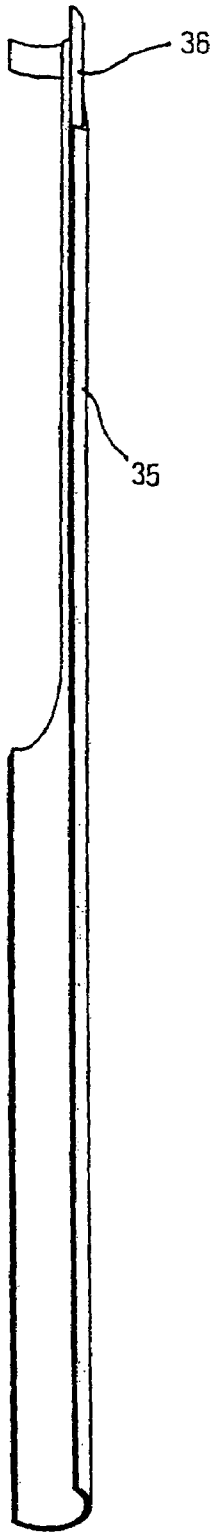
Figure 46:
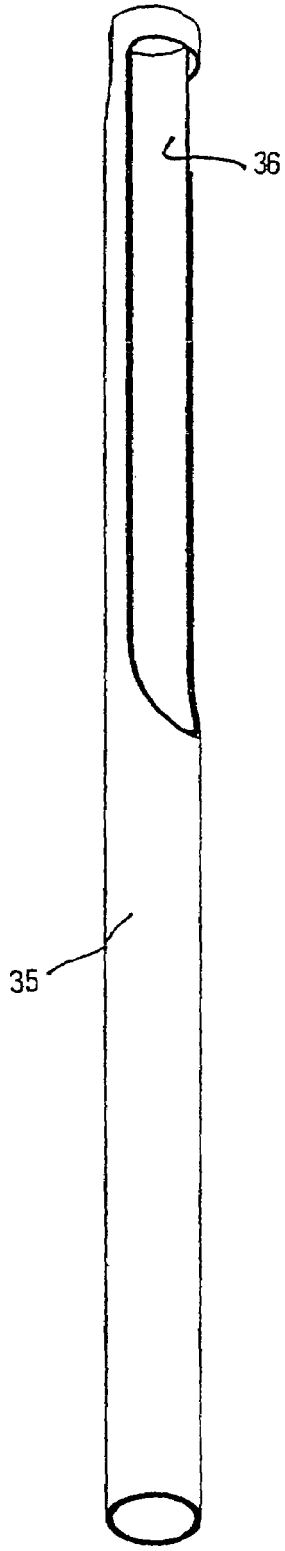
Figure 48:
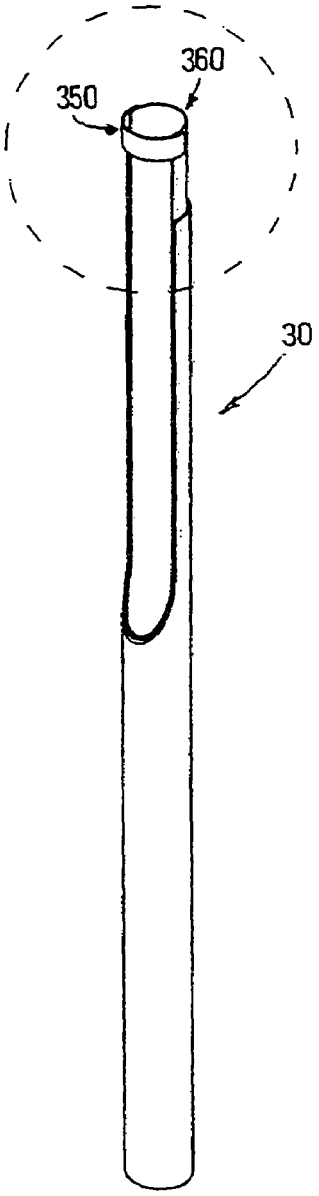
Figure 49:
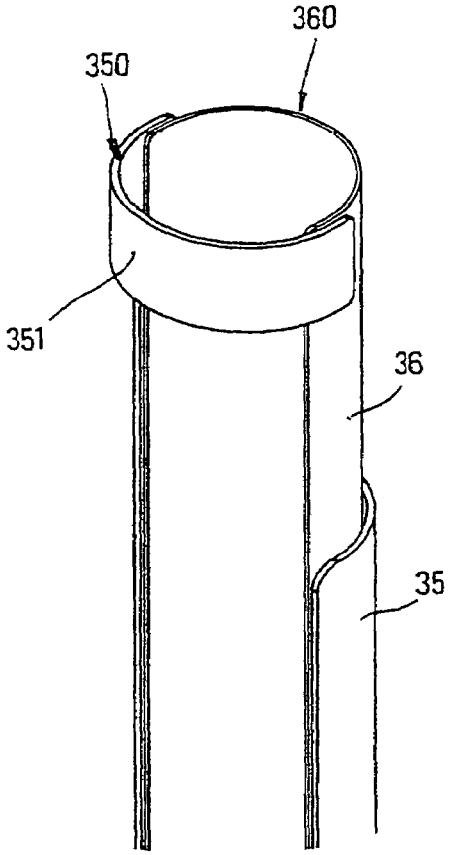
Figure 50:
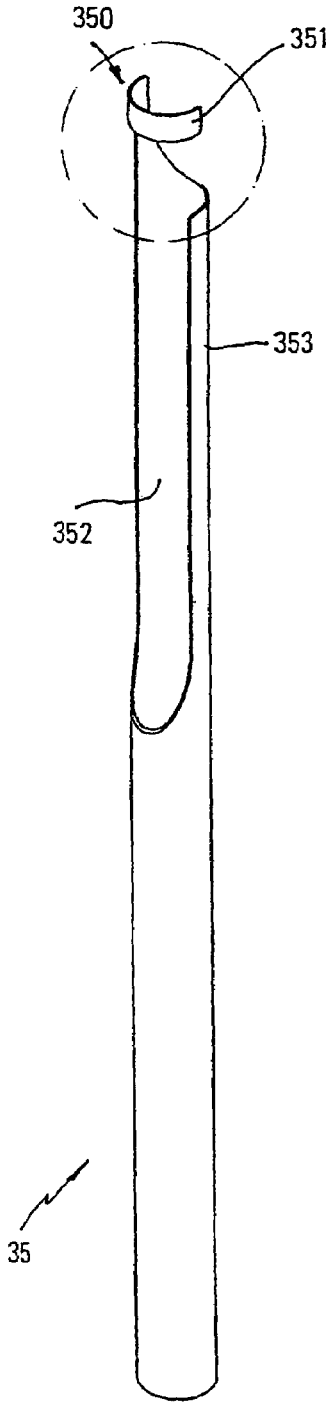
Figure 51:
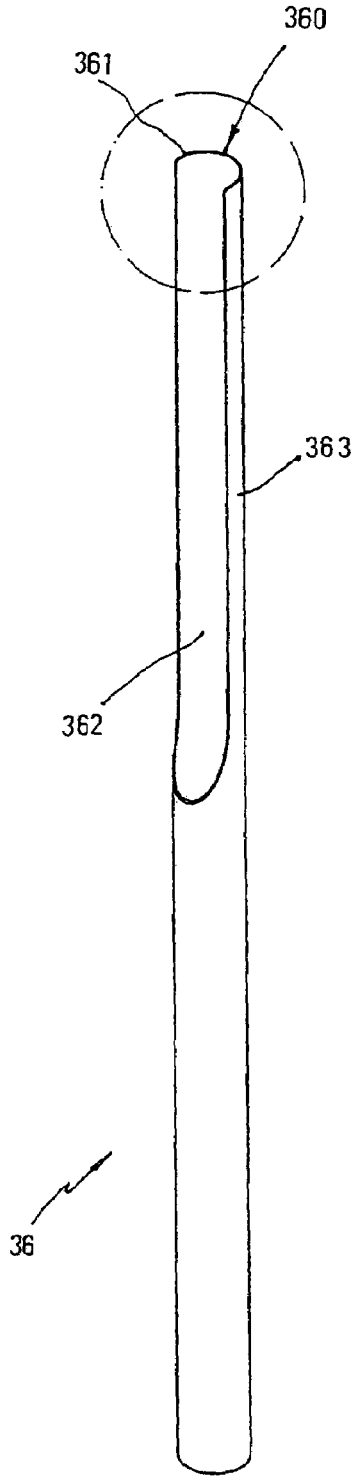
Figure 53:
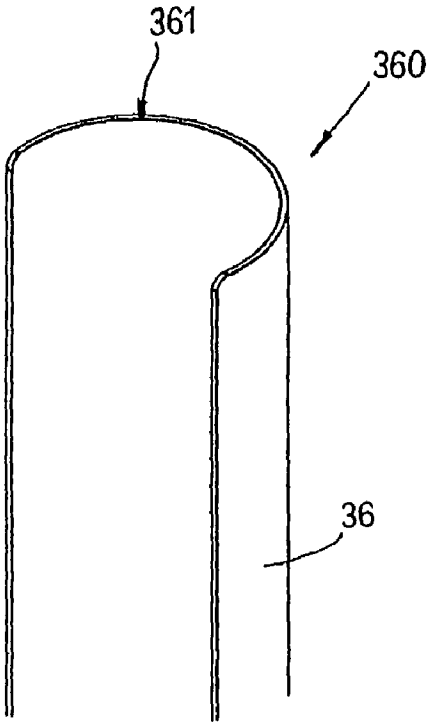
Figure 52:
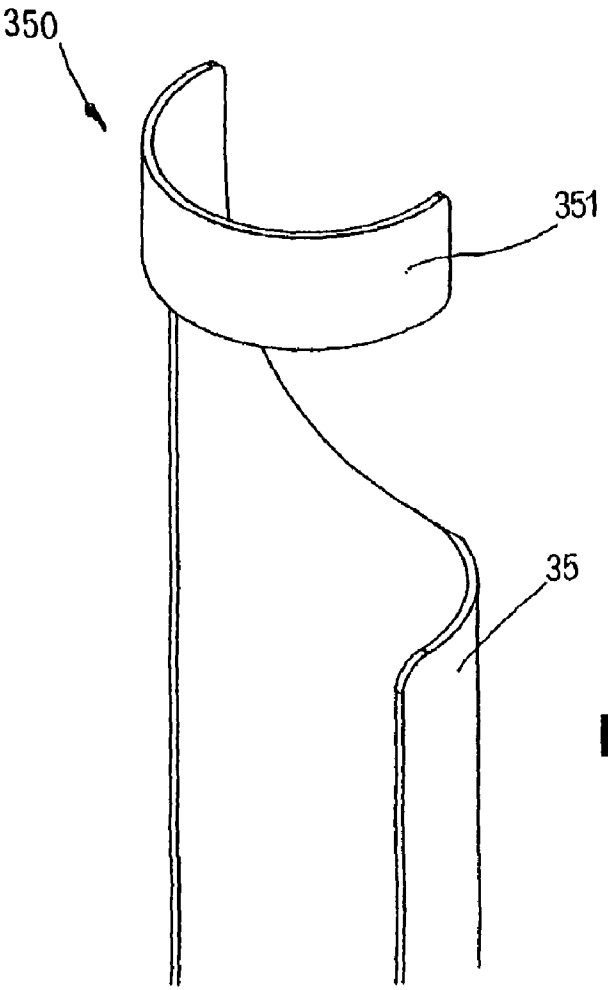
Figures 54, 55, 56, 57, 58, 59, 60, 61, 62, 63, 64, 65, 66, 67:
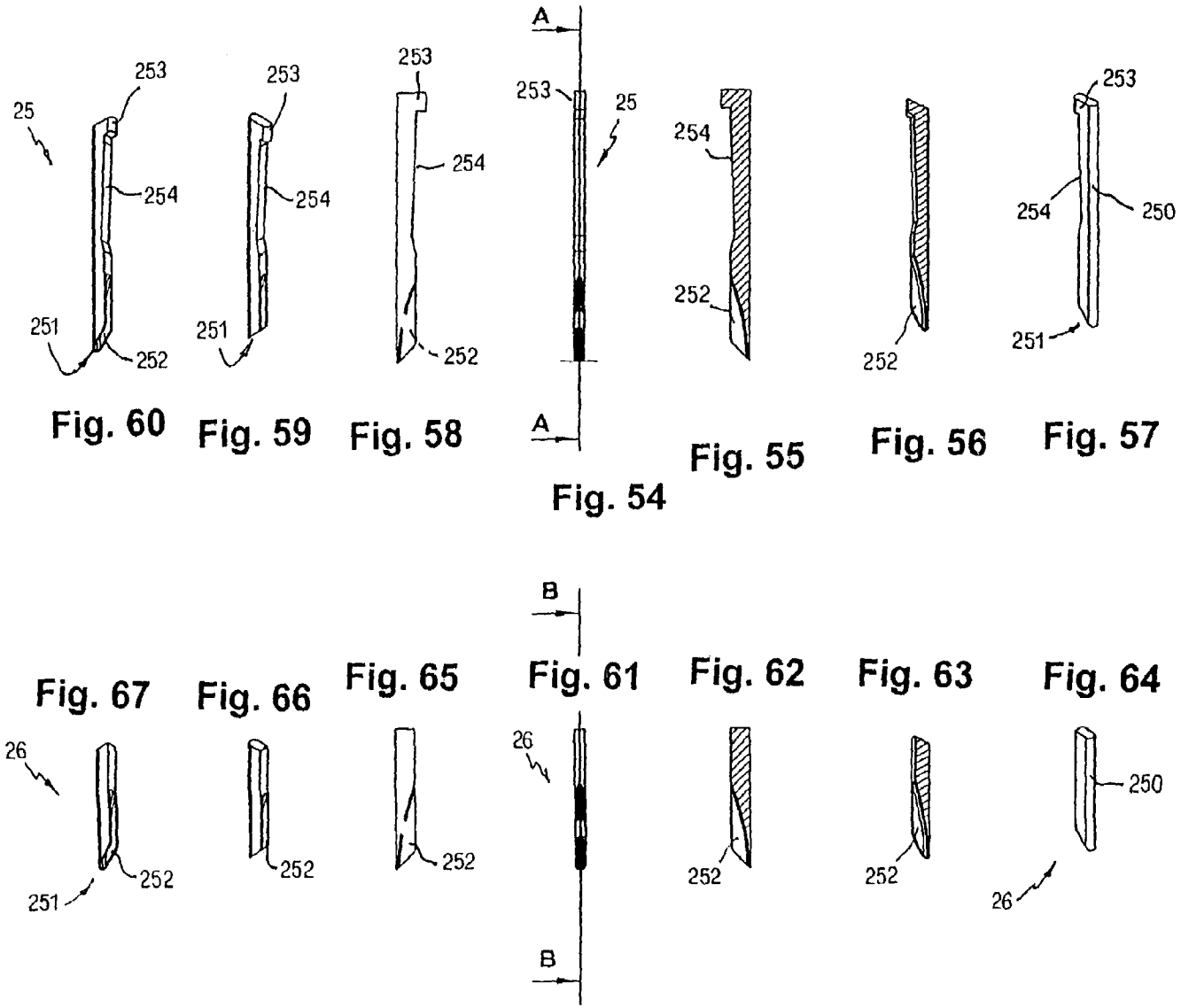
Figure 70:
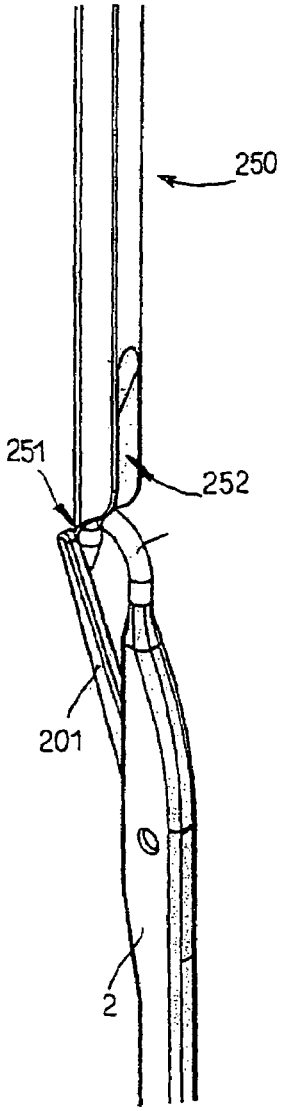
Figure 69:
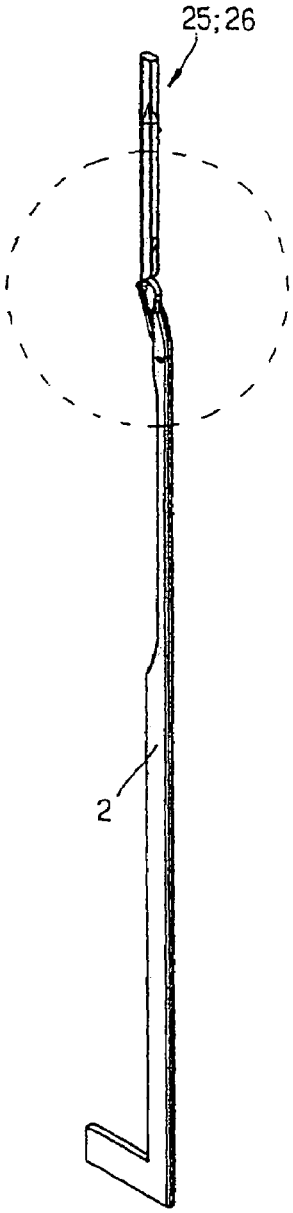
Figure 68:
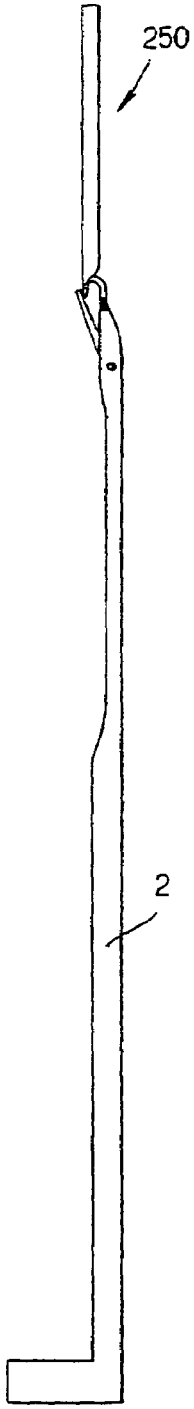
Figure 73:
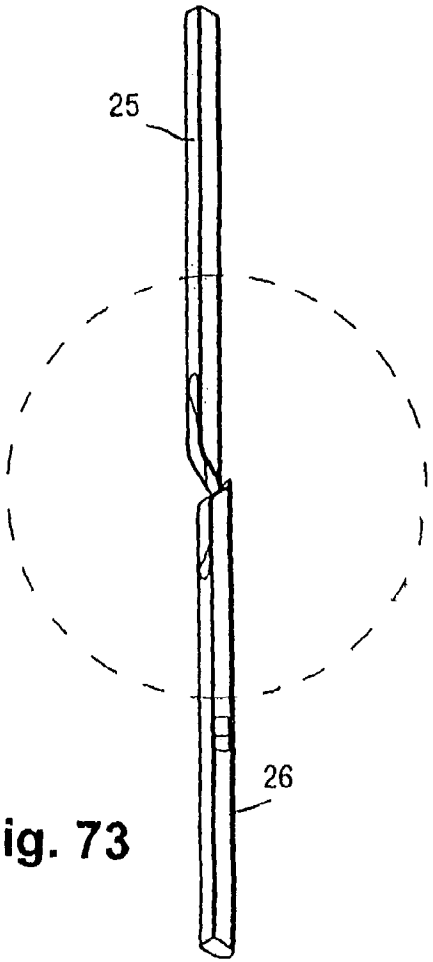
Figure 72:
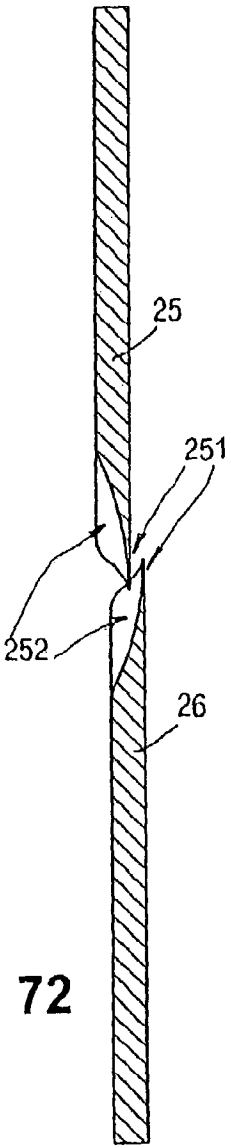
Figure 71:
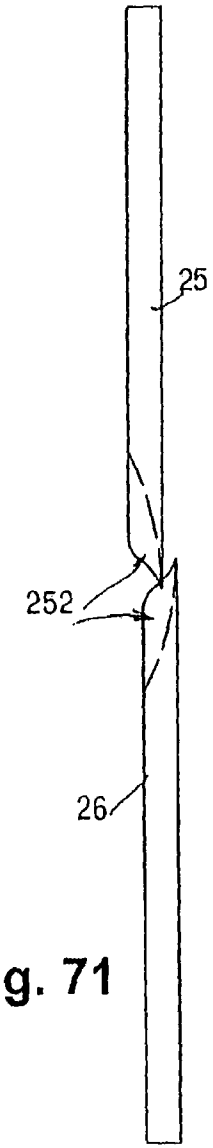
Figure 74:
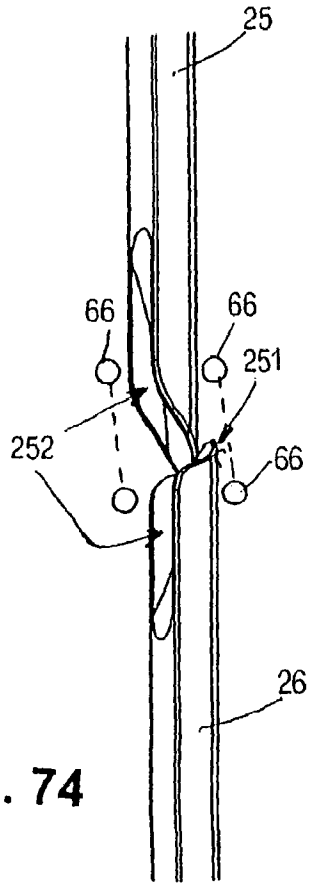
Figure 76:
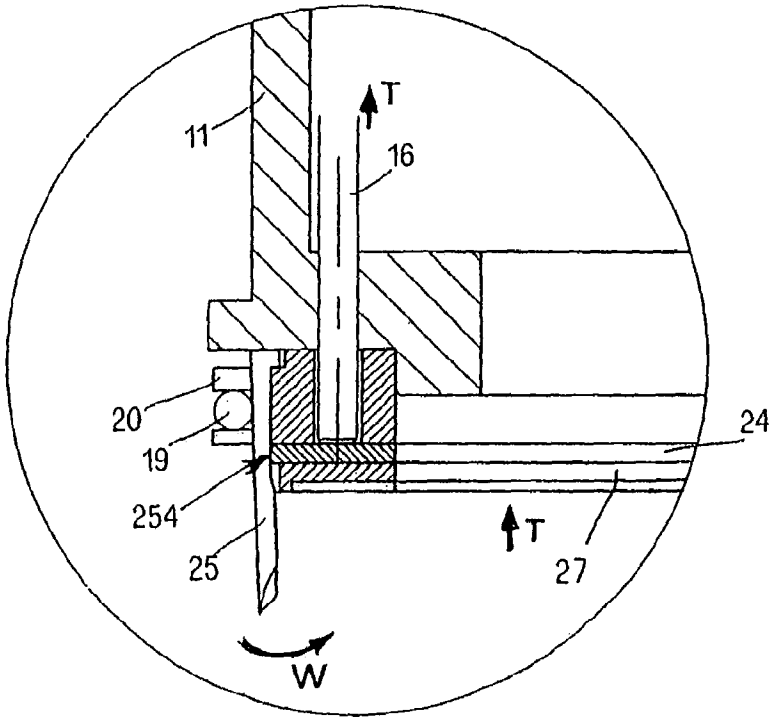
Figure 75:
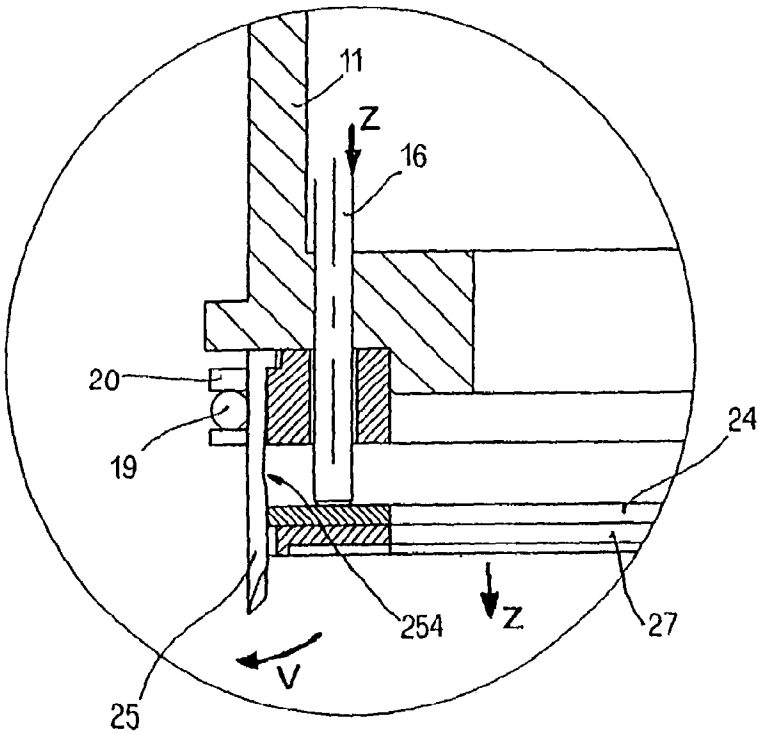
Figure 78:
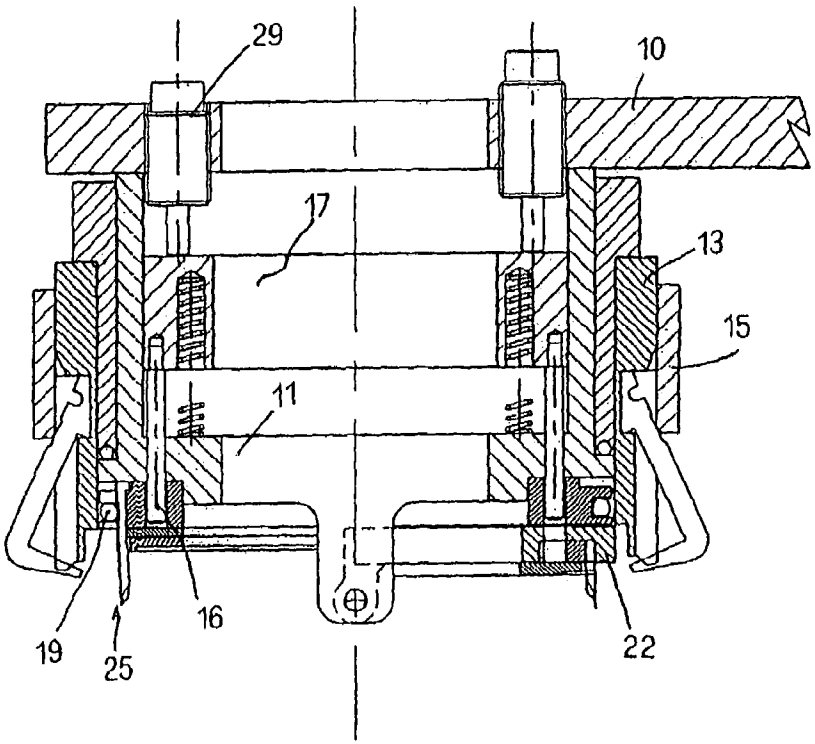
Figure 77:
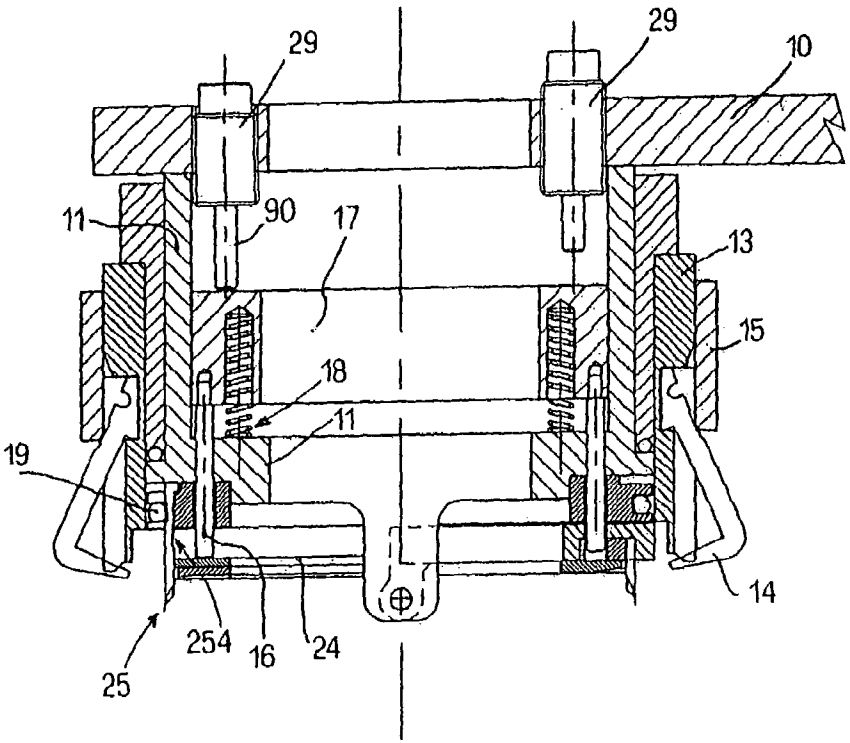
Figure 80:
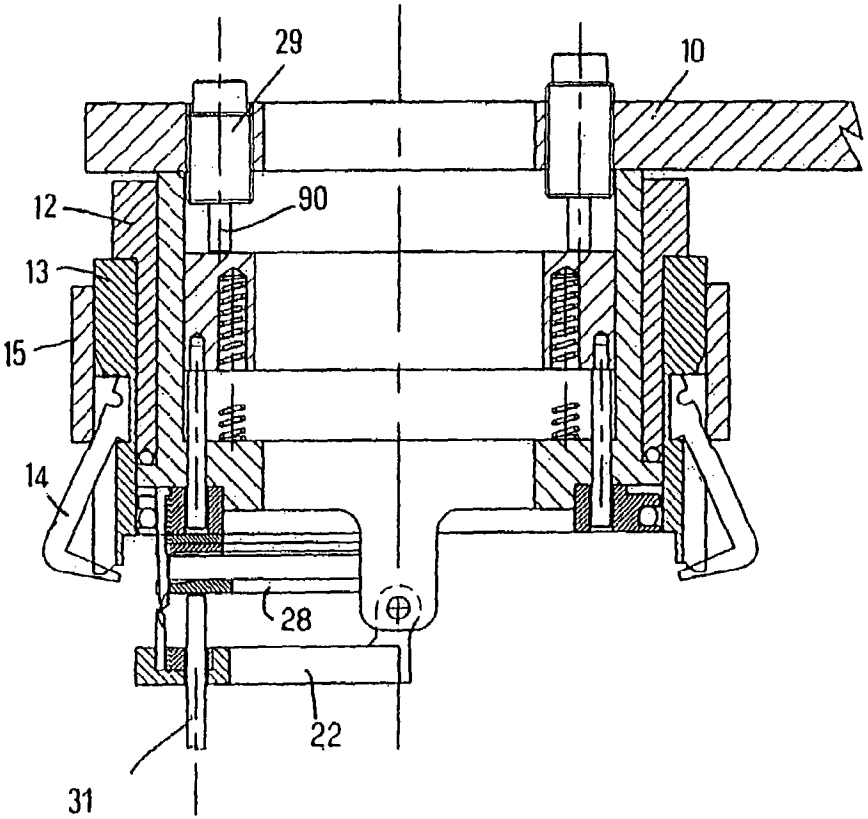
Figure 79:
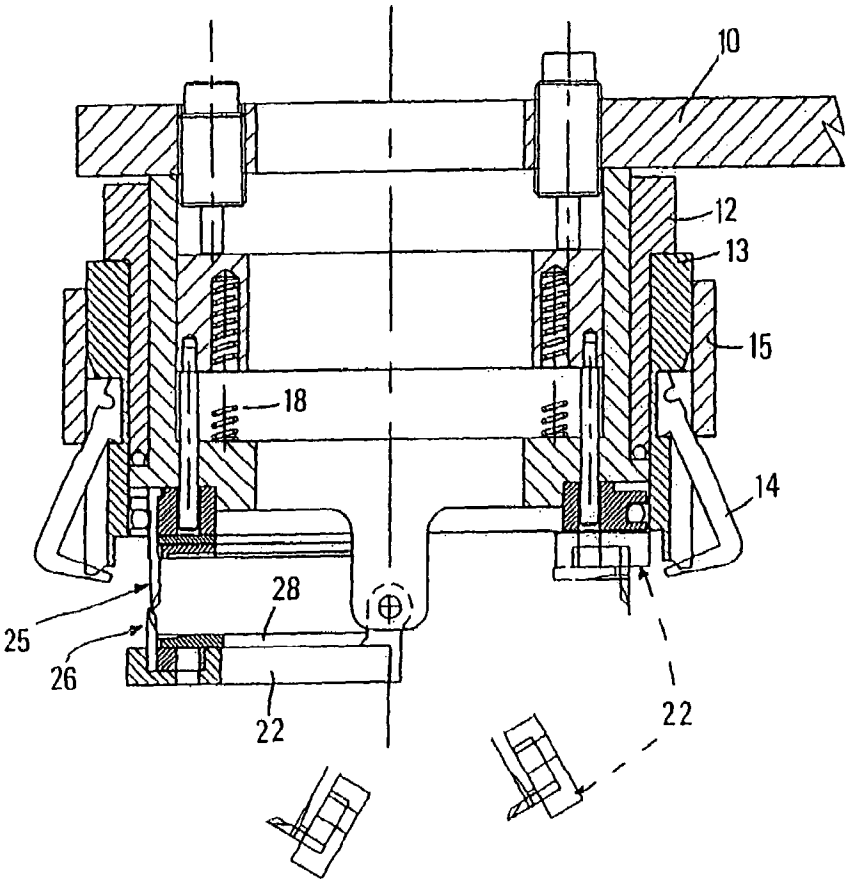
Figure 82:
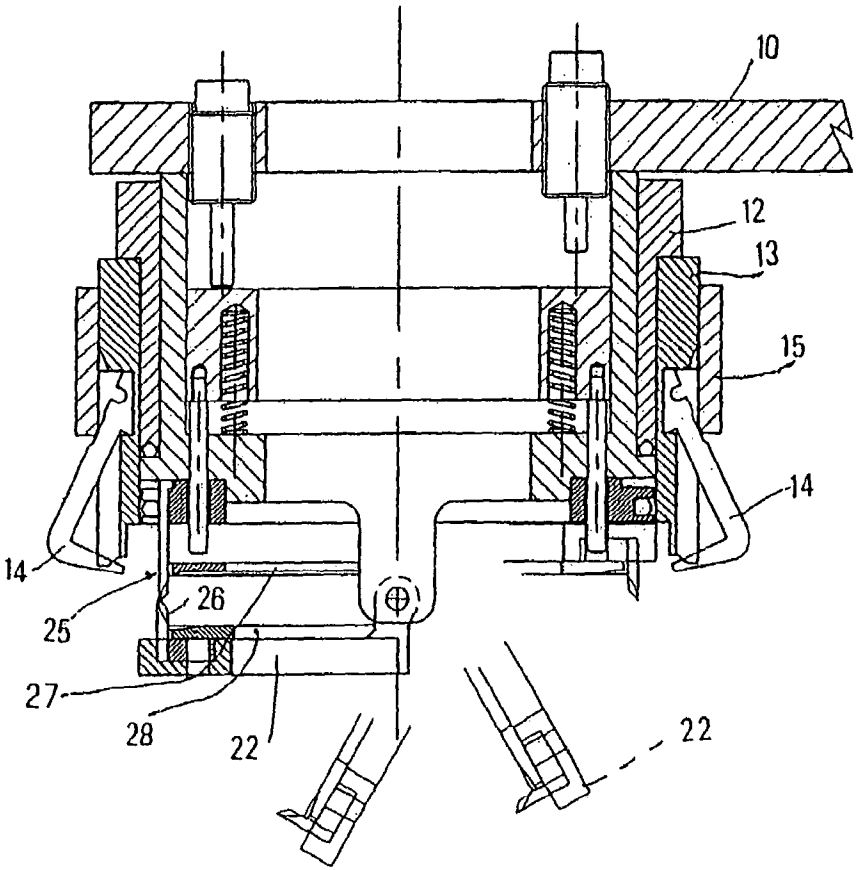
Figure 81:
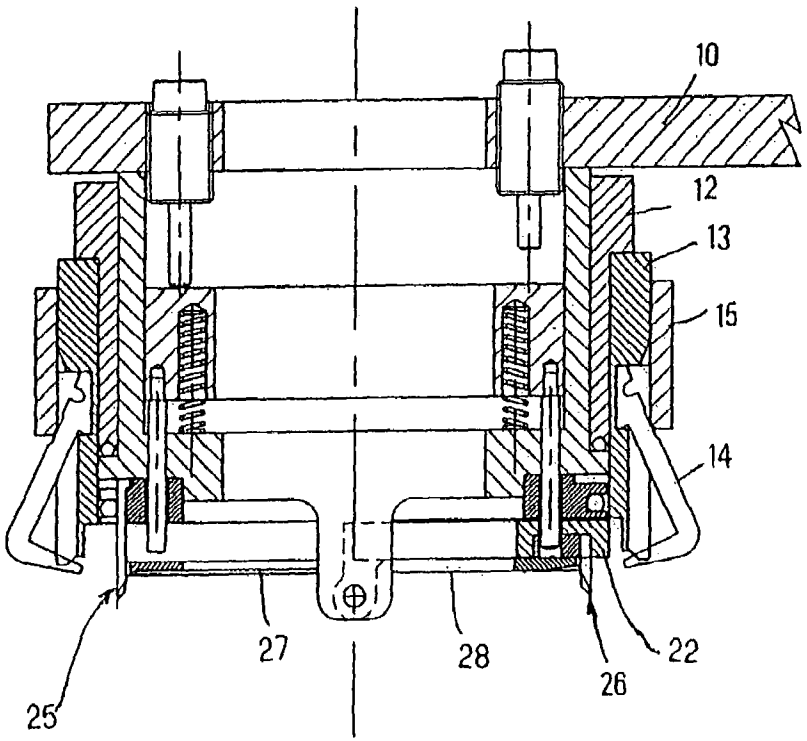
Figure 83:
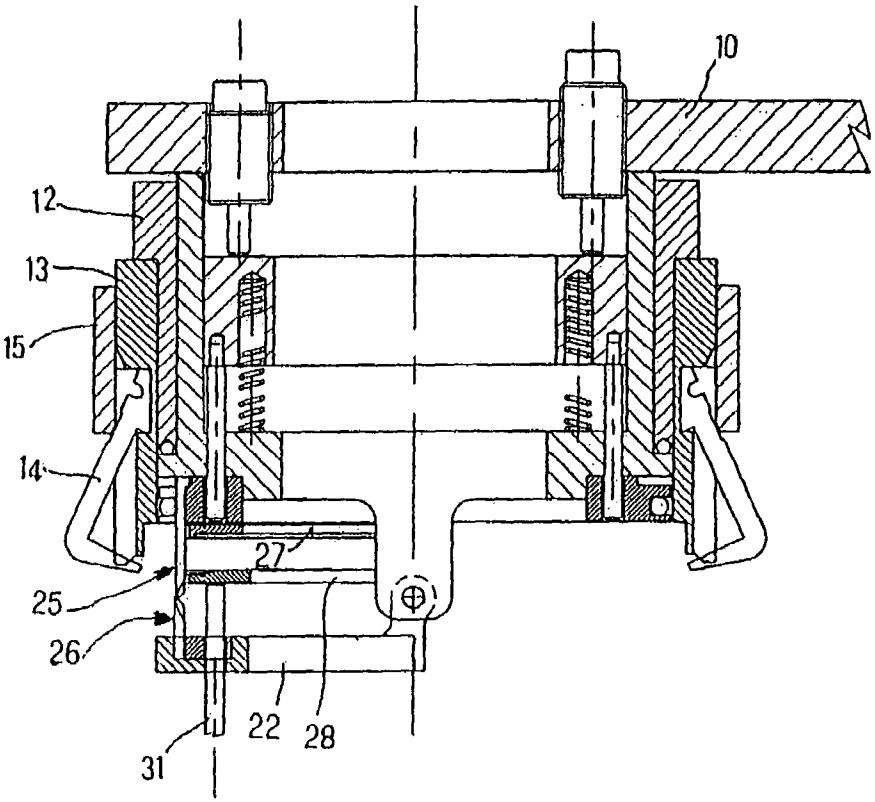
Figure 84:
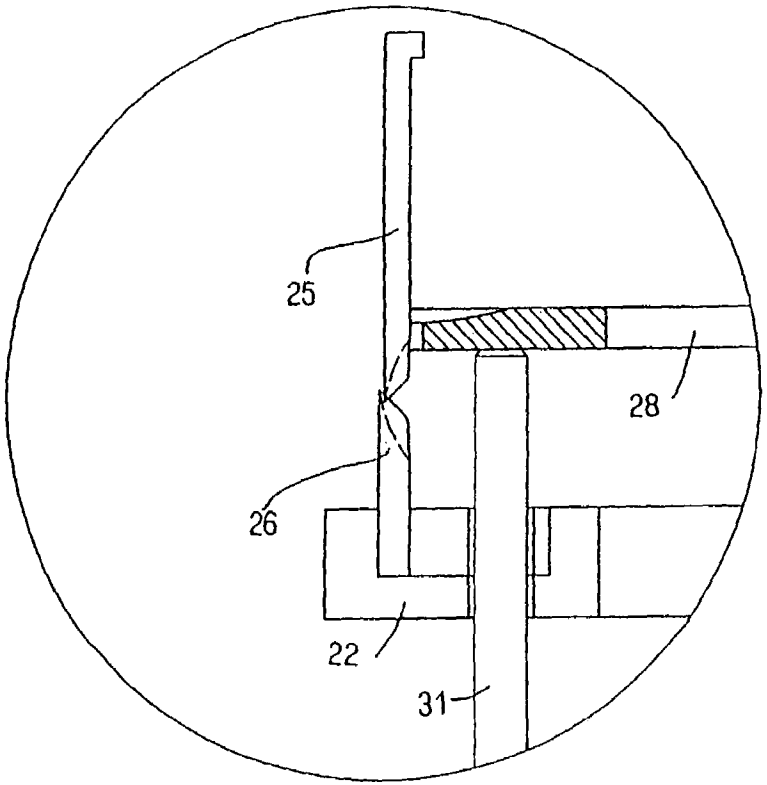
Figure 85:
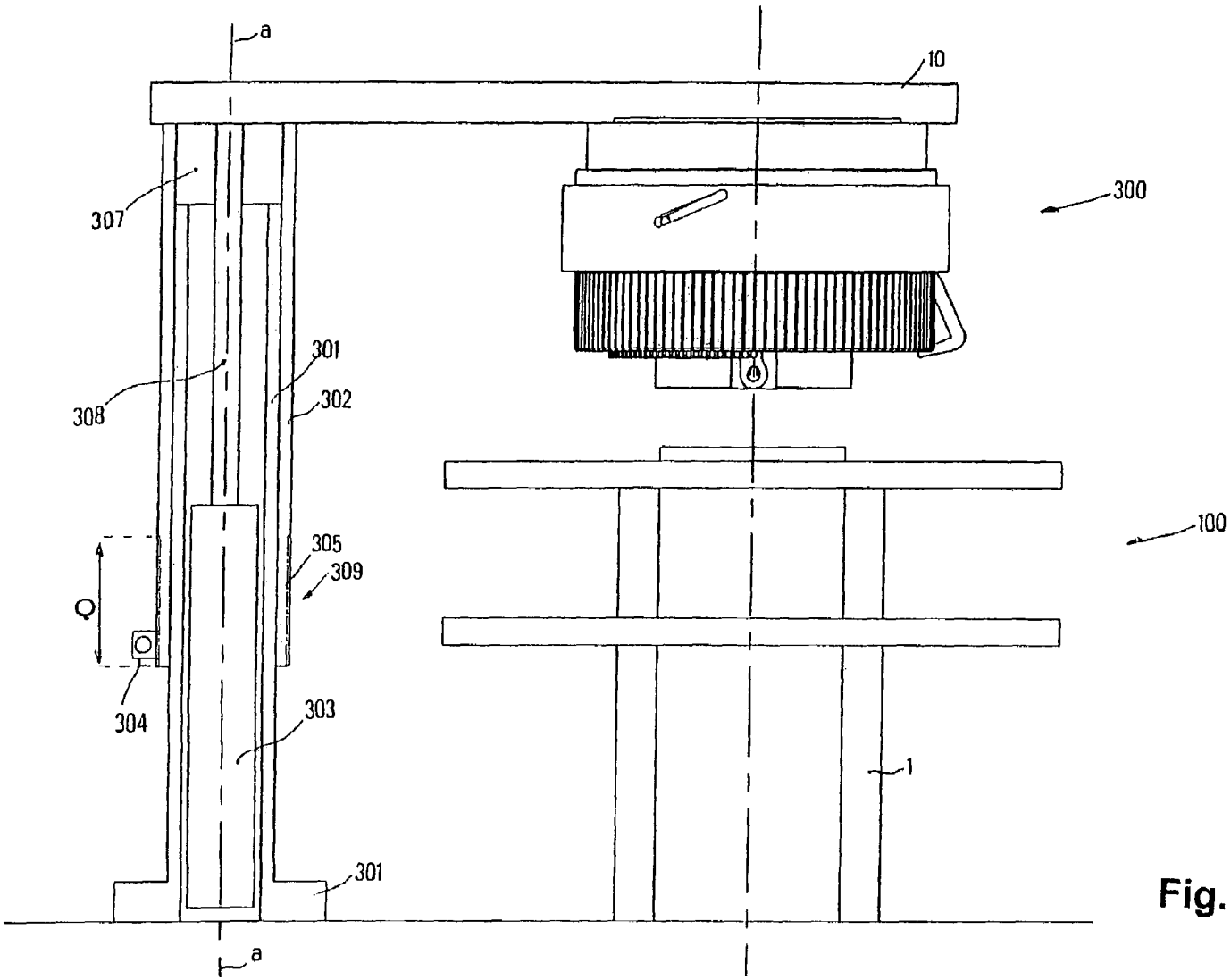
Figure 86:
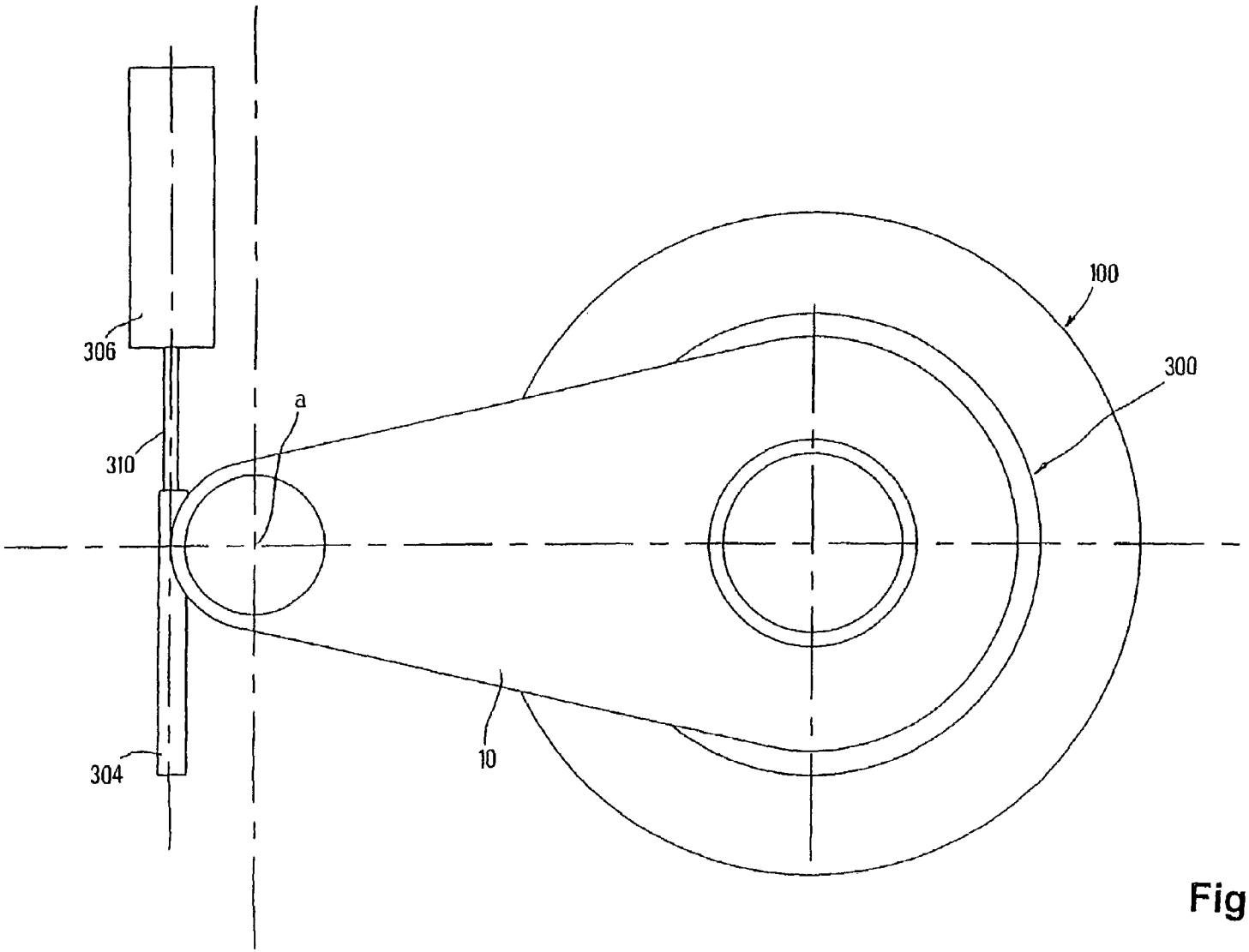
Figure 87:
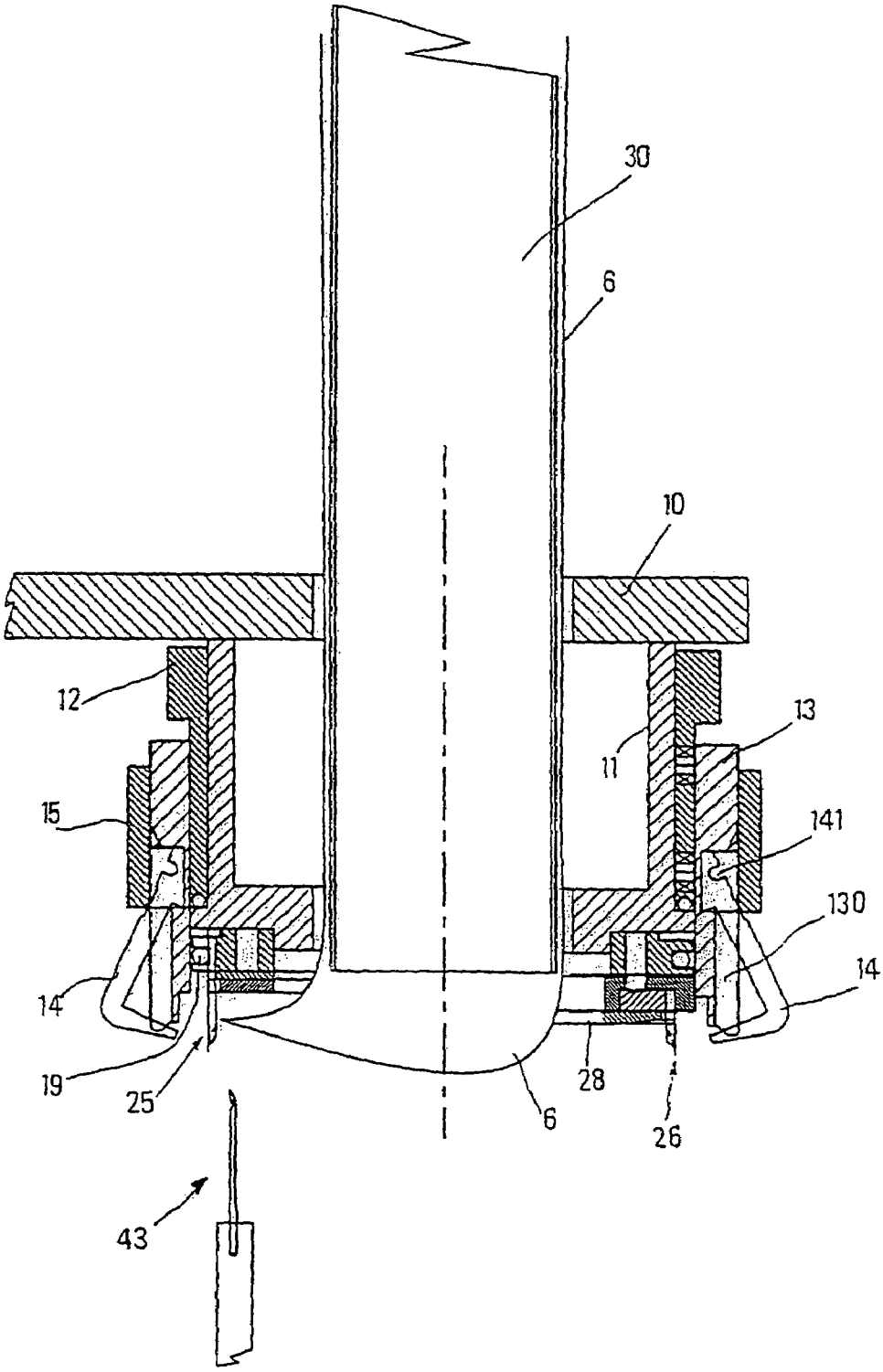
Figure 88:
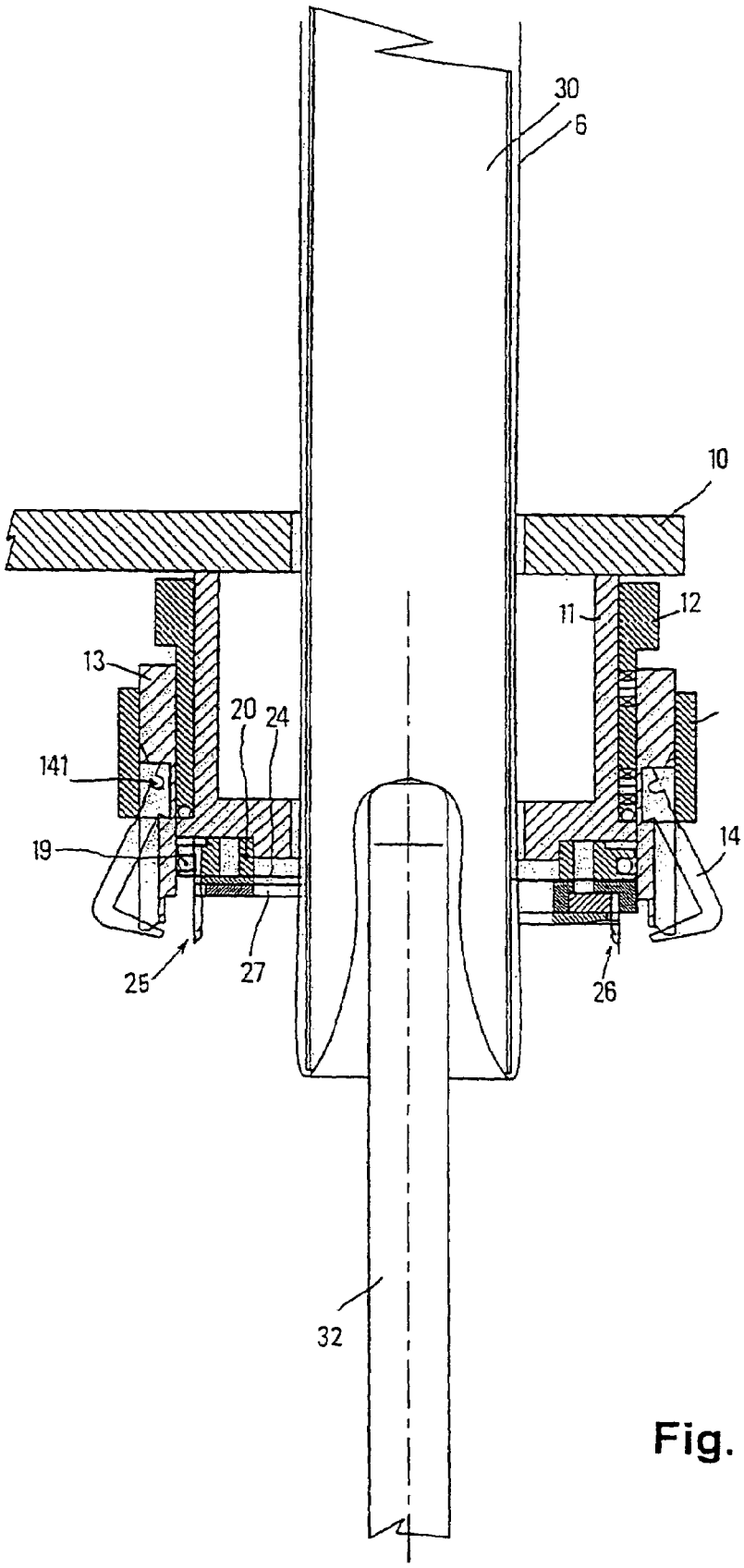

FIG. 3 refers to the phase in which, according to the invention, a movable carrier provided with removal means is moved onto the knitting head of the machine and the needles are further lifted so as to take the stitches to be removed above the sinkers;

FIG. 4 refers to a phase in which some of the above removal means—to be referred to later on also as punches—are moved close to the relevant heads of the needles;

FIG. 5 refers to a phase in which stitch-pushing means, which can be used during the removal phase and are hereinafter referred to also as hooks—are moved below the stitches to be removed and disposed in a closing configuration;

FIG. 6 refers to a phase for lifting the hooks and, along with them, the stitches which disengage from the needles and pass onto the removal means;

FIG. 7 shows the lifting of the punches which move away from the needles, and the consequent lifting of the article now released from the knitting head of the machine;

FIG. 8 shows the phase in which the carrier is moved away, along with the article supported thereon, from the knitting head of the machine;

FIG. 9 shows a subsequent phase in which the article is moved to a hooking-up station and inserted within a inside-out-turning tube presented by the same station;

FIG. 10 shows the phase in which the inside-out-turning tube is lifted, thereby allowing the article to turned inside-out achieving the turning inside-out of the article with the initial end thereof oriented upwards above the rank of stitches removed from the punches;

FIG. 11 shows the final stage of the lifting operation, in which the turning-inside-out tube remains engaged with relevant supporting means (not shown) in correspondence of its upper end, while the lower end of the tube remains free and above the plane of the removed stitches, with the article resulting fitted on the outer side of said tube;

FIG. 12 shows the phase in which the stitches of a first semi-rank are overturned through substantially 180° about the diametral axis which ideally divides the circumference of the removed rank into two semi-ranks;

FIG. 13 shows the phase in which, after the overturning shown in the preceding figure, each member for the removal of the first semi-rank is in correspondence of a member for the removal of the second semi-rank, with the respective free ends thereof being close to each other;

FIG. 14 shows the phase in which the first rank-removing members are brought back to their starting position by operating the above said overturning in the opposite direction;

FIG. 15 shows the stitch-supporting means—so-called spines—which are moved close to the punches during the hook-up phase;

FIG. 16 shows how the stitches are transferred with a longitudinal push by suitable means, in the example a crown coaxial to the circumference defined by the punches;

FIG. 17 refers to the phase of hooking-up the stitches and/or pairs of stitches, fitted on the spines by hook-up means, by making the necessary chain-closing knots;

FIG. 18 refers to the phase in which the hooked-up stitches are released from the spines;

FIG. 19 shows an enlarged perspective view of a hook;

FIG. 20 is a side view of a possible embodiment of a movable carrier according to the present invention;

FIG. 21 is a view in section taken on line B—B of the movable carrier shown in FIG. 20;

FIGS. 22, 23 and 24 are, respectively, a bottom view, an axonometric view, and a sectional axonometric view of the movable carrier shown in the preceding figures;

FIG. 25 is a side view of a movable carrier during the overturning of a relevant sector of means for the removal of the first semi-rank;

FIG. 26 is a view in section taken on line F—F in FIG. 25;

FIG. 27 is a front view of the movable carrier, that is, a view angularly shifted through 90° with respect to FIG. 25;

FIG. 28 is a view in section taken on line E—E in FIG. 27;

FIGS. 29, 30 and 31 show the movable carrier during the overturning phase in a first axonometric bottom view (FIG. 29) from a point of view similar to that of FIG. 25, a second axonometric bottom view (FIG. 30) from a point of view similar to that of FIG. 27, and a sectional axonometric view (FIG. 31);

FIG. 32 is an exploded side view of the movable carrier shown in the preceding figures;

FIG. 33 is a sectional view taken on line D—D in FIG. 32;

FIGS. 34 and 35 show axonometric bottom views of the carrier, from points of view similar respectively to those of FIGS. 32 and 33;

FIG. 36 is a front view of an embodiment, according to the invention, of an inside-out-turning device with coaxial tubes in open condition;

FIGS. 37, 38 and 39 show the inside-out-turning device of FIG. 36 respectively in a sectional view taken on line A—A in FIG. 36, a sectional view taken on line B—B in FIG. 36, and an axonometric view;

FIG. 40 is an axonometric view similar to that of FIG. 39, with the inside-out-turning device being sectioned longitudinally;

FIGS. 41 and 42 refer, respectively, to a further axonometric view of the device of FIG. 36 and to an enlarged detail thereof;

FIG. 43 is a front view of one embodiment of the inside-out-turning device of FIG. 36 shown in closed condition;

FIGS. 44, 45 and 46 show the inside-out-turning device of FIG. 43 respectively in a sectional view taken on line C—C in FIG. 43, a sectional view taken on line D—D in FIG. 43 and in axonometric view;

FIG. 47 is an axonometric view similar to that of FIG. 46, with the inside-out-turning device being sectioned longitudinally;

FIGS. 48 and 49 refer, respectively, to a further axonometric view of the device in closed condition as in FIG. 43, and to an enlarged detail thereof;

FIGS. 50 and 51 are axonometric views of, respectively, the outer tube only, and the inner tube only, both tubes making part of the exemplary inside-out-turning device shown in the preceding figures;

FIGS. 52 and 53 refer to enlarged details, respectively, of FIG. 50 and FIG. 51;

FIG. 54 is a rear view of a removal member making part of a pivoting semi-rank;

FIG. 55 is a sectional view of the removal member taken on line A—A in FIG. 54;

FIG. 56 is axonometric view of the removal member sectioned as in FIG. 55;

FIGS. 57, 58 and 60 show, respectively, the member of FIG. 54 in axonometric view, in side view, and in top (FIG. 59) and bottom (FIG. 60) axonometric views;

FIG. 61 is a rear view of a removal member making part of a fixed semi-rank;

FIG. 62 is a sectional view of the removal member taken on line B—B in FIG. 61;

FIG. 63 is an axonometric view of the removal member sectioned as in FIG. 62;

FIGS. 64, 65, 66 and 67 show respectively the member of FIG. 61 in axonometric view (FIG. 64), side view (FIG. 65), and in top (FIG. 66) and bottom (FIG. 67) axonometric views;

FIG. 68 is a side view of the engagement of a needle with a removal member in a removal phase;

FIGS. 69 and 70 are axonometric views, respectively, of the engagement of FIG. 68 and of a detail thereof;

FIG. 71 is a side view of two removal members engaged with each other during the transfer of a stitch;

FIGS. 72, 73 and 74 show, respectively, a longitudinal section, an overall axonometric view, and an axonometric view of a detail of the removal members of FIG. 71;

FIGS. 75 and 76 are a side view of a removal member during a removal (FIG. 75) and transfer (FIG. 76) of a stitch;

FIGS. 77, 78, 79 and 80 are sectional views of details of the movable carrier during the phases subsequent to said removal, showing the members for moving the pivoting removal members and the stitch-pushing means during said transfer;

FIGS. 81, 82, 83 and 84 show sectional details of an alternative embodiment of the movable carrier during the phases subsequent to said removal;

FIG. 85 is an outline side view of the movable carrier positioned on the machine's knitting head with a support column and an actuator for the vertical movement thereof;

FIG. 86 is a plan view of the movable carrier outlined in FIG. 85, with the actuator for the movement thereof from and to the knitting and hook-up stations;

FIG. 87 shows a phase alternative to that shown in FIG. 15, in which a hook-up needle is moved close to the punches which support the stitches onto the movable carrier, in order to hook-up stitches and/or pairs of stitches, fitted onto the punches by means of the hook-up needle, by making the necessary chain-closing knots directly on the punches;

FIG. 88 refers to the phase, similar to that of FIG. 18, of releasing the hooked-up stitches.

Figure 2:
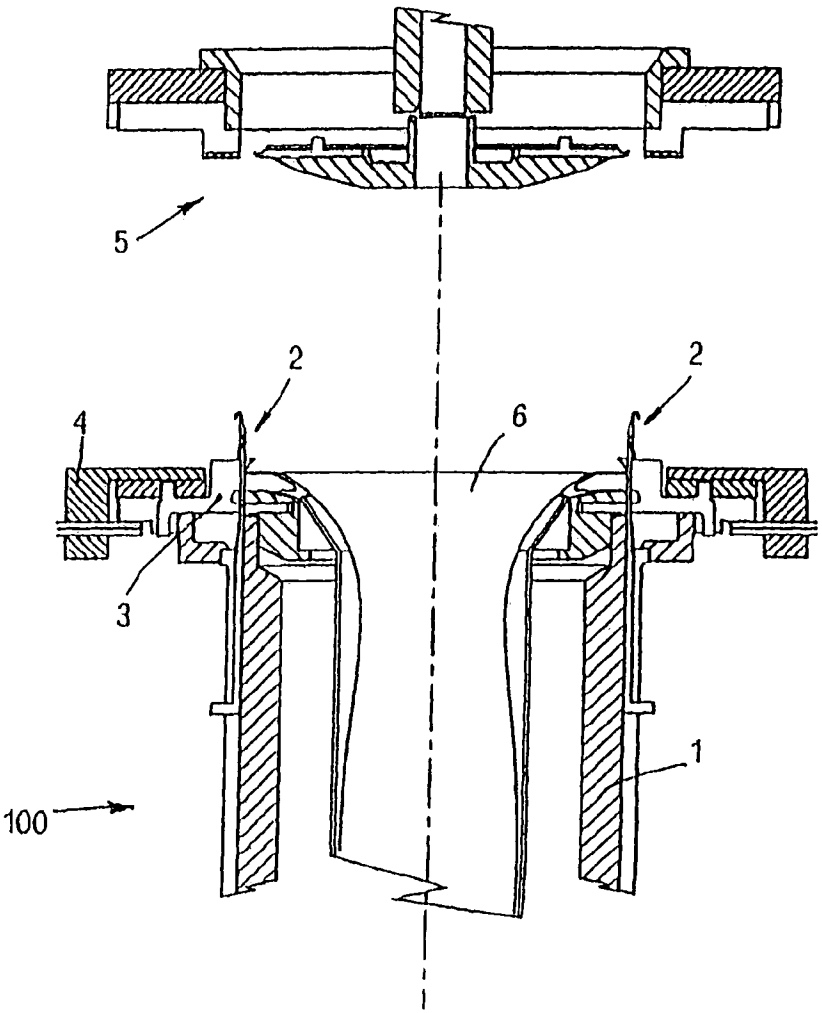
FIG. 2 shows the machine of the preceding figure, upon the subsequent operating phase in which the plate is lifted to make the knitting head of the machine accessible, and in which the needles are lifted so as to move each stitch up to the so-called "unloading" position, that is, below the respective latch of the needle.
Figure 1:
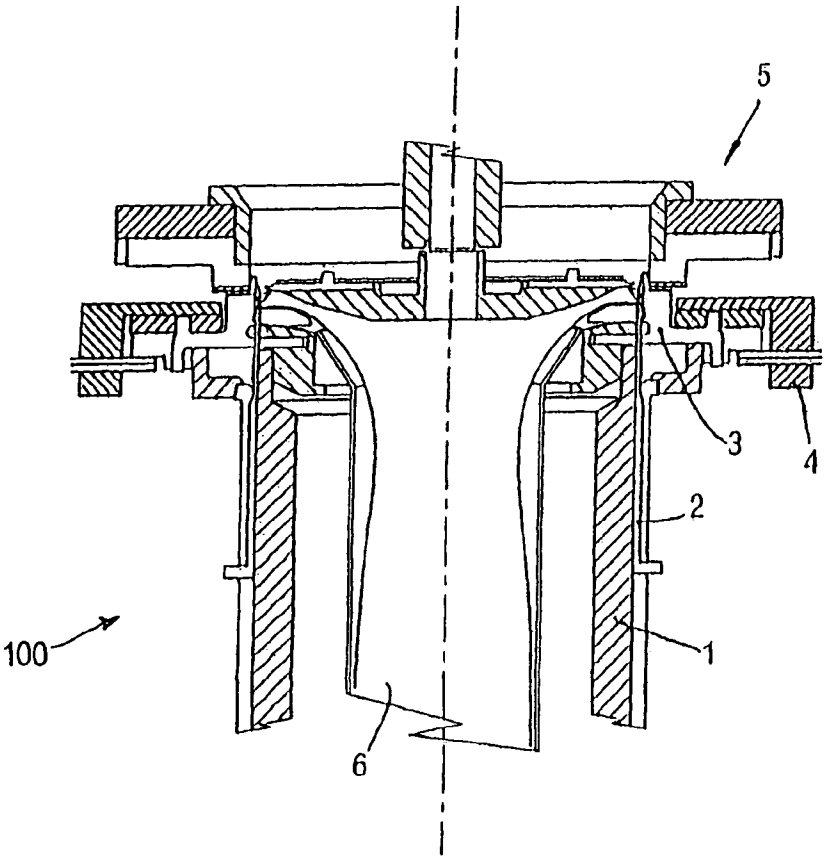
FIG. 1 is a front view, with parts in section, of a head for knitting an article (a stocking, in particular), which shows the head upon completion of the knitting of the stocking in correspondence of the toe which remains open.

With reference to the figures of the attached drawings, an apparatus according to the invention comprises a movable carrier 300 which is moved close to and away from a knitting head 100, and can be rotated and vertically displaced as well. FIGS. 85 and 86 show schematically the movement of carrier 300. In the example, the movable carrier 300 is supported by a relevant arm 10 horizontally disposed. The arm 10 is keyed on the sleeve 302 which is fitted on a relevant hollow column 301. Provided inside the column 301 is a pneumatic lifting cylinder 303, whose rod 308 is fixed inside the sleeve 302 in correspondence of the proximal end 307 of the arm 10. In this way, an extension of rod 308 corresponds to a lift of the arm 10 and of the movable carrier 300 as well supported by the latter. The lower portion 309 of the sleeve 302 is provided with a toothing 305. Also provided is a pneumatic cylinder 306, horizontally disposed, whose rod 310 supports a rack 304 complementary to the toothing 305 and meshing therewith. The travel of rod 310 drives into rotation the sleeve 302 about its longitudinal axis a-a and, consequently, causes the supported movable carrier 300 to rotate as well. Moreover, the toothing 305 moves to a height Q corresponding to the vertical travel of the sleeve onto the column 301 (or longer than the latter); this allows rotating the arm 10 while displacing it up to different levels. Again with reference to the accompanying drawings, and in particular to FIGS. 1–18, the knitting head 100 is provided, in a known manner, with a cylinder 1, needles 2, sinkers 3, and a sinkers case 4. The completion of an article 6, such as a stocking, is made on the knitting head 100 with the use of a plate group 5. Upon completion of the knitting, as illustrated in FIG. 1, the stocking or article 6 has the configuration in which the tubular part is knitted and the toe remains open.

At this point, the plate 5 is lifted (see FIG. 2) in a known manner which, therefore, will not be described herein in detail. At the same time, the needles 2 of the knitting head 100 are lifted so as to move each stitch of article 6 to the position so-called "unloaded" in technical jargon, that is, to a level along the needle which is below the latch 201 of the needle 2 (numeral 200 indicating the needle's head).

As mentioned before, and as shown in FIG. 3, the apparatus in question comprises the movable carrier 300 supported by the arm 10 which allows the vertical and rotational movement thereof. After the plate 5 is moved away, the movable carrier 300, provided with means for the removal of the article, is superimposed to the knitting head 100. In this phase, the needles 2 are further lifted so as to move the stitches above the sinkers 3.

Before describing the operation of the apparatus any further, let us point out the characteristics of the movable carrier 300 by making reference in particular to FIGS. 19–35. The movable carrier 300 exhibits a support body 11 on which relevant hooks 14 are fixed and intended to move the stitches during the removal of the needles 2 from the knitting head 100. The supporting body 11 has a hollow cylindrical shape with two cross-sections: one upper cross-section of greater diameter 110 and one lower cross-section of smaller diameter 111. The hooks 14 are inserted into a corresponding number of slots 130 vertically disposed and presented by a hook-supporting crown 13 located externally and coaxially to the body 11 which supports the movable carrier 300.

Moreover, the support body 11 exhibits, in correspondence of the region connecting the upper 110 with the lower 111 section a projecting peripheral edge or frame 112. Coming to rest on the frame 112 is a hollow cylindrical element 12 which defines a cam. The cam element 12 results interposed between the body 11 and the crown 13 supporting the hooks 14. As best shown in FIG. 19, the hooks 14 have, when viewed laterally, a substantially "L" shape, with the short leg 145 of the "L" being disposed below. The upper end 140 of the hooks 14 is inserted into an annular cavity 131, of rectangular cross-section, formed on the outside of crown 13. In correspondence of the said upper end 140, the hooks 14 exhibit a groove 141 on their outer side (that is, on the side facing centrifugally relative to the movable carrier 300). On the inner side (that is, centripetally with respect to carrier 300), the end 140 has a triangular portion defining a step 142 connected with the apex 144 of the upper end 140 via an oblique portion 143, that is, a portion with oblique edge to the longitudinal development of the stem of hook 14.

Housed within the grooves 141 of hooks 14 is an elastic ring (designated by numeral 8 in FIG. 13 only, for the sake of clarity) which retains the said ends 140 inside the cavity 131 of crown 13. In this way, in the absence of further interventions, the oblique portions 143 of the hooks result in contact with and parallel to the vertical wall of cavity 131, as they are kept so retained by the elastic reaction force of the above mentioned ring. This determines an outwardly inclination of the stems of hooks 14, which, owing to the action of the elastic ring, result in an open configuration such as that shown also in FIGS. 3 and 4. Besides, the presence of the step or tooth 142 determines a restraint to the downward displacement of the hooks 14 within the slots 130 where they are inserted.

Provided externally to the crown 13 is a ring 15 (hereinafter also referred to as "hook-closing ring") intended for moving the hooks 14. The ring 15 is fitted on the crown 13 and is able to slide vertically relative to the same crown. Provided on the hook-closing ring 15 are one or more helicoidal slots 150. The helicoidal slots 150 act like cams able to determine the vertical movement of the hook-closing ring 15 in correspondence of the rotational movement of relevant pivots inserted into the slots 150.

Moreover, oblique slots 120 are formed on the cam element 12 to receive corresponding pivots 132 (in FIG. 28, numeral 132 designates the axis of one of the pivots 132) which connect the cam element 12 with the crown 13 so as to allow the vertical movement of the latter upon the displacement of pivots 132 within the cams defined by the oblique slots 120. In FIG. 28, besides, numeral 134 designates a hole, and numeral 135 designates the axis of the pivot inserted therein and able to connect the support body 11 with the crown 15. Provided on the lower portion of the support body 11 are two groups of removal members 26, 25 (also called punches in the present description) to be associated, respectively, with the first and second semi-rank of the article knitted on the knitting machine 100. In some of the attached figures, only one punch or removal member 25 or 26 is shown, for the sake of clarity, when a plurality of these members is provided in repeating series, such as in FIGS. 23, 25, 28, 29 and others. Referring now to FIGS. 3–18, fixed in the left side of the lower portion of the support body 11 is a crown 20 supporting the removal members 25 of the second semi-rank. As best viewable in FIG. 34, the crown 20 has a half thereof provided with seats for the punches 25. The removal members 26 of the first semi-rank are disposed on a semicrown 21 supported by a semicircular sector 22 hinged to the lower portion 11 of body 11 in correspondence of two diametrically opposite hinges 23. As will be described later on in greater detail, the semicircular sector 22 can be rotated through 180° so as to dispose the semicrown 21 of the first semi-rank below the crown 20 of the second semi-rank. Moreover, with reference in particular to FIG. 30, provision is made for cylindrical containers 88 on the semicircular sector 22 to receive stitch-pushing springs to be described below, while holes 89 are provided for the passage of vertical bars 16 described with reference to FIGS. 75–80, and holes 87 for the passage of screws (not shown) for fixing the crown 20 to the body 11. In the illustrated exemplary embodiment (as best illustrated in FIGS. 61–67), the removal members 26 of the first semi-rank are essentially made up of a rectilinear and flat body which is tapered in its distal end 251. In correspondence of said end 251, on the side in which the taper begins, a notch 252 is formed within the thickness of the said body to receive the needle 2 of the knitting head 100 during the removal phase (as illustrated in FIGS. 68–70). On the opposite or proximal side, the removal member 26 exhibits a stem 250 by which it is retained firmly by the support means defined by the semicrown 21. The removal members 25 of the second semi-rank (see FIGS. 55–60) are like those of the first semi-rank above described, as far as the free end 251 and the cavity 252 allowing the engagement thereof with the needle of the knitting machine are concerned, but they differ in the stem's region. (In FIG.

69, numerals 25 and 26 refer generically to a removal member which is similar for both first and second semi-rank; FIG. 70 also shows a generic stem 250 as this part is similar for the first and second semi-rank). The above characteristic differentiation of the stem's region is due to the difference of the support means (that is, crown 20) which allow an oscillatory movement with radial direction, that is, with "in-out" direction with respect to the circumference of the needles. This results of advantage in allowing a good covering during the engagement for the transfer of the stitches of the first semi-rank onto the removal members of the second semi-rank since, by a centripetal movement of the free ends of the removal members of the second semi-rank, it is safer to have the apexes of the ends of the latter inserted into respective cavities of the removal members of the first semi-rank (see FIGS. 71–74). In this context, the term "covering" refers to the partial overlapping of two elements (for example, two removal members, or one removal member and one needle) to allow the passage of a stitch from one to another of said elements without having any dead regions or times in which the stitch is not engaged by one of the two elements. In FIG. 74 at 66, two stitches of the article 6 are schematically represented as they are made to pass from the removal member 26 to the removal member 25, thanks to the above said covering situation.

The above described movement is centripetally induced by a spring (or other elastic body) which is opposed by a semi-ring or semi-crown 24 acting on the inside of stems 250 of the same removal members 25 where a special profile (indicated with 254) acts as a cam upon the variation of longitudinal position of said semi-ring 24. In practice, when the semi-ring 24 interacts with the profile 254 (stem's minor section) the removal member is maintained in the inner position; when, instead, the semi-ring 24 interacts with the removal member's portion closest to apex 251 (major section), the removal member 26 is pushed outwardly. With reference to the examples of the attached drawings, FIGS. 75–80 show how the removal member 25 is inclined either inwardly or outwardly according to the operating phase. In particular, FIG. 75 shows (partially) the movable carrier in removal position in which the removal member 25 is kept facing outwardly (direction indicated by the arrow V); on the contrary, in FIG. 76 the removal member is in a stitch-transfer position and is kept facing inwardly by the action of spring 19 (an elastic ring in the illustrated example) being not opposed by the semi-ring 24 which, in fact, lies in the profile 254 of the removal member; again in this figure an arrow (W) indicates the direction of displacement of the removal member 25.

In FIGS. 75–83 are shown some details that do not appear in the preceding figures, for example, pneumatic cylinders 29 provided on the arm 10. The pneumatic cylinders 29 operate via relevant rods 90 on a support element 17 exhibiting vertical bars 16 facing downwards. The support element 17 is vertically slidable inside the support body 11, and springs 18 are disposed between the latter and the support element 17 to provide a reaction able to push the element 17 upwards, that is, in a direction opposite to that of the downward thrust of rods 90. In some of the drawings, the springs 18 are represented only partially. With reference to FIGS. 75–80 in particular, the activation of the cylinder 29 causes the lowering of the rod 90, with the consequent downward displacement of the support element 17. This determines the lowering of the bar 16 which (as indicated by the arrows Z in FIG. 75) pushes down the semi-crown 24, so that the latter, being no longer in correspondence of the cam profile 254, pushes the removal member 25 outwardly (arrow V). On the contrary, when the bar 16 is brought back upwards (arrow T in FIG. 76), the semi-crown 24 too moves up to engage the profile 254, and the action of the spring 19 wins that of the removal member 25 which is thus kept inwardly (arrow W).

FIGS. 81–84 show an alternative embodiment of the said removal members 25. In this embodiment, each removal member 25 is fixed on the relevant crown 20, and the covering condition is obtained by disposing the removal members 26 of the first semi-rank and those of the second semi-rank over two ideal circumferences of different radius and/or providing a group (for example, the punches 26) of larger size with respect to the other group of punches. These characteristics are more evident by the detail of FIG. 84 where the punch 26 of the first semi-rank results further externally (as it lies on a circumference of larger radius) than the punch 25 of the second semi-rank and, besides, it has a size larger than the other.

As above mentioned, once the group of plate 5 has been moved away, the movable carrier 300 is placed above the knitting machine 100.

At this point (see FIG. 4), the removal members 25 and 26 are moved closer to the respective needle heads, and the interaction between the needles 2 and removal members 25, 26 is similar to that illustrated in FIGS. 68–70. Afterwards (FIG. 5), the hook-closing ring 15 is lowered, thereby determining the positioning of the hooks 14 below the stitches to be removed which are, therefore, in their closed configuration. As can be seen in FIG. 6, the support crown 13 is lifted, along with the hooks 14 supported by the same crown, so that the hooks move the article's stitches upwards and the latter disengage from the needles 2 to pass onto the removal members 25 and 26. Thereafter (FIGS. 7, 8, 9), the movable carrier 300 is further lifted and moved away form the knitting head 100 to take the article on to a hook-up station provided with an inside-out turning tube 30 in which the article 6 is inserted. The moving of article 6 away from the knitting head 100 can be effected soon after removing the stitches from the needles of the knitting head, as above described, or it can be effected afterwards, for example, in a possible alternative embodiment of the method, after the phase—to be described later on—in which the stitches of the two semi-ranks are moved close to each other.

FIGS. 36–53 illustrate embodiments, to be described later on in details, of the inside-out-turning tube 30. The general structure of said tube can be imagined, for example, like a tubular body inside which the article is inserted when the stitches of the last semi-rank, that is, the removed stitches, are still disposed around a circumference, that is, prior to the overturning through 180° of the first semi-rank. Thereafter, by a longitudinal movement, the article engaged on the tube is forced to pass through the open end of the tube, thereby causing the inside-out turning of the article, with the stocking that will be fitted outside the tubular body.

The inside-out-turning tube 30 is then lifted (FIGS. 9–11) thus causing the inside-out turning of the article which results fitted on the outside of the tube 30, with the initial end of the same article facing upwards and above the rank of stitches removed by the removal members. In the final phase (illustrated in FIG. 11), the inside-out turning tube 30 is engaged with relevant support means (not shown) in correspondence of its upper end, whereas the lower end of the tube remains free and above the plane of the removed stitches.

The inside-out turning phases above described, and those to be described below for preparing the hook-up operation, can be carried out at any point of the path of the movable carrier, that is, at positions different from the one described herein by way of example.

Afterwards, the hook-closing ring 15 is moved upwards thereby determining the opening of the hooks 14, that is, their displacement in centripetal direction.

At this point (see FIGS. 12–14), the stitches of the article's first semi-rank supported by removal members 26 are transferred by an overturning thereof of substantially 180° about the diametral axis which ideally divides the circumference of the removed rank into two semi-ranks. Thus, each removal member 26 of the first semi-rank lies in correspondence of a removal member 25 of the second semi-rank, with the respective free ends close to each other in a configuration similar to that described with reference to FIGS. 71–74; in this configuration, each stitch of the first semi-rank results juxtaposed and coaxial to the corresponding stitch of the second semi-rank.

At this point, through the action of a pusher 31 acting from the bottom upwards, a stitch-pushing semi-crown 28 makes the stitches slide along the removal members 26 to take them up onto the removal members 25 of the second semi-ranks located above.

Subsequently, the removal members 26 of the first semi-rank are brought back to their original position by the above said overturning operated in opposite direction.

Depicted in the lower side of FIG. 14 is a portion of the closing and/or hook-up machine 400, comprising a support body 42, a crown 41 with relevant hook-up spines 40, all being well known elements which, therefore, need not to be described in detail.

With reference to FIGS. 15–18, the hook-up spines 40 are moved close to the removal members 25 which, as already mentioned, support the two overlapping semi-ranks of the article; afterwards, owing to the downwardly directed push of a stitch-pushing semi-crown 27 coaxial to the circumference formed by the removal members 25, the stitches are transferred onto the spines 40.

The semi-crowns 27 and 28 are shaped alike a semicircular comb, with a series of slots 270 and 280 angularly spaced apart by such extents which correspond to the angular displacement between the removal members 26 and 25, so that the same semi-crowns are able to slide along the removal members while guided vertically by the latter.

Shown in FIG. 17 is a hook-up needle 43, by means of which the hook-up of stitches and/or pairs of stitches being fitted on spines is performed in a known manner by carrying out the necessary chain-closing knots.

According to the alternative embodiment illustrated in FIGS. 87–88, the pairs of stitches of the two semi-ranks, can be supported—during the closing/hooking-up of the toe of stocking 6—by the punches 25 of the second semi-rank, and a hook-up needle 43 can be brought close to the latter, which needle, instead of operating the hook-up on spines provided for this purpose, will perform such operation by exploiting the punches 25 which, advantageously, exhibit the said cavity 252, that is, the one used for the engagement of the needle 2.

Finally (FIG. 18), once the stitches have been hooked-up onto the spines (or, likewise to the example of FIGS. 87–88, onto the punches 25 of the second semi-rank located on the movable carrier), the article 6 is pushed inside the same inside-out turning tube 30 so as to take up a right-side-out condition. This operation can be carried out by using a bar 32 to be inserted into the tube 30 by an extent sufficient to complete the right-side-out arrangement of the article which, after such operation, is definitely ejected.

As above mentioned, FIGS. 36–53 show exemplary embodiments of the inside-out-turning tube 30.

One way to perform the introduction of the article into the inside-out-turning tube 30 may consist in aspirating the article inside a single tubular element. With reference to the examples illustrated by the drawings, the body of tube 30 may consist of two coaxial elements 35, 36 whose front or upper-ends 350, 360, that is, those facing the article before the inside-out-turning thereof, are so shaped as to define alternately a closed or open ring by a rotation of said two elements relative to each other and about the common longitudinal axis. A so-formed device allows inserting the article thereinside by a transverse movement when the mouth portion is in open condition (semi-ring configuration) and definitely "trapping" the same article by a closing of its perimeter.

The outer tubular element 35 has below a cylindrical closed shape; from its mid portion upwards, it exhibits a semi-cylindrical shape, that is, a wall 353 developing through about 180° on one side only with respect to the longitudinal axis, thereby defining a corresponding lateral opening or port 352 having longitudinal development; in the upper end, the element 35 exhibits a semi-ring 351 defined by a cylindrical surface of a relatively limited height and extending approximately through 180° on the side opposite to the wall 353.

The inner tubular element 36 has in its lower part, likewise the element 35, a closed cylindrical shape; from its mid portion up to the upper end 360, it exhibits a semi-cylindrical shape, that is, a wall 363 developing through approximately 180° on one side only with respect to the longitudinal axis, thereby defining a corresponding lateral opening or port 362 having longitudinal development; the upper end 360 is thus defined by the upper edge 361 of the wall 363.

When the tube 30 is in its open configuration, the semi-ring 351 of the outer element 35 encircles the edge 361 of the inner element; in this way, it is possible to introduce the article 6 inside the tube by a simple translation movement without the need of moving the tube vertically downwards by a stroke which would be substantially equal to the length of the knitted article. This brings about a significant reduction of the apparatus overall dimensions. Thereafter, by a simple relative rotation of the two elements 35 and 36 the tube 30 is closed, thereby allowing the inside-out-turning operation.

The structure of the said tube can be imagined, for example, like a tubular body inside which the article is inserted when the stitches of the last semi-rank, that is, the removed stitches, are still disposed around a circumference, that is, prior to the overturning through 180° of the first semi-rank. Thereafter, by a longitudinal movement, the article engaged on the tube is forced to pass through the open end of the tube and is thus turned inside-out. It will be appreciated that, at this point, the stocking is fitted outside the tubular body. The said tubular body, after the said movement, remains engaged with a support located on the side opposite to the article. After the hook-up operation, the now closed toe of the article will result in proximity of the tube's mouth, so that, by inserting a core of suitable size into the tube's mouth, the same core will be in contact with the article's fabric and, by keeping to move downwards will drive the same article along with it and the latter, by sliding over the edge of the tube will move thereinside by taking up the right-side out configuration which it had originally. Such operation can be carried out and/or assisted by a pneumatic or suction flow. After the ejection of the article, the above described tubular body can be brought back to its initial position to perform its function in the subsequent cycle.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. Method for joining the edges of a tubular knitted article upon the completion of the latter on a circular machine, characterized in that it comprises the following operating steps:

a) knitting the article by starting on one edge or hem to end up on the toe side by leaving the latter open;

b) moving the machine's removable parts away from the knitting head of the same circular machine so as to clear the top of the cylinder of needles;

c) removing the stitches of the last knitted rank and retaining them onto suitable removal means supported by a movable carrier between a knitting station defined by the knitting head of said machine and a closing station located at a preset distance form the other station;

d) moving said removal means together with the article away from the machine's knitting head to move the same article up to said closing station;

e) turning the article inside-out while it is retained by said removal means;

f) moving the stitches of a first semi-rank, corresponding in practice to half the stitches retained by said removal means, so that, by an overturning through approximately 180 about a diametral axis of the circumference defined by the removal means, each of the moved stitches will result juxtaposed and coaxial to the corresponding stitch of the other semi-rank's stitches;

g) moving the stitches of the pairs close to each other;

h) carrying out the hook-up of said pairs of stitches so as to obtain the definitive union of the edges of the article;

I) unloading the article from the means on which the hook-up operation has been performed.

2. Method according to claim 1, characterized in that the said step d) of moving the article away from the knitting head is performed after the step e) of inside-out-turning the article.

3. Method according to claim 1, characterized in that the said step d) of moving the article away from the knitting head is performed after the step f) of transferring the stitches.

4. Method according to claim 1, characterized in that the said step d) of moving the article away from the knitting head is performed after the step g) of approaching the stitches.

5. Method according to claim 1, characterized in that the step g) of approaching the stitches is carried out on the means that support the stitches of a second semi-rank, that is, a semi-rank of stitches which the overturned stitches are brought near to.

6. Method according to claim 1, characterized in that the step g) of approaching the stitches is carried out on the means that support the stitches of a first semi-rank, that is, a semi-rank whose stitches are overturned.

7. Method according to claim 1, characterized in that the said step h) is carried out on the same removal means.

8. Method according to claim 1, characterized in that the said step h) is carried out on means which support the pairs of stitches and do not belong to the removal means and upon the transfer of the pairs of stitches onto said means.

9. Method according to claim 1, characterized in that the article is moved back to its right-side out condition after unloading it from the support means for the hook-up.

10. Method according to claim 1, characterized in that the article is moved back to its right-side out condition by the same means which operate the said inside-out turning step e).

11. Method according to claim 1, characterized in that separate means of said movable carrier are used for the removal respectively of the stitches of the first and second semi-ranks.

12. Method according to claim 11, characterized in that the means for the removal of the stitches from the first semi-rank are moved relative to the means for the removal of the stitches from the second semi-rank.

13. Method according to claim 11, characterized in that means are used for the removal of stitches from the first semi-rank, said means being disposed along an arc of circumference having a radius different from that of a corresponding arc of circumference on which the means for the removal of the second semi-rank are disposed.

14. Method according to claim 11, characterized in that means are used for the removal of stitches from the first semi-rank which have different dimensions from those of the means for the removal of the second semi-rank.

15. Apparatus for joining the edges of a tubular knitted article upon the completion of the tubular knitted article on a circular machine, characterized in that it comprises a movable carrier able to be associated with a knitting head of a circular machine and movable between said knitting head and a closing station, said carrier supporting means for the removal of stitches of the last knitted rank, comprising means for the removal of one semi-rank, that is, of half the stitches of said last knitted rank, and means for the removal of the other semi-rank, and in that the same movable carrier is provided with driving means and transfer means able to move the stitches of one semi-rank onto the means which remove the other semi-rank.

16. Apparatus according to claim 15, characterized in that the said movable carrier comprises a support body on which hooks are provided intended to move the stitches onto the needles of the knitting head during the removal thereof.

17. Apparatus according to claim 16, characterized in that the said hooks are inserted into corresponding slots disposed vertically and exhibiting a crown for supporting the hooks which is disposed externally and coaxially to said support body.

18. Apparatus according to claim 17, characterized in that it is provided with a hollow cylindrical element or cam element interposed between the said body and said crown.

19. Apparatus according to claim 16, characterized in that the said hooks have substantially an "L" shape, the short leg of which is disposed below, and the upper end of which is inserted into an annular cavity of rectangular cross-section, externally presented by said crown, the said hooks exhibiting, in correspondence of said upper end, a groove on the outer side and a triangular portion defining a step on the inner side, said step being connected with the apex of the upper end via an oblique portion; an elastic ring being received in said grooves and retaining said ends inside said cavity thereby causing, when in open configuration, the stems of the hooks to be inclined outwardly.

20. Apparatus according to claim 17, characterized in that externally to said crown provision is made for a ring intended to move the said hooks, and being fitted on the crown for sliding vertically relative thereto, the same ring having one or more spiral slots which define corresponding cams able to drive vertically said ring upon a rotary movement of corresponding pivots inserted into the slots.

21. Apparatus according to claim 18, characterized in that the said cam element exhibits one or more slots wherein corresponding pivots are inserted for connecting the same cam element with the crown.

22. Apparatus according to claim 15, characterized in that the said removal means comprise a first semi-crown which supports the removal members of the first semi-rank and a second crown which supports the members for the removal of the second semi-rank, said members for the removal of the first semi-rank being disposed on a semicircular sector hinged on the body of the movable carrier in correspondence of two hinges disposed diametrically opposite.

23. Apparatus according to claim 15, characterized in that the said means for the removal of the first semi-rank are made up of a straight and flat body which in its distal end is tapered and provided, on the taper side, with a notch, and on the opposite side has a stem by which it is retained firmly by relevant support means.

24. Apparatus according to claim 15, characterized in that the said means for the removal of the second semi-rank are made up of a removal member with a straight and flat body which in its distal end is tapered and, on the taper side, is provided with a notch, and on the opposite side has a stem with a profile which defines a cam.

25. Apparatus according to claim 24, characterized in that it comprises an elastic means of reaction and a semi-ring, disposed and acting, with opposite directions, on said removal member.

26. Apparatus according to claim 25, characterized in that said elastic means has a reaction directed centripetally and said semi-ring interacts with the profile of said removal member.

27. Apparatus according to claim 22, characterized in that the said members for the removal of the first semi-rank are disposed on said semi-crown along an arc of circumference having a radius different from that of a corresponding arc of circumference on which the means for the removal of the second semi-rank are disposed.

28. Apparatus according to claim 22, characterized in that the said members for the removal of the first semi-rank have dimension different from that of the members for the removal of the second semi-rank.

29. Apparatus according to claim 22, characterized in that it comprises a stitch-pushing semi-crown able to push the stitches of the article along the first semi-rank- removing members and move them up onto the second semi- rank-removing members.

30. Apparatus according to claim 22, characterized in that it comprises a second stitch-pushing semi-crown able to push the pairs of stitches of article, which are engaged on the second semi-rank-removing members, onto corresponding means provided in the closing and hooking- up station.

31. Apparatus according to claim 29, characterized in that the said semi-crowns are substantially comb- like shaped, with a series of slots angularly spaced apart by extents corresponding to the relevant angular displacements existing between respective first and second semi-rank-removing members.

32. Apparatus according to claim 15, characterized in that it comprises a device for turning the article inside-out.

33. Apparatus according to claim 32, characterized in that the inside-out turning device comprises a inside-out-turning tube movable between two positions for the inside-out-turning operation, and within which the article is introduced before being turned inside-out.

34. Apparatus according to claim 33, characterized in that it comprises means able to generate a pneumatic flow inside said inside-out-turning tube.

35. Apparatus according to claim 32, characterized in that it comprises an inside-out-turning tube made up of two coaxial elements fitted one onto the other and whose front ends, that is, those facing the article prior to the inside-out-turning operation, are so shaped as to define, alternately, a closed ring or an open semi-ring by a rotation of the two elements relative to each other and about the common longitudinal axis.

36. Apparatus according to claim 35, characterized in that the outer tubular element exhibits, in correspondence of said end, a semi-ring defined by a cylindrical surface extending through 180 approximately.

37. Apparatus according to claim 35, characterized in that the inner tubular element exhibits, in correspondence of its end, a semi-cylindrical shape, that is, a wall developing over 180 approximately on one side only with respect to the longitudinal axis.

* * * * *